US008650028B2

(12) United States Patent
Su et al.

(10) Patent No.: US 8,650,028 B2
(45) Date of Patent: Feb. 11, 2014

(54) MULTI-MODE SPEECH ENCODING SYSTEM FOR ENCODING A SPEECH SIGNAL USED FOR SELECTION OF ONE OF THE SPEECH ENCODING MODES INCLUDING MULTIPLE SPEECH ENCODING RATES

(75) Inventors: Huan-Yu Su, San Clemente, CA (US); Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 830 days.

(21) Appl. No.: 12/229,324

(22) Filed: Aug. 20, 2008

(65) Prior Publication Data

US 2009/0024386 A1 Jan. 22, 2009

Related U.S. Application Data

(63) Continuation of application No. 12/218,242, filed on Jul. 11, 2008, which is a continuation of application No. 11/827,915, filed on Jul. 12, 2007, which is a continuation of application No. 11/251,179, filed on Oct. 13, 2005, now Pat. No. 7,266,493, which is a continuation of application No. 09/663,002, filed on Sep. 15, 2000, now Pat. No. 7,072,832, which is a continuation-in-part of application No. 09/154,660, filed on Sep. 18, 1998, now Pat. No. 6,330,533.

(51) Int. Cl.
*G10L 19/00* (2013.01)

(52) U.S. Cl.
USPC ..... 704/219

(58) Field of Classification Search
USPC ..... 704/219–223
See application file for complete search history.

(56) References Cited

U.S. PATENT DOCUMENTS 4,653,098 A 3/1987 Nakata et al.
4,720,861 A 1/1988 Bertrand (Continued)

FOREIGN PATENT DOCUMENTS

EP 04 21 360 4/1991
EP 462558(A2) 12/1991

(Continued)

OTHER PUBLICATIONS

*Digital cellular telecommunications system (Phase 2); Enhanced Full Rate (EFR) speech transcoding; (GSM 06.60 version 4.1.0)*, European Telecommunications Standards Institute Draft EN 301 245 V4.1.0, 1-47 (Jun. 1998).

(Continued)

*Primary Examiner* — Michael N Opsasnick
(74) *Attorney, Agent, or Firm* — Farjami & Farjami LLP

(57) ABSTRACT

A method comprises analyzing each frame of a plurality of frames of the speech signal to determine one or more speech parameters for the speech signal; deciding, for each frame of the plurality of frames of the speech signal, based on the one or more speech parameters of the speech signal, to select one of a plurality of encoding modes including a first encoding mode and a second encoding mode for encoding each frame of the plurality of frames of the speech signal; encoding each frame of the plurality of frames of the speech signal according to the selected one of the plurality of encoding modes for each frame of the plurality of frames in the deciding; the first encoding mode supports a first encoding rate and the second encoding mode supports a second encoding rate, wherein the first encoding rate is the same encoding rate as the encoding rate.

22 Claims, 18 Drawing Sheets

(56) References Cited

U.S. PATENT DOCUMENTS 4,969,192 A 11/1990 Chen et al.
4,980,516 A 12/1990 Nakagawa
4,980,916 A 12/1990 Zinser
5,007,092 A 4/1991 Galand
5,060,269 A 10/1991 Zinser
5,086,471 A 2/1992 Tanaka et al.
5,097,508 A 3/1992 Valenzuela Steude
5,138,661 A 8/1992 Zinser
5,199,076 A 3/1993 Taniguchi
5,233,660 A 8/1993 Chen
5,235,669 A 8/1993 Ordentlich
5,293,449 A 3/1994 Tzeng
5,313,554 A 5/1994 Ketchum
5,327,520 A 7/1994 Chen
5,339,384 A 8/1994 Chen
5,382,949 A 1/1995 Mock
5,414,796 A 5/1995 Jacobs
5,490,230 A 2/1996 Gerson et al.
5,491,771 A 2/1996 Gupta
5,495,555 A 2/1996 Swaminathan
5,517,595 A 5/1996 Kleijn
5,528,727 A 6/1996 Wang
5,537,509 A 7/1996 Swaminathan
5,541,955 A 7/1996 Jacobsmeyer
5,548,680 A 8/1996 Cellario
5,553,191 A 9/1996 Minde
5,583,969 A 12/1996 Yoshizumi
5,596,676 A 1/1997 Swaminathan
5,602,913 A 2/1997 Lee
5,615,298 A 3/1997 Chen
5,630,016 A 5/1997 Swaminathan
5,651,091 A 7/1997 Chen
5,657,418 A 8/1997 Gerson
5,657,420 A 8/1997 Jacobs et al.
5,664,055 A 9/1997 Kroon
5,680,507 A 10/1997 Chen
5,682,404 A 10/1997 Miller
5,689,615 A 11/1997 Benyassine
5,692,101 A 11/1997 Gerson
5,699,477 A 12/1997 McCree
5,699,485 A 12/1997 Shoham
5,704,003 A 12/1997 Kleijn et al.
5,719,993 A 2/1998 Kleijn
5,732,188 A 3/1998 Moriya
5,732,389 A 3/1998 Kroon et al.
5,734,789 A 3/1998 Swaminathan
5,742,734 A 4/1998 DeJaco
5,745,871 A 4/1998 Chen
5,751,903 A 5/1998 Swaminathan
5,752,223 A 5/1998 Aoyagi et al.
5,774,835 A 6/1998 Ozawa
5,774,836 A 6/1998 Bartkowiak et al.
5,774,838 A 6/1998 Miseki et al.
5,774,846 A 6/1998 Morii
5,778,335 A 7/1998 Ubale et al.
5,778,338 A * 7/1998 Jacobs et al. ..... 704/223
5,799,131 A 8/1998 Taniguchi
5,799,271 A 8/1998 Byun et al.
5,812,965 A 9/1998 Massaloux
5,828,672 A 10/1998 Labonte
5,854,845 A 12/1998 Itani
5,864,798 A 1/1999 Miseki
5,878,388 A 3/1999 Nishiguchi et al.
5,884,010 A 3/1999 Chen
5,884,251 A 3/1999 Kim et al.
5,890,108 A 3/1999 Yeldener
5,891,118 A 4/1999 Toyoshima
5,893,060 A 4/1999 Honkanen
5,903,866 A 5/1999 Shoham
5,924,061 A 7/1999 Shoham
5,960,389 A 9/1999 Jarvinen
5,970,442 A 10/1999 Timner
5,974,375 A 10/1999 Aoyagi et al.
5,978,366 A 11/1999 Massingill
5,978,761 A 11/1999 Johansson
5,982,766 A 11/1999 Nystrom
5,991,600 A 11/1999 Anderson
5,995,539 A 11/1999 Miller
6,003,001 A 12/1999 Maeda
6,006,177 A 12/1999 Funaki
6,014,618 A 1/2000 Patel
6,029,128 A 2/2000 Jarvinen
6,052,660 A 4/2000 Sano
6,052,661 A 4/2000 Yamaura et al.
6,058,359 A 5/2000 Hagen
6,058,362 A 5/2000 Malvar
6,064,962 A 5/2000 Oshikiri
6,067,518 A 5/2000 Morii
6,073,092 A 6/2000 Kwon
6,104,992 A 8/2000 Gao
6,138,001 A 10/2000 Nakamura
6,151,571 A 11/2000 Pertrushin
6,167,031 A 12/2000 Olofsson
6,173,257 B1 1/2001 Gao
6,182,030 B1 1/2001 Hagen
6,182,032 B1 1/2001 Rapeli
6,188,980 B1 2/2001 Thyssen
6,199,035 B1 3/2001 Lakaniemi
6,233,550 B1 * 5/2001 Gersho et al. ..... 704/208
6,240,386 B1 5/2001 Thyssen
6,246,979 B1 6/2001 Carl
6,249,758 B1 6/2001 Mermelstein
6,256,606 B1 7/2001 Thyssen
6,260,010 B1 7/2001 Gao et al.
6,298,139 B1 10/2001 Poulsen
6,308,081 B1 10/2001 Kolmonen
6,330,533 B2 12/2001 Su et al.
6,334,105 B1 12/2001 Ehara
6,345,247 B1 2/2002 Yasunaga
6,347,081 B1 2/2002 Bruhn
6,353,810 B1 3/2002 Pertushin
6,385,573 B1 5/2002 Gao
6,393,295 B1 5/2002 Butler
6,412,540 B2 7/2002 Hendee
6,418,408 B1 7/2002 Bhaskar
6,424,938 B1 7/2002 Johansson
6,470,309 B1 10/2002 Mccree
6,470,312 B1 10/2002 Suzuki
6,507,814 B1 1/2003 Gao
6,539,205 B1 3/2003 Wan
6,574,211 B2 6/2003 Padovani
6,574,593 B1 6/2003 Gao
6,584,441 B1 6/2003 Ojala
6,604,070 B1 8/2003 Gao
6,606,593 B1 8/2003 Jarvinen
6,633,841 B1 10/2003 Thyssen
6,636,829 B1 10/2003 Benyassine et al.
6,658,064 B1 12/2003 Rotola-Pukkila
6,680,920 B1 1/2004 Wan
6,691,082 B1 2/2004 Aguilar
6,738,739 B2 5/2004 Gao
6,757,654 B1 6/2004 Westerlund
6,804,218 B2 10/2004 El-Maleh
6,819,661 B2 11/2004 Okajima
6,823,303 B1 11/2004 Su
6,865,534 B1 3/2005 Murashima
6,959,274 B1 10/2005 Gao
7,072,832 B1 7/2006 Su et al.
7,103,538 B1 9/2006 Gao
7,120,578 B2 10/2006 Thyssen
7,266,493 B2 9/2007 Su
7,272,556 B1 9/2007 Aguilar
7,444,283 B2 10/2008 Lin
7,454,330 B1 11/2008 Nishiguchi
7,500,018 B2 3/2009 Hakansson
7,590,096 B2 9/2009 El-Maleh
2001/0046843 A1 11/2001 Alanara
2002/0138256 A1 9/2002 Thyssen

(56) References Cited

U.S. PATENT DOCUMENTS

| | | | |
|---|---|---|---|
| 2005/0143986 | A1 | 6/2005 | Patel |
| 2008/0052068 | A1 | 2/2008 | Aguilar |

FOREIGN PATENT DOCUMENTS

| | | | |
|---|---|---|---|
| EP | 462559(A2) | | 12/1991 |
| EP | 05 00 095 | | 8/1992 |
| EP | 462558(A3) | | 8/1992 |
| EP | 462559(A3) | | 8/1992 |
| EP | 05 32 225 | | 3/1993 |
| EP | 565504(A1) | | 10/1993 |
| EP | 0 628 947 | A1 | 12/1994 |
| EP | 06 28 947 | | 12/1994 |
| EP | 07 20 145 | | 7/1996 |
| EP | 462559(B1) | | 5/1997 |
| EP | 462558(B1) | | 5/1998 |
| EP | 08 49 887 | | 6/1998 |
| EP | 08 52 376 | | 7/1998 |
| EP | 08 77 355 | | 11/1998 |
| EP | 877355(A2) | | 11/1998 |
| EP | 877355(A3) | | 6/1999 |
| EP | 832482(B1) | | 10/2001 |
| EP | 0496427 | B1 | 1/2002 |
| EP | 1010267(B1) | | 2/2002 |
| EP | 565504(B1) | | 6/2002 |
| EP | 819302(B1) | | 6/2002 |
| EP | 680034(B1) | | 7/2002 |
| EP | 763818(B1) | | 5/2003 |
| EP | 877355(B1) | | 5/2003 |
| EP | 1372289(A2) | | 12/2003 |
| EP | 768770(B1) | | 1/2004 |
| EP | 1050040(B1) | | 8/2006 |
| EP | 1372289(B1) | | 7/2008 |
| EP | 2 259 255 | | 12/2010 |
| GB | 2332598(A) | | 6/1999 |
| GB | 2344722(A) | | 6/2000 |
| JP | HO5-083157 | | 4/1993 |
| JP | 8-130515 | | 5/1996 |
| JP | H9-187077 | | 7/1997 |
| JP | 10-116097 | | 5/1998 |
| JP | 2010-181889 | | 8/2010 |
| JP | 2010-181890 | | 8/2010 |
| JP | 2010-181891 | | 8/2010 |
| JP | 2010-181892 | | 8/2010 |
| JP | 2010-181893 | | 8/2010 |
| WO | 92/22891 | | 12/1992 |
| WO | WO 9315558 | A2 | 8/1993 |
| WO | 95/28824 | | 11/1995 |
| WO | WO 96/35208 | | 11/1996 |
| WO | WO 97/33402 | | 9/1997 |
| WO | WO 9850910 (A1) | | 11/1998 |
| WO | WO 9916050 | A1 | 4/1999 |
| WO | WO 0013448(A2) | | 3/2000 |

OTHER PUBLICATIONS

Taniguchi, et al., *Enhacement of VSELP Coded Speech under Background Noise*, Speech Coding for Telecommunications, 1995. Proceedings, 1995 IEEE Workshop on Volume, pp. 67-68 (Sep. 1995).

Ekudden, et al., The Adaptive Multi-Rate Speech Coder, Ericsson Research, 117-119 (1999).

J. Kleider & W. Campbell, "An Adaptive-Rate Digital Communication System for Speech," Proceedings of the 1997 IEEE International Conference on Acoustics, Speech, and Signal Processing (ICASSP'97) (Apr. 21-24, 1997), vol. 3, pp. 1695-1698 ("Kleider").

GSM 05.08: Digital Cellular telecommunications system (Phase 2+); Radio Subsystem link control (GSM 05.08), Jul. 1996.

H. Liu,et al. "Error Control schemes for networks: An Overview,", *Mobile Networks and Applications* 2 (1997).

J. Pons, et al. "Bit Error Rate Based Link Adaption for GSM,", 1998 IEEE.

PIMRC'98 Call for Papers, Sep. 8-11, 1998.

J. Wigard, et al."Ber and FER Prediction of Control and Traffic Channels for a GSM Type of Air-Interface," 1998 IEEE.

"TIA/EIA Interim Standard, Enhanced Variable Rate Codec, Speech Service Option 3 for Wideband Spread Spectrum Digital Systems, TIA/EIA/IS-127," Telecommunications Industry Association, Jan. 1997 ("EVRC IS-127").

G. Chahine, et al.Pitch Modelling for Speech Coding at 4.8 kbits/s,1993.

H. Kim, "Adaptive Encoding of Fixed Codebook in CELP Coders", 1998 IEEE.

W. Kleijn, et al."Improved Speech Quality and Efficient Vector Quantization in SELP", 1998 IEEE.

W.Kleijn, et al."Generalized Analysis-By-Synthesis Coding and Its Application to Pitch Prediction", 1992 IEEE.

"Speech Classification Embedded in Adaptive Codebook Search for Low Bit-Rate CELP Coding," C. Kuo, F. Jean, H. Wang, 1995 IEEE.

"A High Quality BI-CELP Speech Coder at 8 KBIT/S and Below," S. Kwon, H. Park, H.Chang, 1997 IEEE.

"A Fast Pitch Searching Algorithm Using Correlation Characteristics in CELP Vocoder," J.Lee, H. Jeon, M. Bae, S. Ann, 1994 IEEE.

"A New Fast Pitch Search Algorithm Using the Abbreviated Correlation Function in CELP Vocoder," J. Lee, M. Bae, H. Yoo, 1996 IEEE.

"Theory and Implementation of the Digital Cellular Standard Voice Coder: VSELP on the TMS320C5x: Application Report," J. Macres, Oct. 1994.

"Adaptive Code Excited Linear Predictive Coder (ACELP)," J. Menez, C. Garland, M. Rosso, F. Bottau, 1989 IEEE.

"Analysis by Synthesis Speech Coding with Generalized Pitch Prediction," P. Mermelstein, Y. Qian, 1999 IEEE.

"2.4KBPS Pitch Prediction Multi-Pulse Speech Coding," S. Ono, K. Ozawa, 1988 IEEE.

"M-LCELP Speech Coding at 4KBPS," K. Ozawa, M. Serizawa, T. Miyano, T. Nomura,1994 IEEE.

"Stability and Performance Analysis of Pitch Filters in Speech Coders," R. Ramachandran, P. Kabal, 1987 IEEE.

"Design and Description of CS-ACELP: A Toll Quality 8 kb/s Speech Coder," R. Salami, C. Laflamme, J. Adoul, A. Kataoka, S. Hayashi, T. Moriya, C. Lamblin, D. Massaloux, S. Proust, P. Kroon, Y. Shoham, 1998 IEEE.

"Design of a Variable Half Rate Speech Codec," H. Sung, S. Kang, D. Lee, 1999 IEEE.

"Smoothing the Evolution of the Spectral Parameters in Speech Coders," M. Zad-Issa, Jan. 1998.

ETS 300 726, "Digital Cellular Telecommunications System; Enhanced Full Rate (EFR) Speech Transcoding" (GSM 06.60 version 5.1.2): Mar. 1997.

Draft standard GSM EFR 06.10 (Enhanced Full Rate Speech Transcoding) (Nov. 23, 1995)("GSM 06.10").

Chen & Gersho, "Adaptive Postfiltering for Quality Enhancement of Coded Speech," IEEE Trans. on Speech and Audio Processing, vol. 3 No. 1 (Jan. 1995), pp. 59-71 ("Chen &Gersho").

"A Toll Quality 8 Kb/s Speech Codec for the Personal Communications System (PCS)," R.Salami, C. Laflamme, J. Adoul, D. Massaloux, 1994 IEEE.

General Aspects of Digital Transmission Systems, Coding of Speech at 8 kbit/s Using Conjugate-Structure Algebraic-Code-Excited Linear-Prediction (CS-ACELP), ITU-T Recommendation G.729 (Mar. 1996).

Excerpt from *Advances in Speech Coding*, B. Atal, V. Cuperman, A. Gersho, 1991, Springer.

Vainio, J., et al. "GSM EFR Based Multi-Rate Codec Family" Proc. of 1998 IEEE Int'l Conf. on Acoustics, Speech and Signal Processing (ICASSP), May 12-15, 1998, vol. 1, pp. 141-144.

"Real-Time Communication in Packet-Switched Networks", C. Aras, J. Kurose, D. Reeves, H. Schulzrinne, 1994.

"Techniques, Perception, and Applications of Time-Compressed Speech," B. Arons, 1992.

"Wideband Quality DPCM-AQF Speech Digitizers for Bit Rates of 16-32 kb/s", C. Cengiz, P. Patrick, C. Xydeas, 1983.

"Digital Audio Compression", D. Pan, Digital Technical Journal, vol. 5 No. 2, Spring 1993.

"Low Bit-Rate Speech Coders for Multimedia Communication", R. Cox, *IEEE Communications Magazine*, Dec. 1996.

(56) References Cited

OTHER PUBLICATIONS

Digital cellular telecommunications system (Phase 2); Enhanced Full Rate (EFR) speech processing functions; General Description (GSM 06.51 version 4.0.1), European Telecommunications Standards Institute EN 301 243 V4.0.1 (Dec. 1997).
"The Dual Excitation Speech Model", J. Hardwick , 1992 Massachusetts Institute of Technology.
"Transmission of multimedia data over lossy networks", M. Isenberg, Aug. 1996.
"Subband-Multipulse Digital Audio Broadcasting for Mobile Receivers", X. Lin, L. Hanzo, R. Steele, W.T. Webb, 1993 IEEE.
"Dynamic Bit Allocation in Subband Coding of Wideband Audio with Multipulse LPC", P. Menardi, G. Mian, G. Riccardi, 1994.
"Variable Bit-Rate CELP Coding of Speech with Phonetic Classification," E. Paksoy, K. Srinivasan, A. Gersho, *European Transactions on Telecommunications and Related Technologies*, vol. 5, No. 5, Sep.-Oct. 1994.
"Low Bit Rate Speech Coding for Multimedia and Wireless Communications", R. Salami,*International Workshop on Circuits, Systems and Signal Processing for Communications*, Apr. 23-26, Tampere, Finland, 2002.
"Voice Communication Across the Internet: a Network Voice Terminal", H. Schulzrinne, Jul. 29, 1992.
"Speech Coding: A Tutorial Review", A. Spanias, *Proceedings of the IEEE*, vol. 82, No. 10, Oct. 1994.
Telephone Transmission Quality: Methods for Objective and Subjective Assessment of Quality, ITU-T Recommendation p. 830, (Feb. 1996).
"Hidden Markov Model Decomposition of Speech and Noise", A. Varga, R. Moore, 1990.
"Low rate speech coding for telecommunications", W. Wong, R. Mack, B. Cheatham, X. Sun, *BT Technology Journal*, vol. 14, No. 1, Jan. 1996.
"Real-Time Implementation of a Variable Rate CELP Speech Codec," R. Zopf, 1993.
Gardner, Jacobs and Lee, "QCELP: A Variable Rate Speech Coder for CDMA Digital Cellular, in Speech and Audio Coding for Wireless and Network Applications" (Ed. B.S. Atal, V. Cuperman, A. Gersho), Kluwer Academic Publishers, Norwell, MA, 1993, pp. 85-92. ("QCELP Chapter").
"Audio Compression", P. Herget, 1996.
GSM 06.51 V5.1.2 (Mar. 1997) ("GSM 06.51").
R. Di Francesco et al, "Variable Rate Speech Coding with online segmentation and fast algebraic codes," S4b.5; pp. 233-236; CH2847-2/90/000-0233, 1990 IEEE.
TIA/EIA Telecommunications Systems Bulletin, Interoperable Implementations Issues in IS-641, TSB77 (Dec. 1996).
Draft ver. 0.0.1 of 06.71 "Adaptive Multi-Rate Speech Processing Functions; General Description" (Nov. 23-27, 1998) ("GSM 06.71").
Pettigrew, R.; Cuperman, V., "Backward pitch prediction for low-delay speech coding," *Global Telecommunications Conference, 1989, and Exhibition. Communications Technology for the 1990s and Beyond. GLOBECOM '89., IEEE* , vol. 2, pp. 1247-1252, Nov. 27-30, 1989.
TIA/EIA IS-641-A TDMA Cellular/PCS-Radio Interface Enhanced Full-Rate Voice Codec, Revision A, 1996.
Woodward, J.P., and Hanzo, L., A Range of Low and High Delay CELP Speech Codecs Between 8 and 4 kbits/s, *Digital Signal Processing* 7 (1997), pp. 37-46.
I. Gerson & M. Jasiuk, "Vector Sum Excited Linear Prediction (VSELP)," Advances in Speech Coding (ed. B. Atal et al.) (1991) at pp. 69-79.
Ito et al., "An Adaptive Multi-Rate Speech Codec Based on MP-CELP Coding Algorithm for ETSI AMR Standard," Proc. of 1998 IEEE Int'l Conf. on Acoustics, Speech and Signal Processing (ICASSP), May 12-15, 1998, vol. 1, pp. 137-140.
Certificate of Correction for Patent 5,199,076 dated Jan. 25, 1994.
Certificate of Correction for Patent 5,799,131 dated Nov. 30, 1999.
Certificate of Correction for Patent 7,444,283 B2 dated Apr. 14, 2009.
Certificate of Correction for Patent 5,742,734 dated Aug. 2, 2005.
Certificate of Correction for Patent 6,606,593 B1 dated Feb. 3, 2004.
Lawrence R. Rabiner and Ronald W. Schafer, *Digital Processing Of Speech Signals*, pp. 1-37 and 396-461.
W. Bastiaan Kleijn and Peter Kroon, *The RCELP Speech-Coding Algorithm*, vol. 5, No. 5, Sep.-Oct. 1994, pp. 39/573-47/581.
C. Laflamme, J-P. Adoul, H.Y. Su, and S. Morissette, *On Reducing Computational Complexity of Codebook Search in CELP Coder Through the Use of Algebraic Codes*, 1990, pp. 177-180.
Chin-Chung Kuo, Fu-Rong Jean, and Hsiao-Chuan Wang, *Speech Classification Embedded in Adaptive Codebook Search for Low Bit-Rate CELP Coding*, IEEE Transactions on Speech and Audio Processing, vol. 3, No. 1, Jan. 1995, pp. 1-5.
Erdal Paksoy, Alan McCree, and Vish Viswanathan, *A Variable-Rate Multimodal Speech Coder With Gain-Matched Analysis-By-Synthesis*, 1997, pp. 751-754.
Gerhard Schroeder, *International Telecommunication Union Telecommunications Standardization Sector*, Jun. 1995, pp. i-iv, 1-142.
*Digital Cellular Telecommunications System; Comfort Noise Aspects for Enhanced Full Rate (EFR) Speech Traffic Channels (GSM 06.62)*, May 1996, pp. 1-16.
W.B. Kleijn and K.K. Paliwal (Editors), Speech Coding and Synthesis, Elsevier Science B.V.; A. Das, E. Paskoy and A. Gersho (Authors), Chapter 7: *Multimode and Variable-Rate Coding of Speech*, 1995, pp. 257-288.
B.S. Atal, V. Cuperman, and A. Gersho (Editors), Speech and Audio Coding for Wireless and Network Applications, Kluwer Academic Publishers; T. Taniguchi, Y. Tanaka and Y. Ohta (Authors), Chapter 27: *Structured Stochastic Codebook and Codebook Adaptation for CELP*, 1993, pp. 217-224.
B.S. Atal, V. Cuperman, and A. Gersho (Editors), Advances in Speech Coding, Kluwer Academic Publishers; I.A. Gerson and M.A. Jasiuk (Authors), Chapter 7: *Vector Sum Excited Linear Prediction (VSELP)*, 1991, pp. 69-79.
B.S. Atal, V. Cuperman, and A. Gersho (Editors), Advances in Speech Coding, Kluwer Academic Publishers; J.P. Campbell, Jr., T.E. Tremain, and V.C. Welch (Authors), Chapter 12: *The DOD 4.8 KBPS Standard (Proposed Federal Standard 1016)*,1991, pp. 121-133.
B.S. Atal, V. Cuperman, and A. Gersho (Editors), Advances in Speech Coding, Kluwer Academic Publishers; R.A. Salami (Author), Chapter 14, *Binary Pulse Excitation: A Novel Approach to Low Complexity CELP Coding*, 1991, pp. 145-157.
Kazunori Ozawa and Taskashi Araseki, *Multipulse Excited Speech Coding Utilizing Pitch Information at Rates Between 9.6 and 4.8 kbits/s*, Systems and Computers in Japan, vol. 21 No. 13, 1990.
S. Ghaemmaghami and M. Deriche, *A New Approach to Efficient Interpolative Dtermination of Pitch Contour Using Temporal Decomposition*, IEEE Proceedings of Digital Processing Application, 1996, pp. 125-130.
Roch Lefebvre and Claude LaFlamme, *Shaping Coding Noise With Frequency-Domain Companding*, IEEE publication, 1997, pp. 61-62.
W. Bastiaan Klejian, Ravi P. Ramachandran and Peter Kroon, *Generalized Analysis-by-Synthesis Coding and Its Application To Pitch Prediction*, IEEE, 1992, pp. 1-337-1-340.
W. Bastiaan Klejian, Ravi P. Ramachandran and Peter Kroon, *Interpolation of the Pitch-Predictor Parameters in Analysis-by-Synthesis Speech Coders*, IEEE Transactions on Speech and Audio Processing, vol. 2, No. 1, Part 1, 1994, pp. 42-54.
Jean Rouat, Yong Chun Liu, and Daniel Morissette, *A Pitch Determination and Viced/Unvoiced Decision Algorithm for Noisy Speech*, 1997 Elsevier B.V., Speech Communication, 21 (1997), pp. 191-207.
*Enhanced Variable Rate Codec, Speech Service Option 3 for Wideband Spread Spectrum Digital Systems*, TIA/EIA/IS-127 (Jan. 1997).
*Dual Rate Speech Coder for Multimedia Communications Transmitting at 5.3 and 6.3 kbit/s*, ITU-T Recommendation G.723.1, 1-27 (Mar. 1996).
*Coding of Speech at 9 kbit/s Using Conjugate-Structure Algebraic-Code-Excited Linear-Prediction (CS-ACELP)*, ITU-T Recommendation G.729, 1-35 (Mar. 1996).

(56) References Cited

OTHER PUBLICATIONS

Hong Kook Kim, *Adaptive Encoding of Fixed Codebook in CELP Coders*, Proceedings of the 1998 IEEE International Conference on Acoustics, Spech and Signal Processing, vol. 1, pp. 149-152 (May 1998).
Josep M. Salavedra and Enrique Masgrau, *APVQ Encoder Applied to Wideband Speech Coding*, Proceedings of ICSLP '96—Fourth International Conference on Spoken Language Processing, vol. 2, pp. 941-944 (Oct. 1996).
Tomohiko Taniguchi, Mark Johnson, and Yasuji Ohta, *Pitch Sharpening for Perceptually Improved CELP, and the Sparse-Delta Codebook for Reduced Computation*, Proceedings of ICASSP '91—IEEE International Conference on Acoustics, Speech, and Signal Processing, vol. 1, pp. 241-244 (May 1991).
U.S. Appl. No. 60/109,556, filed Nov. 23, 1998, Johansson.
"High level description: Source coding part of the Nokia AMR speech codec candidate," by Nokia, ETSI SMG11 AMR#10, Stockholm, Sweden, Jun. 3-5, 1998, Tdoc SMG11 AMR74/98.
Draft standard GSM 06.51 (Enhanced full rate speech processing functions: General description), ETSI SMG2 Speech Experts Group (Jan. 12, 1996).
ETSI Technical Specification GSM 04.03, May 1996, Version 5.0.0.
ETSI Technical Specification GSM 04.08, Dec. 1995, Version 5.0.0.
ETSI Technical Specification GSM 05.02, May 1996, Version 5.0.0.
Siegmund M. Redl et al., An Introduction to GSM (1995).
Zopf, "Real-time Implementation of a Variable Rate CELP Speech Codec," Simon Fraser University, May 1995. ("Zopf").
Enhanced Variable Rate Codec (EVRC), Speech Service Option 3 for Wideband Spread Spectrum Digital Systems, ARIB STD-T64-C. S0014-0 v1.0, 3GPP2-WG of Association of Radio Industries and Businesses (ARIB) based upon the 3GPP2 specification, C.S0014-0 v1.0, 2004.
File History for U.S. Appl. No. 60/109,556.
Digital cellular telecommunications system (Phase 2); Enhanced Full Rate (EFR) speech transcoding; (GSM 06.60 version 4.1.0) Draft EN 301 245 V4.1.0 (Jun. 1998).
Defendants' Disclosure of Claim Terms and Proposed Constructions, Case 3:09-cv-00447-REP, Document 188, Filed Dec. 14, 2009, pp. 1-8.
U.S Civil Docket Index for Case #: 3:09-cv-00447-REP, As of: Mar. 14, 2011 05:44 PM EDT, pp. 1-38.
File History for U.S. Appl. No. 09/663,002.
File History for U.S. Appl. No. 11/251,179.
File History for U.S. Appl. No. 12/220,480.
Vien V. Nguyen, Vladimir Goncharoff, and John Damoulakis, "Correcting Spectral Envelope Shifts in Linear Predictive Speech Compression Systems", Proceedings of the Military Communications Conference (Milcom '90), vol. 1, 1990, pp. 354-358.
Masaaki Honda, "Speech Coding Using Waveform Matching Based on LPC Residual Phase Equalization", International Conference on Acoustics, Speech & Signal Processing (ICASSP '90), vol. 1, pp. 213-216.
File History for U.S. Appl. No. 12/321,934.
File History for U.S. Appl. No. 12/069,973.
Changchun, Two Kinds of Pitch Predictors in Speech Compressing Coding, Journal of Electronics, vol. 14 No. 3 (Jul. 1997).
LeBlanc, Efficient Search and Design Procedures for Robust Multi-Stage VQ of LPC Parameters for 4 kb/s Speech Coding, IEEE Transactions on Speech and Audio Processing, vol. 1, No. 4, (Oct. 1993).
Ney, Dynamic Programming Algorithm for Optimal Estimation of Speech Parameter Contours, IEEE Transactions on Systems, Man, and Cybernetics, vol. SMC-13, No. 3 (Mar./Apr. 1983).
Shlomot, Delayed Decision Switched Prediction Multi-Stage LSF Quantization, Rockwell Telecommunication, IEEE Trans. on Speech . . . ; 1995;pp. 45-46.
File History for U.S. Appl. No. 60/097,569.
File History for U.S. Appl. No. 12/218,242.
TIA/EIA IS-641-A, TDMA Cellular/PCS—Radio Interface Enhanced Full-Rate Voice Codec, Revision A, 1998.
J. Sohn and W. Sung, "A Voice Activity Detection Employing Soft Decision Based Noise Spectrum Adaptation", in *Proc. Int. Conf. on Acoust., Speech, Signal Processing*, Seattle, WA, USA, pp. 365-368 (May 1998).
"Enhanced Variable Rate Codec, Speech Service Option 3 for Wideband Spread Spectrum Digital Systems", 3GPP2 C.S0014-A, Version 1.0, Version Date: Apr. 2004.
Itakura, "Line Spectrum Representation of Linear Predictive Coefficients of Speech Signals", *Journal of the Acoustic Society of America*, vol. 57, p. S35, 1975.
Deller, J.R., et al. "Discrete-Time Processing of Speech Signals" (Wiley-Interscience, 1993).
Yang, Gao et al "A Reliable Postprocessor for Pitch Determination Algorithms" Lab T.C.T.S, Faculte Polytechnique de Mons, Belgium, Lernout & Hauspie Speechproducts n.v., Wemmel, Belgium. Sep. 16, 1993 4 pages.
Yang, Gao et al "A Fast CELP Vocoder with Efficient Computation of Pitch" Lab T.C.T.S, Faculte Polytechnique de Mons 31, Boulevard Dolez, B-7000 Mons, Belgium, Lernout & Hauspie Speechproducts n.v Rozendaalstraat, 14, 8900 Ieper, Belgium. 1992 pp. 511-514.
Lupini, et al, "A Multi-Mode Variable Rate CELP Coder Based on Frame Classification" Communications Science Laboratory, School of Engineering Science, Simon Fraser University, B.C., Canada. MPR TelTech Ltd., Burnaby, B.C., Canada. pp. 406-409 (1993).
Paksoy, et al "A Variable-Rate Multimodal Speech Coder with Gain-Matched Analysis-By-Synthesis" Corporate Research, Texas Instruments, Dallas, TX, Copyright 1997, pp. 751-754.
"General Aspects of Digital Transmission Systems: Dual Rate Speech Coder For Multimedia Communications Transmitting at 5.3 and 6.3 kbit/s" ITU-T Recommendation G.723.1 (Mar. 1996) Geneva, 1996 33 Pgs.
Paksoy, et al "Variable Bit-Rate CELP Coding of Speech with Phonetic Classification (1)" Center for Information Processing Research. Department of Electrical Computer Engineering, University of California Santa Barbara, CA 93106—USA 11 pgs.
Di Francesco, et al "Variable Rate Speech Coding with Online Segmentation and Fast Algebraic Codes" Frnce Telecom, CNET LAA/TSS/CMC. 22301 Lannion Cedex, France pp. 233-236.
"Digital Cellular Telecommunications System (Phase 2); Enhanced Full Rate (EFR) speech processing functions; General description (GSM 06.51 version 4.0.1)" European Telecommunications Standards Institute, Global System For Mobile Telecommunications. 1997—12 pgs. 1-11.
"Enhanced Variable Rate Codec, Speech Service Option 3 for Wideband Spread Spectrum Digital Systems" TIA/EIA Interim Standard. Telecommunications Industry Association. Jan. 1997. pp. 1-142.
Kleijn, et al "Improved Speech Quality and Efficient Vector Quantization" AT&T Bell Laboratories, Naperville, IL 1988. pp. 155-158.
Cellario, et al "CELP Coding at Variable Rate" CSELT Via G. Reiss Romoli 274, 10148 Torino-Italy. vol. 5. No. 5 Sep.-Oct. 1994 pp. 69-80.
Lupini, et al "A Multi-Mode Variable Rate CELP Coder Based on Frame Classification" Communications Science Laboratory, School of Engineering, Science, Simon Fraser University, B.C. Canada, MPR TelTech Ltd., Burnaby, B.C., Canada 1993 pp. 406-409.
Ojala, Pasi "Toll Quality Variable-Rate Speech Codec" Speech and Audio Systems Laboratory, Nokia Research Center, Tampere, Finland Copyright 1997 pp. 747-750.
Das, et al "A Variable-Rate Natural-Quality Parametric Speech Coder" Center for Information Processing Research Department of Electrical & Computer Engineering. University of California, Santa Barbara, CA 93106 copyright 1994 pp. 216-220.
Chen, et al "Adaptive Postfiltering for Quality Enhancement of Codec Speech" IEEE Transactions on Speech and Audio processing, vol. 3, No. 1, Jan. 1995 pp. 59-71.
Kleijn and Paliwal (Editors) "Speech Coding and Synthesis" 1995.
Digital Cellular Telecommunications System: Enhanced Full Rate (EFR) Speech Transcoding (GSM 06.60) Global System for Mobile Telecommunications. ETS 300 726 Mar. 1997.
Paksoy, et al "Variable Rate Speech Coding For Multiple Access Wireless Networks" Center for Information Processing Research,

(56) References Cited

OTHER PUBLICATIONS

Dept. of Electrical and Computer Engineering. University of California, Santa Barbara, CA 93106 (1994) pp. 47-50.
ITU-T G.723.1 Annex A "Series G: Transmission Systems and Media: Digital Transmission systems—Terminal equipments—Coding of analogue signals by methods other than PCM" Dual rate speech coder for multimedia communications transmitting at 5.3 and 6.3 kbit/s Annex A: Silence compression scheme Nov. 1996.
"On AMR Codec Performance" Nokia, Apr. 16, 1997 pp. 1-6 (Antipolis, Sophia, France 1997).
"On AMR Codec Performance: Background Noise" Nokia, Jun. 25, 1997, Oxford, UK pp. 1-6 (ETSI SMG11 AMR #5).
"TDMA Cellular/PCS—Radio Interface—Enhanced Full-Rate Speech Codec" TIA/EIA Interim Standard May 1996 pp. 1-48.
Vary, et al "Digitale Sprachsignal-verarbeitung".
Benesty, et al "Speech Processing".
Chu, Wai C. "Speech Coding Algorithms: Foundation and Evolution of Standardized Coders".
Kondoz, A.M, "Digital Speech: Coding for low bit rate communication systems" John Wiley & Sons, Ltd, The Atrium, Southern Gate, Chichester, West Sussex PO19 8SQ, England Copyright 2004.
Figueiras-Vidal, Anibal R. "Digital Signal Processing In Telecommunications" ETSI Telecom-UPM, Ciudad Universitaria, 28040 Madrid, Spain ISBN No. 3-540-76037-7.
Vainio, et al, "GSM EFR Based Multi-Rate Codec Family" Nokia Research Center, Tampere, Finland 4 Pgs.
Appendix 6, Invalidity Contentions.
Appendix 1-H, Invalidity Contentions.
Defendant's Invalidity Contentions.
Appendix 1-A, Invalidity Contentions.
Appendix 1-B, Invalidity Contentions.
Appendix 1-C, Invalidity Contentions.
Appendix 1-D, Invalidity Contentions.
Appendix 1-E, Invalidity Contentions.
Appendix 1-F, Invalidity Contentions.
Appendix 1-G, Invalidity Contentions.
Appendix 1-I, Invalidity Contentions.
Appendix 1-J, Invalidity Contentions.
Appendix 2-A, Invalidity Contentions.
Appendix 2-B, Invalidity Contentions.
Appendix 2-C, Invalidity Contentions.
Appendix 2-D, Invalidity Contentions.
Appendix 2-E, Invalidity Contentions.
Appendix 2-F, Invalidity Contentions.
Appendix 2-G, Invalidity Contentions.
Appendix 2-H, Invalidity Contentions.
Appendix 2-I, Invalidity Contentions.
Appendix 2-J, Invalidity Contentions.
Appendix 3-A, Invalidity Contentions.
Appendix 3-B, Invalidity Contentions.
Appendix 3-C, Invalidity Contentions.
Appendix 3-D, Invalidity Contentions.
Appendix 3-E, Invalidity Contentions.
Appendix 3-F, Invalidity Contentions.
Appendix 3-G, Invalidity Contentions.
Appendix 3-H, Invalidity Contentions.
Appendix 3-I, Invalidity Contentions.
Appendix 3-J, Invalidity Contentions.
Appendix 3-K, Invalidity Contentions.
Appendix 4-A, Invalidity Contentions.
Appendix 4-B, Invalidity Contentions.
Appendix 4-C, Invalidity Contentions.
Appendix 4-D, Invalidity Contentions.
Appendix 4-E, Invalidity Contentions.
Appendix 4-F, Invalidity Contentions.
Appendix 5-A, Invalidity Contentions.
Appendix 5-B, Invalidity Contentions.
Appendix 5-C, Invalidity Contentions.
Appendix 5-D, Invalidity Contentions.
"Sony Ericsson Mobile Communications (USA) Inc. and Sony Ericsson Mobile Communications AB's Response to WIA V Solutions LLC's Disclosure of Asserted Claims and Infringement Contentions".
Appendix 1: MMI's Noninfringement Contentions for U.S. Patent No. 6,256,606.
Appendix 1—Nokia's Noninfringement Contentions for U.S. Patent No. 6,625,606.
Appendix 2: MMI's Noninfringement Contentions for U.S. Patent No. 7,120,578.
Appendix 2—Nokia's Noninfringement Contentions for U.S. Patent No. 7,120,578.
Appendix 3: MMI's Noninfringement Contentions for U.S. Patent No. 6,385,573.
Appendix 3—Nokia's Noninfringement Contentions for U.S. Patent No. 6,385,573.
Appendix 4: MMI's Noninfringement Contentions for U.S. Patent No. 7,266,493.
Appendix 4: Nokia's Noninfringement Contentions for U.S. Patent No. 7,266,493.
Appendix 5: MMI's Noninfringement Contentions for U.S. Patent No. 6,507,814.
Appendix 5: Nokia's Noninfringement Contentions for U.S. Patent No. 6,507,814.
Motorola Mobility, Inc.'s Response To Wiav Solutions LLC's Disclosure Of Asserted Claims And Infringement Contentions.
Nokia Inc. And Nokia Corporation's Response To Wiav Solutions Llc's Disclosure Of Asserted Claims And Infringement Contentions.
Appendix 1—Sony Ericsson's Noninfringement Contentions for U.S. Patent No. 6,625,606.
Appendix 2—Sony Ericsson's Noninfringement Contentions for U.S. Patent No. 7,120,578.
Appendix 3—Sony Ericsson's Noninfringement Contentions for U.S. Patent No. 6,385,573.
Appendix 4—Sony Ericsson's Noninfringement Contentions for U.S. Patent No. 7,266,493.
Appendix 5—Sony Ericsson's Noninfringement Contentions for U.S. Patent No. 6,507,814.
TIA/EIA Interim Standard, TDMA Cellular/PCS—Radio Interface—Enhanced Full-Rate Speech Codec, TIA/EIA/IS-641 (May 1996) ("TDMA IS-641").
Chen, "Low-Delay Coding of Speech" Speech Coding Research Department, AT&T Bell Laboratories (1995).
W.B. Kleijn and K.K. Paliwal (Editors), Speech Coding and Synthesis, Elsevier Science B.V.; Kroon and W.B. Kleijn (Authors), Chapter 3: Linear-Prediction Based on Analysis-by-Synthesis Coding, 1995, pp. 81-113.

* cited by examiner

| ENCODING SCHEME | FIRST ENCODING SCHEME 99 | | SECOND ENCODING SCHEME 97 | |
|---|---|---|---|---|
| FRAME DURATION | 20 ms | | 20 ms | |
| FRAME TYPE | 1ST FRAME TYPE (4 SUBFRAMES) | | 2ND FRAME TYPE (4 SUBFRAMES) | |
| FILTER COEFFICIENT INDICATORS (E.G., LSF'S) 76 | 1ST STAGE<br>2ND STAGE<br>3RD STAGE<br>4TH STAGE | 7 BITS<br>6 BITS<br>6 BITS<br>6BITS<br>25 BITS | INTERPOLATION<br>1ST STAGE<br>2ND STAGE<br>3RD STAGE<br>4TH STAGE | 2 BIT<br>7 BITS<br>6 BITS<br>6 BITS<br>6BITS<br>27 BITS |
| TYPE INDICATOR 71 | | 1 BIT | 1 BIT | |
| ADAPTIVE CODEBOOK 72 | 8 BITS/FRAME | 8 BITS | 8,5,8,5 BITS/SUBFRAME | 26 BITS |
| FILTER CODEBOOK INDEX 74 | 8 - PULSE CODEBOOK | $2^{30}$ ENT./SUBFRAME | 5 - PULSE CODEBOOK<br>5 - PULSE CODEBOOK<br>5 - PULSE CODEBOOK | $2^{21}$ ENT./SUBFRAME<br>$2^{20}$ ENT./SUBFRAME<br>$2^{20}$ ENT./SUBFRAME<br>$2^{22}$ ENT./SUBFRAME |
| 80 | 30 BITS/SUBFRAME | 120 BITS | 22 BITS/SUBFRAME | 88 BITS |
| ADAPTIVE CODEBOOK GAIN | 4D PRE VQ/FRAME | 6 BITS | 2D VQ/SUBFRAME | 7 BITS/SUBFRAME<br>28 BITS |
| FIXED CODEBOOK GAIN 78 | 4D DELAYED VQ/FRAME | 10 BITS | | |
| TOTAL BITS | 170 BITS | | 170 BITS | |

FIG. 6

| ENCODING SCHEME | THIRD ENCODING SCHEME 103 | | FOURTH ENCODING SCHEME 101 | |
|---|---|---|---|---|
| FRAME DURATION | 20 ms | | 20 ms | |
| FRAME TYPE | 3RD FRAME TYPE (3 SUBFRAMES) | | 4TH FRAME TYPE (2 SUBFRAMES) | |
| LSF'S 76<br>FILTER COEFFICIENT INDICATORS (E.G., LSF'S) | 1 BIT<br>7 BITS<br>7 BITS<br>6 BITS<br>21 BITS | | PREDICTOR SWITCH<br>1ST STAGE<br>2 STAGE<br>3RD STAGE | |
| TYPE INDICATOR 71 | 1 BIT | | 1 BIT | |
| ADAPTIVE CODEBOOK 72 | 7 BITS/FRAME | 7 BITS | 7 BITS/SUBFRAME | 14 BITS |
| FIXED CODEBOOK INDEX 74 | 2 - PULSE CODEBOOK<br>3 - PULSE CODEBOOK | $2^{12}$ ENT./SUBFRAME<br>$2^{12}$ ENT./SUBFRAME<br>$2^{13}$ ENT./SUBFRAME | 2 - PULSE CODEBOOK<br>3 - PULSE CODEBOOK<br>GAUSSIAN CODEBOOK | $2^{14}$ ENT./SUBFRAME<br>$2^{13}$ ENT./SUBFRAME<br>$2^{13}$ ENT./SUBFRAME<br>$2^{15}$ ENT./SUBFRAME |
| 80 | 13 BITS/SUBFRAME | 39 BITS | 15 BITS/SUBFRAME | 30 BITS |
| ADAPTIVE CODEBOOK GAIN | 3D PRE VQ/FRAME | 4 BITS | 2D VQ/SUBFRAME | 7 BITS/SUBFRAME |
| FIXED CODEBOOK GAIN 78 | 3D DELAYED VQ/FRAME | 8 BITS | | 14 BITS |
| TOTAL BITS | 80 BITS | | 80 BITS | |

FIG. 7

MULTI-MODE SPEECH ENCODING SYSTEM FOR ENCODING A SPEECH SIGNAL USED FOR SELECTION OF ONE OF THE SPEECH ENCODING MODES INCLUDING MULTIPLE SPEECH ENCODING RATES

CROSS REFERENCE TO RELATED APPLICATIONS

This application is a continuation of U.S. application Ser. No. 12/218,242, filed Jul. 11, 2008, which is continuation of U.S. application Ser. No. 11/827,915, filed Jul. 12, 2007, which is a continuation of U.S. application Ser. No. 11/251,179, filed Oct. 13, 2005 now U.S. Pat. No. 7,266,493, which is a continuation of U.S. application Ser. No. 09/663,002, filed Sep. 15, 2000 now U.S. Pat. No. 7,072,832, which is a continuation-in-part of application Ser. No. 09/154,660, filed on Sep. 18, 1998 now U.S. Pat. No. 6,330,533. The following co-pending and commonly assigned U.S. patent applications have been filed on the same day as this application. All of these applications relate to and further describe other aspects of the embodiments disclosed in this application and are incorporated by reference in their entirety.

U.S. patent application Ser. No. 09/663,242, "SELECTABLE MODE VOCODER SYSTEM," filed on Sep. 15, 2000.

U.S. patent application Ser. No. 09/755,441, "INJECTING HIGH FREQUENCY NOISE INTO PULSE EXCITATION FOR LOW BIT RATE CELP," filed on Sep. 15, 2000.

U.S. patent application Ser. No. 09/771,293, "SHORT TERM ENHANCEMENT IN CELP SPEECH CODING," filed on Sep. 15, 2000.

U.S. patent application Ser. No. 09/761,029, "SYSTEM OF DYNAMIC PULSE POSITION TRACKS FOR PULSE-LIKE EXCITATION IN SPEECH CODING," filed on Sep. 15, 2000.

U.S. patent application Ser. No. 09/782,791, "SPEECH CODING SYSTEM WITH TIME-DOMAIN NOISE ATTENUATION," filed on Sep. 15, 2000.

U.S. patent application Ser. No. 09/761,033, "SYSTEM FOR AN ADAPTIVE EXCITATION PATTERN FOR SPEECH CODING," filed on Sep. 15, 2000.

U.S. patent application Ser. No. 09/782,383, "SYSTEM FOR ENCODING SPEECH INFORMATION USING AN ADAPTIVE CODEBOOK WITH DIFFERENT RESOLUTION LEVELS," filed on Sep. 15, 2000.

U.S. patent application Ser. No. 09/663,837, "CODEBOOK TABLES FOR ENCODING AND DECODING," filed on Sep. 15, 2000.

U.S. patent application Ser. No. 09/662,828, "BIT STREAM PROTOCOL FOR TRANSMISSION OF ENCODED VOICE SIGNALS," filed on Sep. 15, 2000.

U.S. patent application Ser. No. 09/781,735, "SYSTEM FOR FILTERING SPECTRAL CONTENT OF A SIGNAL FOR SPEECH ENCODING," filed on Sep. 15, 2000.

U.S. patent application Ser. No. 09/663,734, "SYSTEM FOR ENCODING AND DECODING SPEECH SIGNALS," filed on Sep. 15, 2000.

U.S. patent application Ser. No. 09/940,904, "SYSTEM FOR IMPROVED USE OF PITCH ENHANCEMENT WITH SUBCODEBOOKS," filed on Sep. 15, 2000.

BACKGROUND OF THE INVENTION

1. Technical Field

This invention relates to a method and system having an adaptive encoding arrangement for coding a speech signal.

2. Related Art

Speech encoding may be used to increase the traffic handling capacity of an air interface of a wireless system. A wireless service provider generally seeks to maximize the number of active subscribers served by the wireless communications service for an allocated bandwidth of electromagnetic spectrum to maximize subscriber revenue. A wireless service provider may pay tariffs, licensing fees, and auction fees to governmental regulators to acquire or maintain the right to use an allocated bandwidth of frequencies for the provision of wireless communications services. Thus, the wireless service provider may select speech encoding technology to get the most return on its investment in wireless infrastructure.

Certain speech encoding schemes store a detailed database at an encoding site and a duplicate detailed database at a decoding site. Encoding infrastructure transmits reference data for indexing the duplicate detailed database to conserve the available bandwidth of the air interface. Instead of modulating a carrier signal with the entire speech signal at the encoding site, the encoding infrastructure merely transmits the shorter reference data that represents the original speech signal. The decoding infrastructure reconstructs a replica or representation of the original speech signal by using the shorter reference data to access the duplicate detailed database at the decoding site.

The quality of the speech signal may be impacted if an insufficient variety of excitation vectors are present in the detailed database to accurately represent the speech underlying the original speech signal. The maximum number of code identifiers (e.g., binary combinations) supported is one limitation on the variety of excitation vectors that may be represented in the detailed database (e.g., codebook). A limited number of possible excitation vectors for certain components of the speech signal, such as short-term predictive components, may not afford the accurate or intelligible representation of the speech signal by the excitation vectors. Accordingly, at times the reproduced speech may be artificial-sounding, distorted, unintelligible, or not perceptually palatable to subscribers. Thus, a need exists for enhancing the quality of reproduced speech, while adhering to the bandwidth constraints imposed by the transmission of reference or indexing information within a limited number of bits.

SUMMARY

There are provided methods and systems for adaptive gain reduction for encoding a speech signal, substantially as shown in and/or described in connection with at least one of the figures, as set forth more completely in the claims.

BRIEF DESCRIPTION OF THE FIGURES

The invention can be better understood with reference to the following figures. Like reference numerals designate corresponding parts or procedures throughout the different figures.

FIG. 6 and FIG. 7 are charts of bit assignments for an illustrative higher rate encoding scheme and a lower rate encoding scheme, respectively.

FIG. 9 is a functional block diagram illustrating of a first stage of operations performed by one embodiment of the speech encoder of FIGS. 8*a* and 8*b*. FIG. 10 is a functional block diagram of a second stage of operations, while FIG. 11 illustrates a third stage.

DETAILED DESCRIPTION OF PREFERRED EMBODIMENTS

A multi-rate encoder may include different encoding schemes to attain different transmission rates over an air interface. Each different transmission rate may be achieved by using one or more encoding schemes. The highest coding rate may be referred to as full-rate coding. A lower coding rate may be referred to as one-half-rate coding where the one-half-rate coding has a maximum transmission rate that is approximately one-half the maximum rate of the full-rate coding. An encoding scheme may include an analysis-by-synthesis encoding scheme in which an original speech signal is compared to a synthesized speech signal to optimize the perceptual similarities or objective similarities between the original speech signal and the synthesized speech signal. A code-excited linear predictive coding scheme (CELP) is one example of an analysis-by synthesis encoding scheme.

Figure 1:
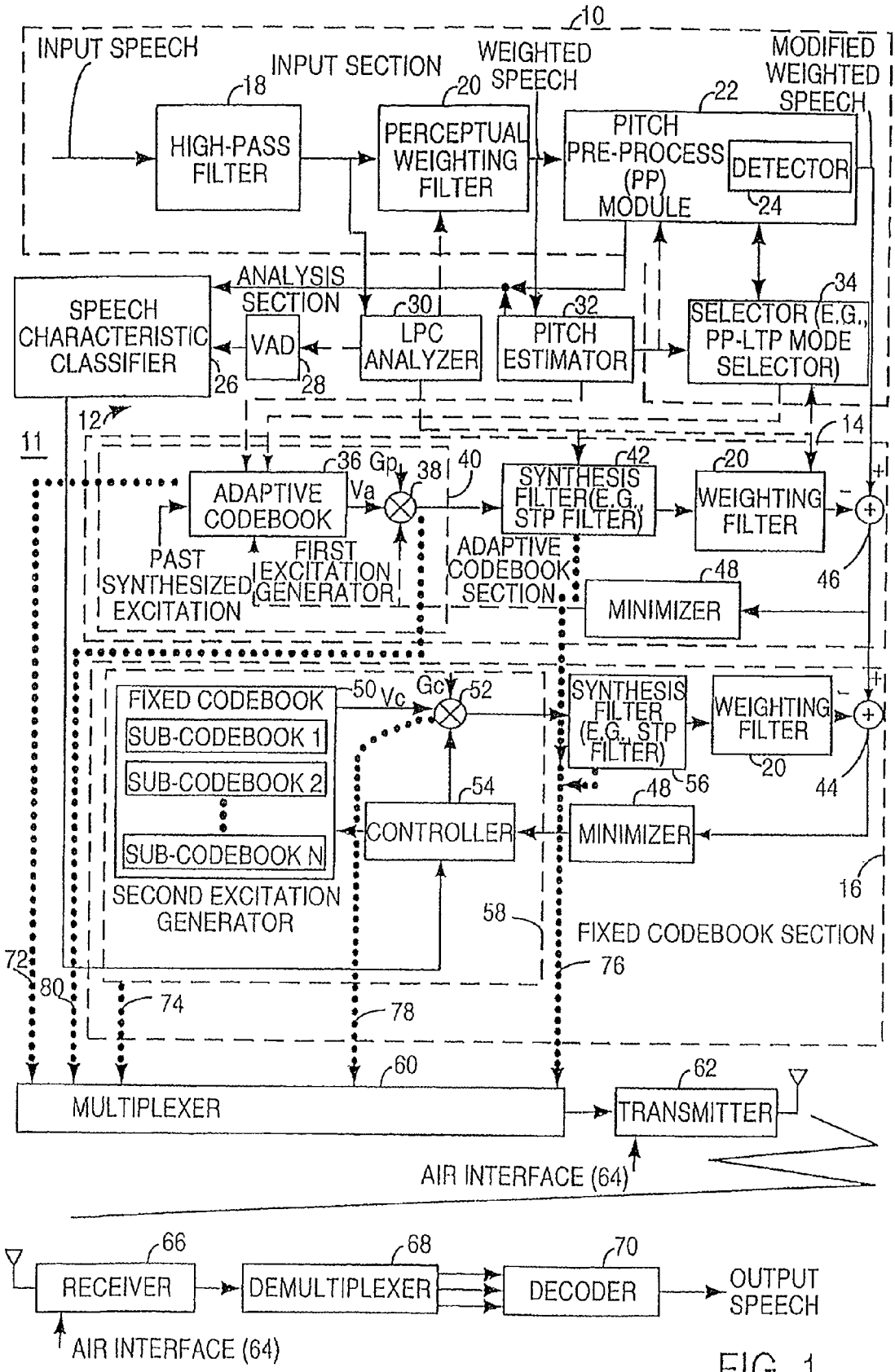
FIG. 1 is a block diagram of an illustrative embodiment of an encoder and a decoder.

In accordance with the invention, FIG. 1 shows an encoder 11 including an input section 10 coupled to an analysis section 12 and an adaptive codebook section 14. In turn, the adaptive codebook section 14 is coupled to a fixed codebook section 16. A multiplexer 60, associated with both the adaptive codebook section 14 and the fixed codebook section 16, is coupled to a transmitter 62.

The transmitter 62 and a receiver 66 along with a communications protocol represent an air interface 64 of a wireless system. The input speech from a source or speaker is applied to the encoder 11 at the encoding site. The transmitter 62 transmits an electromagnetic signal (e.g., radio frequency or microwave signal) from an encoding site to a receiver 66 at a decoding site, which is remotely situated from the encoding site. The electromagnetic signal is modulated with reference information representative of the input speech signal. A demultiplexer 68 demultiplexes the reference information for input to the decoder 70. The decoder 70 produces a replica or representation of the input speech, referred to as output speech, at the decoder 70.

The input section 10 has an input terminal for receiving an input speech signal. The input terminal feeds a high-pass filter 18 that attenuates the input speech signal below a cut-off frequency (e.g., 80 Hz) to reduce noise in the input speech signal. The high-pass filter 18 feeds a perceptual weighting filter 20 and a linear predictive coding (LPC) analyzer 30. The perceptual weighting filter 20 may feed both a pitch pre-processing module 22 and a pitch estimator 32. Further, the perceptual weighting filter 20 may be coupled to an input of a first summer 46 via the pitch pre-processing module 22. The pitch pre-processing module 22 includes a detector 24 for detecting a triggering speech characteristic.

In one embodiment, the detector 24 may refer to a classification unit that (1) identifies noise-like unvoiced speech and (2) distinguishes between non-stationary voiced and stationary voiced speech in an interval of an input speech signal. The detector 24 may detect or facilitate detection of the presence or absence of a triggering characteristic (e.g., a generally voiced and generally stationary speech component) in an interval of input speech signal. In another embodiment, the detector 24 may be integrated into both the pitch pre-processing module 22 and the speech characteristic classifier 26 to detect a triggering characteristic in an interval of the input speech signal. In yet another embodiment, the detector 24 is integrated into the speech characteristic classifier 26, rather than the pitch pre-processing module 22. Where the detector 24 is so integrated, the speech characteristic classifier 26 is coupled to a selector 34.

The analysis section 12 includes the LPC analyzer 30, the pitch estimator 32, a voice activity detector 28, and a speech characteristic classifier 26. The LPC analyzer 30 is coupled to the voice activity detector 28 for detecting the presence of speech or silence in the input speech signal. The pitch estimator 32 is coupled to a mode selector 34 for selecting a pitch pre-processing procedure or a responsive long-term prediction procedure based on input received from the detector 24.

The adaptive codebook section 14 includes a first excitation generator 40 coupled to a synthesis filter 42 (e.g., short-term predictive filter). In turn, the synthesis filter 42 feeds a perceptual weighting filter 20. The weighting filter 20 is coupled to an input of the first summer 46, whereas a minimizer 48 is coupled to an output of the first summer 46. The minimizer 48 provides a feedback command to the first excitation generator 40 to minimize an error signal at the output of the first summer 46. The adaptive codebook section 14 is coupled to the fixed codebook section 16 where the output of the first summer 46 feeds the input of a second summer 44 with the error signal.

The fixed codebook section 16 includes a second excitation generator 58 coupled to a synthesis filter 42 (e.g., short-term predictive filter). In turn, the synthesis filter 42 feeds a perceptual weighting filter 20. The weighting filter 20 is coupled to an input of the second summer 44, whereas a minimizer 48 is coupled to an output of the second summer 44. A residual signal is present on the output of the second summer 44. The minimizer 48 provides a feedback command to the second excitation generator 58 to minimize the residual signal.

In one alternate embodiment, the synthesis filter 42 and the perceptual weighting filter 20 of the adaptive codebook section 14 are combined into a single filter.

In another alternate embodiment, the synthesis filter 42 and the perceptual weighting filter 20 of the fixed codebook section 16 are combined into a single filter.

In yet another alternate embodiment, the three perceptual weighting filters 20 of the encoder may be replaced by two perceptual weighting filters 20, where each perceptual weighting filter 20 is coupled in tandem with the input of one of the minimizers 48. Accordingly, in the foregoing alternate embodiment the perceptual weighting filter 20 from the input section 10 is deleted.

In accordance with FIG. 1, an input speech signal is inputted into the input section 10. The input section 10 decomposes speech into component parts including (1) a short-term component or envelope of the input speech signal, (2) a long-term component or pitch lag of the input speech signal, and (3) a residual component that results from the removal of the short-term component and the long-term component from the input speech signal. The encoder 11 uses the long-term component, the short-term component, and the residual component to facilitate searching for the preferential excitation vectors of the adaptive codebook 36 and the fixed codebook 50 to represent the input speech signal as reference information for transmission over the air interface 64.

The perceptual weighing filter 20 of the input section 10 has a first time versus amplitude response that opposes a second time versus amplitude response of the formants of the input speech signal. The formants represent key amplitude versus frequency responses of the speech signal that characterize the speech signal consistent with an linear predictive coding analysis of the LPC analyzer 30. The perceptual weighting filter 20 is adjusted to compensate for the perceptually induced deficiencies in error minimization, which would otherwise result, between the reference speech signal (e.g., input speech signal) and a synthesized speech signal.

The input speech signal is provided to a linear predictive coding (LPC) analyzer 30 (e.g., LPC analysis filter) to determine LPC coefficients for the synthesis filters 42 (e.g., short-term predictive filters). The input speech signal is inputted into a pitch estimator 32. The pitch estimator 32 determines a pitch lag value and a pitch gain coefficient for voiced segments of the input speech. Voiced segments of the input speech signal refer to generally periodic waveforms.

The pitch estimator 32 may perform an open-loop pitch analysis at least once a frame to estimate the pitch lag. Pitch lag refers a temporal measure of the repetition component (e.g., a generally periodic waveform) that is apparent in voiced speech or voice component of a speech signal. For example, pitch lag may represent the time duration between adjacent amplitude peaks of a generally periodic speech signal. As shown in FIG. 1, the pitch lag may be estimated based on the weighted speech signal. Alternatively, pitch lag may be expressed as a pitch frequency in the frequency domain, where the pitch frequency represents a first harmonic of the speech signal.

The pitch estimator 32 maximizes the correlations between signals occurring in different sub-frames to determine candidates for the estimated pitch lag. The pitch estimator 32 preferably divides the candidates within a group of distinct ranges of the pitch lag. After normalizing the delays among the candidates, the pitch estimator 32 may select a representative pitch lag from the candidates based on one or more of the following factors: (1) whether a previous frame was voiced or unvoiced with respect to a subsequent frame affiliated with the candidate pitch delay; (2) whether a previous pitch lag in a previous frame is within a defined range of a candidate pitch lag of a subsequent frame, and (3) whether the previous two frames are voiced and the two previous pitch lags are within a defined range of the subsequent candidate pitch lag of the subsequent frame. The pitch estimator 32 provides the estimated representative pitch lag to the adaptive codebook 36 to facilitate a starting point for searching for the preferential excitation vector in the adaptive codebook 36. The adaptive codebook section 11 later refines the estimated representative pitch lag to select an optimum or preferential excitation vector from the adaptive codebook 36.

The speech characteristic classifier 26 preferably executes a speech classification procedure in which speech is classified into various classifications during an interval for application on a frame-by-frame basis or a subframe-by-subframe basis. The speech classifications may include one or more of the following categories: (1) silence/background noise, (2) noise-like unvoiced speech, (3) unvoiced speech, (4) transient onset of speech, (5) plosive speech, (6) non-stationary voiced, and (7) stationary voiced. Stationary voiced speech represents a periodic component of speech in which the pitch (frequency) or pitch lag does not vary by more than a maximum tolerance during the interval of consideration. Nonstationary voiced speech refers to a periodic component of speech where the pitch (frequency) or pitch lag varies more than the maximum tolerance during the interval of consideration. Noise-like unvoiced speech refers to the nonperiodic component of speech that may be modeled as a noise signal, such as Gaussian noise. The transient onset of speech refers to speech that occurs immediately after silence of the speaker or after low amplitude excursions of the speech signal. A speech classifier may accept a raw input speech signal, pitch lag, pitch correlation data, and voice activity detector data to classify the raw speech signal as one of the foregoing classifications for an associated interval, such as a frame or a subframe. The foregoing speech classifications may define one or more triggering characteristics that may be present in an interval of an input speech signal. The presence or absence of a certain triggering characteristic in the interval may facilitate the selection of an appropriate encoding scheme for a frame or subframe associated with the interval.

A first excitation generator 40 includes an adaptive codebook 36 and a first gain adjuster 38 (e.g., a first gain codebook). A second excitation generator 58 includes a fixed codebook 50, a second gain adjuster 52 (e.g., second gain codebook), and a controller 54 coupled to both the fixed codebook 50 and the second gain adjuster 52.

The fixed codebook 50 and the adaptive codebook 36 define excitation vectors. Once the LPC analyzer 30 determines the filter parameters of the synthesis filters 42, the encoder 11 searches the adaptive codebook 36 and the fixed codebook 50 to select proper excitation vectors. The first gain adjuster 38 may be used to scale the amplitude of the excitation vectors of the adaptive codebook 36. The second gain adjuster 52 may be used to scale the amplitude of the excitation vectors in the fixed codebook 50. The controller 54 uses speech characteristics from the speech characteristic classifier 26 to assist in the proper selection of preferential excitation vectors from the fixed codebook 50, or a sub-codebook therein.

The adaptive codebook 36 may include excitation vectors that represent segments of waveforms or other energy representations. The excitation vectors of the adaptive codebook 36 may be geared toward reproducing or mimicking the long-term variations of the speech signal. A previously synthesized excitation vector of the adaptive codebook 36 may be inputted into the adaptive codebook 36 to determine the parameters of the present excitation vectors in the adaptive codebook 36. For example, the encoder may alter the present excitation vectors in its codebook in response to the input of past excitation vectors outputted by the adaptive codebook 36, the fixed codebook 50, or both. The adaptive codebook 36 is preferably updated on a frame-by-frame or a subframe-by-subframe basis based on a past synthesized excitation, although other update intervals may produce acceptable results and fall within the scope of the invention.

The excitation vectors in the adaptive codebook 36 are associated with corresponding adaptive codebook indices. In one embodiment, the adaptive codebook indices may be equivalent to pitch lag values. The pitch estimator 32 initially determines a representative pitch lag in the neighborhood of the preferential pitch lag value or preferential adaptive index. A preferential pitch lag value minimizes an error signal at the output of the first summer 46, consistent with a codebook search procedure. The granularity of the adaptive codebook index or pitch lag is generally limited to a fixed number of bits for transmission over the air interface 64 to conserve spectral bandwidth. Spectral bandwidth may represent the maximum bandwidth of electromagnetic spectrum permitted to be used for one or more channels (e.g., downlink channel, an uplink channel, or both) of a communications system. For example, the pitch lag information may need to be transmitted in 7 bits for half-rate coding or 8-bits for full-rate coding of voice information on a single channel to comply with bandwidth restrictions. Thus, 128 states are possible with 7 bits and 256 states are possible with 8 bits to convey the pitch lag value used to select a corresponding excitation vector from the adaptive codebook 36.

The encoder 11 may apply different excitation vectors from the adaptive codebook 36 on a frame-by-frame basis or a subframe-by-subframe basis. Similarly, the filter coefficients of one or more synthesis filters 42 may be altered or updated on a frame-by-frame basis. However, the filter coefficients preferably remain static during the search for or selection of each preferential excitation vector of the adaptive codebook 36 and the fixed codebook 50. In practice, a frame may represent a time interval of approximately 20 milliseconds and a sub-frame may represent a time interval within a range from approximately 5 to 10 milliseconds, although other durations for the frame and sub-frame fall within the scope of the invention.

The adaptive codebook 36 is associated with a first gain adjuster 38 for scaling the gain of excitation vectors in the adaptive codebook 36. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The first excitation generator 40 is coupled to a synthesis filter 42. The first excitation vector generator 40 may provide a long-term predictive component for a synthesized speech signal by accessing appropriate excitation vectors of the adaptive codebook 36. The synthesis filter 42 outputs a first synthesized speech signal based upon the input of a first excitation signal from the first excitation generator 40. In one embodiment, the first synthesized speech signal has a long-term predictive component contributed by the adaptive codebook 36 and a short-term predictive component contributed by the synthesis filter 42.

The first synthesized signal is compared to a weighted input speech signal. The weighted input speech signal refers to an input speech signal that has at least been filtered or processed by the perceptual weighting filter 20. As shown in FIG. 1, the first synthesized signal and the weighted input speech signal are inputted into a first summer 46 to obtain an error signal. A minimizer 48 accepts the error signal and minimizes the error signal by adjusting (i.e., searching for and applying) the preferential selection of an excitation vector in the adaptive codebook 36, by adjusting a preferential selection of the first gain adjuster 38 (e.g., first gain codebook), or by adjusting both of the foregoing selections. A preferential selection of the excitation vector and the gain scalar (or gain vector) apply to a subframe or an entire frame of transmission to the decoder 70 over the air interface 64. The filter coefficients of the synthesis filter 42 remain fixed during the adjustment or search for each distinct preferential excitation vector and gain vector.

The second excitation generator 58 may generate an excitation signal based on selected excitation vectors from the fixed codebook 50. The fixed codebook 50 may include excitation vectors that are modeled based on energy pulses, pulse position energy pulses, Gaussian noise signals, or any other suitable waveforms. The excitation vectors of the fixed codebook 50 may be geared toward reproducing the short-term variations or spectral envelope variation of the input speech signal. Further, the excitation vectors of the fixed codebook 50 may contribute toward the representation of noise-like signals, transients, residual components, or other signals that are not adequately expressed as long-term signal components.

The excitation vectors in the fixed codebook 50 are associated with corresponding fixed codebook indices 74. The fixed codebook indices 74 refer to addresses in a database, in a table, or references to another data structure where the excitation vectors are stored. For example, the fixed codebook indices 74 may represent memory locations or register locations where the excitation vectors are stored in electronic memory of the encoder 11.

The fixed codebook 50 is associated with a second gain adjuster 52 for scaling the gain of excitation vectors in the fixed codebook 50. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The second excitation generator 58 is coupled to a synthesis filter 42 (e.g., short-term predictive filter), which may be referred to as a linear predictive coding (LPC) filter. The synthesis filter 42 outputs a second synthesized speech signal based upon the input of an excitation signal from the second excitation generator 58. As shown, the second synthesized speech signal is compared to a difference error signal outputted from the first summer 46. The second synthesized signal and the difference error signal are inputted into the second summer 44 to obtain a residual signal at the output of the second summer 44. A minimizer 48 accepts the residual signal and minimizes the residual signal by adjusting (i.e., searching for and applying) the preferential selection of an excitation vector in the fixed codebook 50, by adjusting a preferential selection of the second gain adjuster 52 (e.g., second gain codebook), or by adjusting both of the foregoing selections. A preferential selection of the excitation vector and the gain scalar (or gain vector) apply to a subframe or an entire frame. The filter coefficients of the synthesis filter 42 remain fixed during the adjustment.

The LPC analyzer 30 provides filter coefficients for the synthesis filter 42 (e.g., short-term predictive filter). For example, the LPC analyzer 30 may provide filter coefficients based on the input of a reference excitation signal (e.g., no excitation signal) to the LPC analyzer 30. Although the difference error signal is applied to an input of the second summer 44, in an alternate embodiment, the weighted input speech signal may be applied directly to the input of the second summer 44 to achieve substantially the same result as described above.

The preferential selection of a vector from the fixed codebook 50 preferably minimizes the quantization error among other possible selections in the fixed codebook 50. Similarly, the preferential selection of an excitation vector from the adaptive codebook 36 preferably minimizes the quantization error among the other possible selections in the adaptive codebook 36. Once the preferential selections are made in accordance with FIG. 1, a multiplexer 60 multiplexes the fixed codebook index 74, the adaptive codebook index 72, the first gain indicator (e.g., first codebook index), the second gain indicator (e.g., second codebook gain), and the filter coefficients associated with the selections to form reference information. The filter coefficients may include filter coefficients for one or more of the following filters: at least one of the synthesis filters 42, the perceptual weighing filter 20 and other applicable filter.

A transmitter 62 or a transceiver is coupled to the multiplexer 60. The transmitter 62 transmits the reference information from the encoder 11 to a receiver 66 via an electromagnetic signal (e.g., radio frequency or microwave signal) of a wireless system as illustrated in FIG. 1. The multiplexed reference information may be transmitted to provide updates on the input speech signal on a subframe-by-subframe basis, a frame-by-frame basis, or at other appropriate time intervals consistent with bandwidth constraints and perceptual speech quality goals.

The receiver 66 is coupled to a demultiplexer 68 for demultiplexing the reference information. In turn, the demultiplexer 68 is coupled to a decoder 70 for decoding the reference information into an output speech signal. As shown in FIG. 1, the decoder 70 receives reference information transmitted over the air interface 64 from the encoder 11. The decoder 70 uses the received reference information to create a preferential excitation signal. The reference information facilitates accessing of a duplicate adaptive codebook and a duplicate fixed codebook to those at the encoder 70. One or more excitation generators of the decoder 70 apply the preferential excitation signal to a duplicate synthesis filter. The same values or approximately the same values are used for the filter coefficients at both the encoder 11 and the decoder 70. The output speech signal obtained from the contributions of the duplicate synthesis filter and the duplicate adaptive codebook is a replica or representation of the input speech inputted into the encoder 11. Thus, the reference data is transmitted over an air interface 64 in a bandwidth efficient manner because the reference data is composed of less bits, words, or bytes than the original speech signal inputted into the input section 10.

In an alternate embodiment, certain filter coefficients are not transmitted from the encoder to the decoder, where the filter coefficients are established in advance of the transmission of the speech information over the air interface 64 or are updated in accordance with internal symmetrical states and algorithms of the encoder and the decoder.

Figure 2:
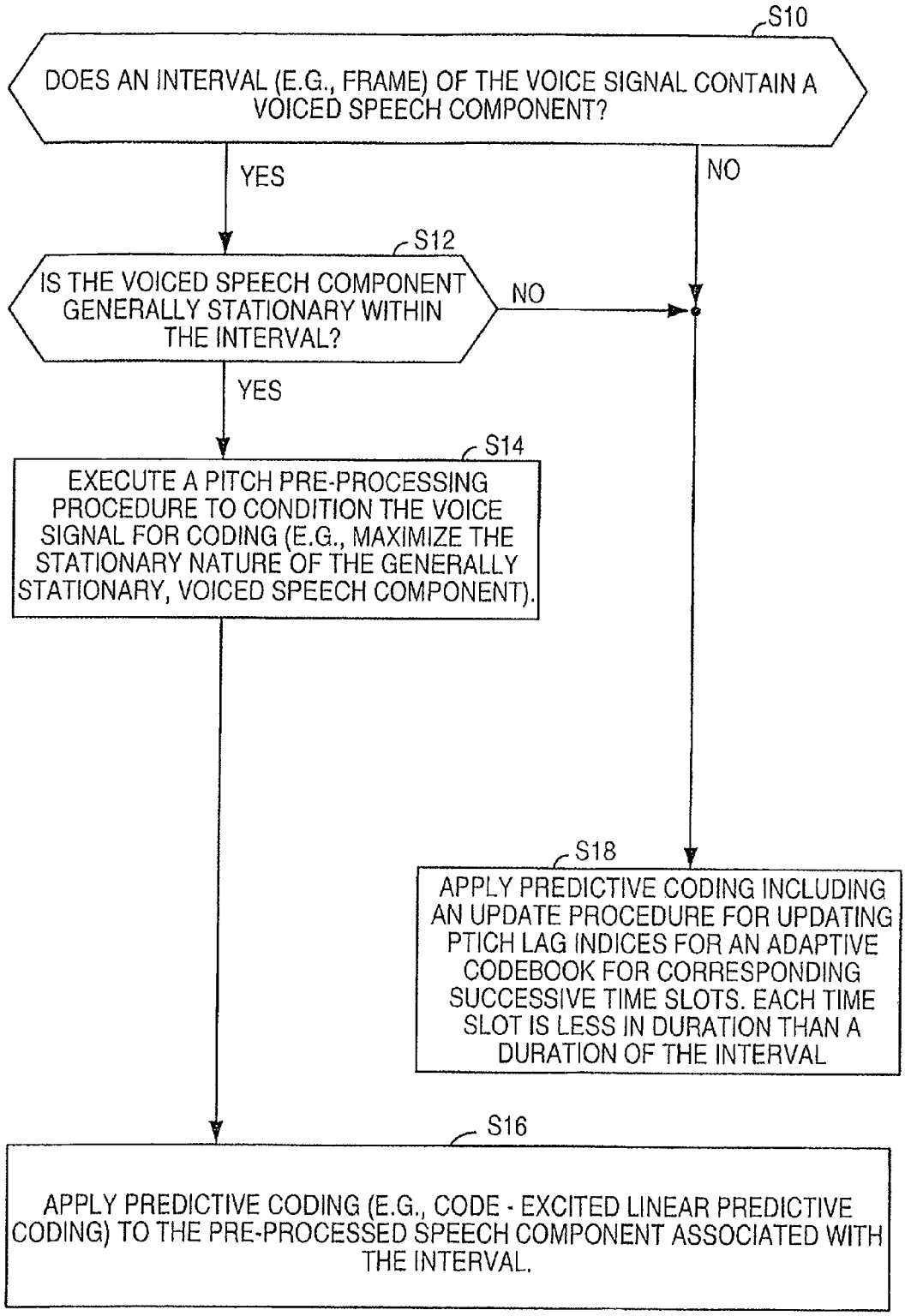
FIG. 2 is a flow chart of one embodiment of a method for encoding a speech signal.

FIG. 2 illustrates a flow chart of a method for encoding an input speech signal in accordance with the invention. The method of FIG. 2 begins in step S10. In general, step S10 and step S12 deal with the detection of a triggering characteristic in an input speech signal. A triggering characteristic may include any characteristic that is handled or classified by the speech characteristic classifier 26, the detector 24, or both. As shown in FIG. 2, the triggering characteristic comprises a generally voiced and generally stationary speech component of the input speech signal in step S10 and S12.

In step S10, a detector 24 or the encoder 11 determines if an interval of the input speech signal contains a generally voiced speech component. A voiced speech component refers to a generally periodic portion or quasiperiodic portion of a speech signal. A quasiperiodic portion may represent a waveform that deviates somewhat from the ideally periodic voiced speech component. An interval of the input speech signal may represent a frame, a group of frames, a portion of a frame, overlapping portions of adjacent frames, or any other time period that is appropriate for evaluating a triggering characteristic of an input speech signal. If the interval contains a generally voiced speech component, the method continues with step S12. If the interval does not contain a generally voiced speech component, the method continues with step S18.

In step S12, the detector 24 or the encoder 11 determines if the voiced speech component is generally stationary or somewhat stationary within the interval. A generally voiced speech component is generally stationary or somewhat stationary if one or more of the following conditions are satisfied: (1) the predominate frequency or pitch lag of the voiced speech signal does not vary more than a maximum range (e.g., a predefined percentage) within the frame or interval; (2) the spectral content of the speech signal remains generally constant or does not vary more than a maximum range within the frame or interval; and (3) the level of energy of the speech signal remains generally constant or does not vary more than a maximum range within the frame or the interval. However, in another embodiment, at least two of the foregoing conditions are preferably met before voiced speech component is considered generally stationary. In general, the maximum range or ranges may be determined by perceptual speech encoding tests or characteristics of waveform shapes of the input speech signal that support sufficiently accurate reproduction of the input speech signal. In the context of the pitch lag, the maximum range may be expressed as frequency range with respect to the central or predominate frequency of the voiced speech component or as a time range with respect to the central or predominate pitch lag of the voiced speech component. If the voiced speech component is generally stationary within the interval, the method continues with step S14. If the voiced speech component is generally not stationary within the interval, the method continues with step S18.

In step S14, the pitch pre-processing module 22 executes a pitch pre-processing procedure to condition the input voice signal for coding. Conditioning refers to artificially maximizing (e.g., digital signal processing) the stationary nature of the naturally-occurring, generally stationary voiced speech component. If the naturally-occurring, generally stationary voiced component of the input voice signal differs from an ideal stationary voiced component, the pitch pre-processing is geared to bring the naturally-occurring, generally stationary voiced component closer to the ideal stationary, voiced component. The pitch pre-processing may condition the input signal to bias the signal more toward a stationary voiced state than it would otherwise be to reduce the bandwidth necessary to represent and transmit an encoded speech signal over the air interface. Alternatively, the pitch pre-processing procedure may facilitate using different voice coding schemes that feature different allocations of storage units between a fixed codebook index 74 and an adaptive codebook index 72. With the pitch pre-processing, the different frame types and attendant bit allocations may contribute toward enhancing perceptual speech quality.

The pitch pre-processing procedure includes a pitch tracking scheme that may modify a pitch lag of the input signal within one or more discrete time intervals. A discrete time interval may refer to a frame, a portion of a frame, a sub-frame, a group of sub-frames, a sample, or a group of samples. The pitch tracking procedure attempts to model the pitch lag of the input speech signal as a series of continuous segments of pitch lag versus time from one adjacent frame to another during multiple frames or on a global basis. Accordingly, the pitch pre-processing procedure may reduce local fluctuations within a frame in a manner that is consistent with the global pattern of the pitch track.

The pitch pre-processing may be accomplished in accordance with several alternative techniques. In accordance with a first technique, step S14 may involve the following procedure: An estimated pitch track is estimated for the inputted speech signal. The estimated pitch track represents an estimate of a global pattern of the pitch over a time period that exceeds one frame. The pitch track may be estimated consistent with a lowest cumulative path error for the pitch track, where a portion of the pitch track associated with each frame contributes to the cumulative path error. The path error provides a measure of the difference between the actual pitch track (i.e., measured) and the estimated pitch track. The inputted speech signal is modified to follow or match the estimated pitch track more than it otherwise would.

The inputted speech signal is modeled as a series of segments of pitch lag versus time, where each segment occupies a discrete time interval. If a subject segment that is temporally proximate to other segments has a shorter lag than the temporally proximate segments, the subject segment is shifted in time with respect to the other segments to produce a more uniform pitch consistent with the estimated pitch track. Discontinuities between the shifted segments and the subject segment are avoided by using adjacent segments that overlap in time. In one example, interpolation or averaging may be used to join the edges of adjacent segments in a continuous manner based upon the overlapping region of adjacent segments.

In accordance with a second technique, the pitch preprocessing performs continuous time-warping of perceptually weighted speech signal as the input speech signal. For continuous warping, an input pitch track is derived from at least one past frame and a current frame of the input speech signal or the weighted speech signal. The pitch pre-processing module 22 determines an input pitch track based on multiple frames of the speech signal and alters variations in the pitch lag associated with at least one corresponding sample to track the input pitch track.

The weighted speech signal is modified to be consistent with the input pitch track. The samples that compose the weighted speech signal are modified on a pitch cycle-by-pitch cycle basis. A pitch cycle represents the period of the pitch of the input speech signal. If a prior sample of one pitch cycle falls in temporal proximity to a later sample (e.g., of an adjacent pitch cycle), the duration of the prior and later samples may overlap and be arranged to avoid discontinuities between the reconstructed/modified segments of pitch track. The time warping may introduce a variable delay for samples of the weighted speech signal consistent with a maximum aggregate delay. For example, the maximum aggregate delay may be 20 samples (2.5 ms) of the weighted speech signal.

In step S18, the encoder 11 applies a predictive coding procedure to the inputted speech signal or weighted speech signal that is not generally voiced or not generally stationary, as determined by the detector 24 in steps S10 and S12. For example, the encoder 11 applies a predictive coding procedure that includes an update procedure for updating pitch lag indices for an adaptive codebook 36 for a subframe or another duration less than a frame duration. As used herein, a time slot is less in duration than a duration of a frame. The frequency of update of the adaptive codebook indices of step S18 is greater than the frequency of update that is required for adequately representing generally voiced and generally stationary speech.

After step S14 in step S16, the encoder 11 applies predictive coding (e.g., code-excited linear predictive coding or a variant thereof) to the pre-processed speech component associated with the interval. The predictive coding includes the determination of the appropriate excitation vectors from the adaptive codebook 36 and the fixed codebook 50.

Figure 3:
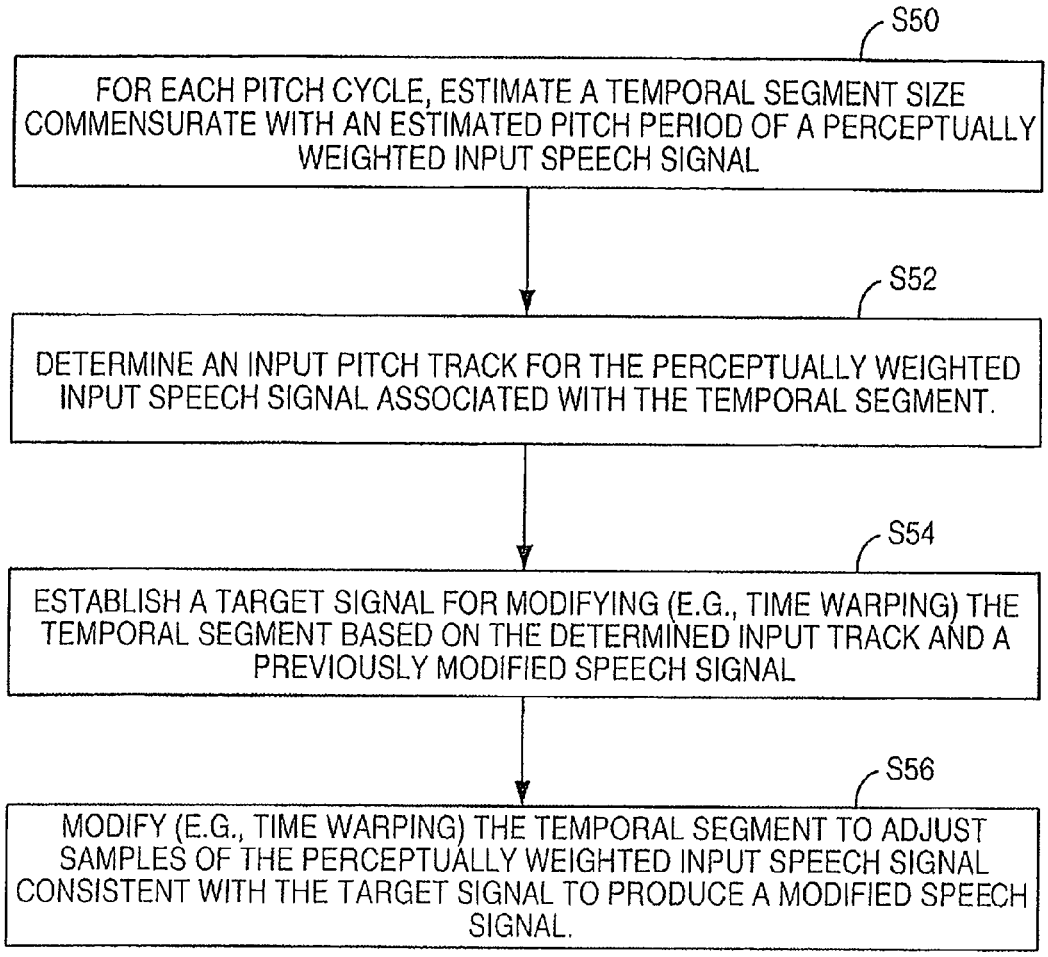
FIG. 3 is a flow chart of one technique for pitch preprocessing in accordance with FIG. 2.

FIG. 3 shows a method for pitch-preprocessing that relates to or further defines step S14 of FIG. 2. The method of FIG. 3 starts with step S50.

In step S50, for each pitch cycle, the pitch pre-processing module 22 estimates a temporal segment size commensurate with an estimated pitch period of a perceptually weighted input speech signal or another input speech signal. The segment sizes of successive segments may track changes in the pitch period.

In step S52, the pitch estimator 32 determines an input pitch track for the perceptually weighted input speech signal associated with the temporal segment. The input pitch track includes an estimate of the pitch lag per frame for a series of successive frames.

In step S54, the pitch pre-processing module 22 establishes a target signal for modifying (e.g., time warping) the weighted input speech signal. In one example, the pitch preprocessing module 22 establishes a target signal for modifying the temporal segment based on the determined input pitch track. In another example, the target signal is based on the input pitch track determined in step S52 and a previously modified speech signal from a previous execution of the method of FIG. 3.

In step S56, the pitch-preprocessing module 22 modifies (e.g., warps) the temporal segment to obtain a modified segment. For a given modified segment, the starting point of the modified segment is fixed in the past and the end point of the modified segment is moved to obtain the best representative fit for the pitch period. The movement of the endpoint stretches or compresses the time of the perceptually weighted signal affiliated with the size of the segment. In one example, the samples at the beginning of the modified segment are hardly shifted and the greatest shift occurs at the end of the modified segment.

The pitch complex (the main pulses) typically represents the most perceptually important part of the pitch cycle. The pitch complex of the pitch cycle is positioned towards the end of the modified segment in order to allow for maximum contribution of the warping on the perceptually most important part.

In one embodiment, a modified segment is obtained from the temporal segment by interpolating samples of the previously modified weighted speech consistent with the pitch track and appropriate time windows (e.g., Hamming-weighted Sinc window). The weighting function emphasizes the pitch complex and de-emphasizes the noise between pitch complexes. The weighting is adapted according to the pitch pre-processing classification, by increasing the emphasis on the pitch complex for segments of higher periodicity. The weighting may vary in accordance with the pitch pre-processing classification, by increasing the emphasis on the pitch complex for segments of higher periodicity.

The modified segment is mapped to the samples of the perceptually weighted input speech signal to adjust the perceptually weighted input speech signal consistent with the target signal to produce a modified speech signal. The mapping definition includes a warping function and a time shift function of samples of the perceptually weighted input speech signal.

In accordance with one embodiment of the method of FIG. 3, the pitch estimator 32, the pre-processing module 22, the selector 34, the speech characteristic classifier 26, and the voice activity detector 28 cooperate to support pitch pre-processing the weighted speech signal. The speech characteristic classifier 26 may obtain a pitch pre-processing controlling parameter that is used to control one or more steps of the pitch pre-processing method of FIG. 3.

A pitch pre-processing controlling parameter may be classified as a member of a corresponding category. Several categories of controlling parameters are possible. A first category is used to reset the pitch pre-processing to prevent the accumulated delay introduced during pitch pre-processing from exceeding a maximum aggregate delay.

The second category, the third category, and the fourth category indicate voice strength or amplitude. The voice strengths of the second category through the fourth category are different from each other.

The first category may permit or suspend the execution of step S56. If the first category or another classification of the frame indicates that the frame is predominantly background noise or unvoiced speech with low pitch correlation, the pitch pre-processing module 22 resets the pitch pre-processing procedure to prevent the accumulated delay from exceeding the maximum delay. Accordingly, the subject frame is not changed in step S56 and the accumulated delay of the pitch preprocessing is reset to zero, so that the next frame can be changed, where appropriate. If the first category or another classification of the frame is predominately pulse-like unvoiced speech, the accumulated delay in step S56 is maintained without any warping of the signal, and the output signal is a simple time shift consistent with the accumulated delay of the input signal.

For the remaining classifications of pitch pre-processing controlling parameters, the pitch preprocessing algorithm is executed to warp the speech signal in step S56.

The remaining pitch pre-processing controlling parameters may control the degree of warping employed in step S56.

After modifying the speech in step S56, the pitch estimator 32 may estimate the pitch gain and the pitch correlation with respect to the modified speech signal. The pitch gain and the pitch correlation are determined on a pitch cycle basis. The pitch gain is estimated to minimize the mean-squared error between the target signal and the final modified signal.

Figure 4:
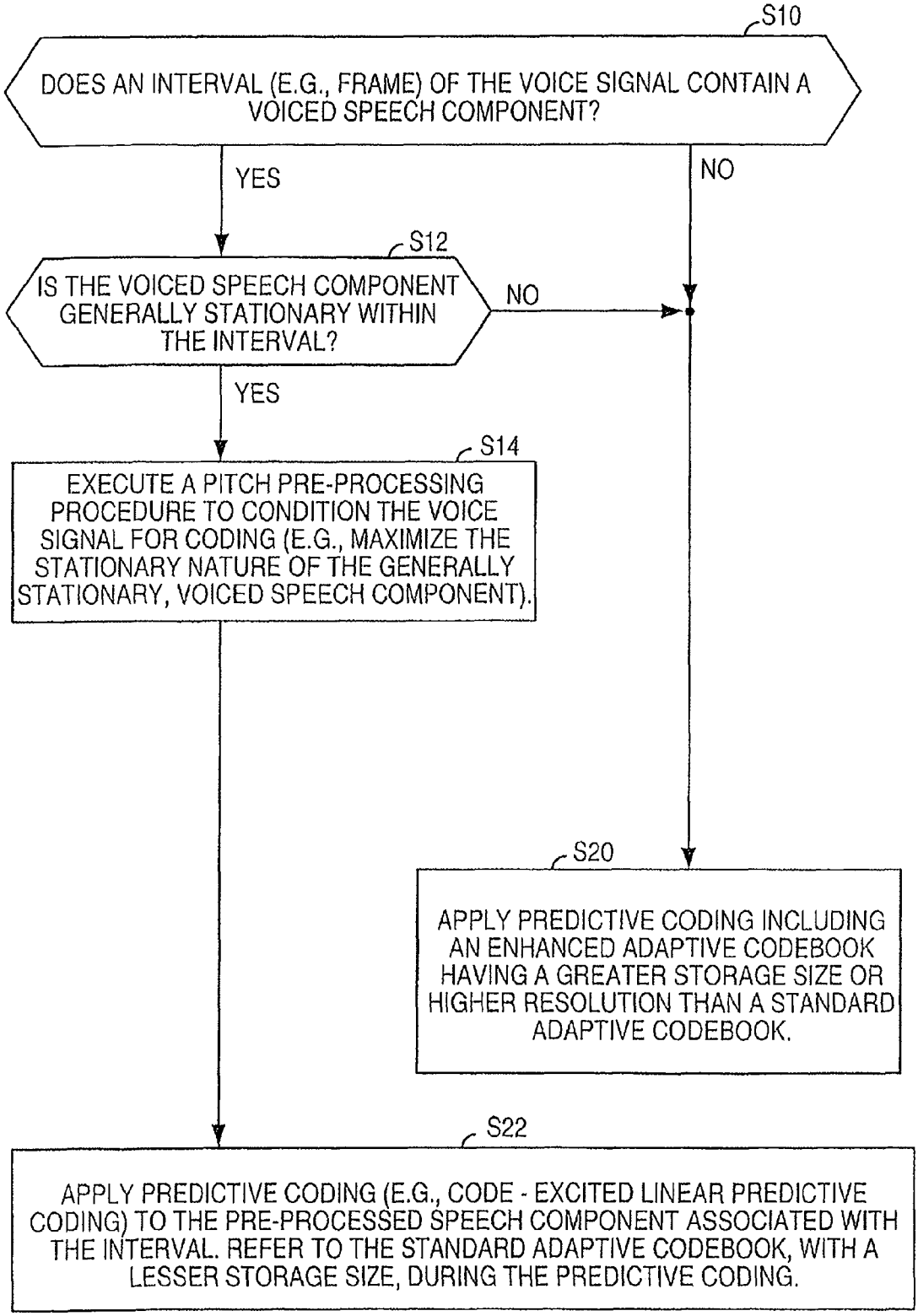
FIG. 4 is a flow chart of another method for encoding.

FIG. 4 includes another method for coding a speech signal in accordance with the invention. The method of FIG. 4 is similar to the method of FIG. 2 except the method of FIG. 4 references an enhanced adaptive codebook in step S20 rather than a standard adaptive codebook. An enhanced adaptive codebook has a greater number of quantization intervals, which correspond to a greater number of possible excitation vectors, than the standard adaptive codebook. The adaptive codebook 36 of FIG. 1 may be considered an enhanced adaptive codebook or a standard adaptive codebook, as the context may require. Like reference numbers in FIG. 2 and FIG. 4 indicate like elements.

Steps S10, S12, and S14 have been described in conjunction with FIG. 2. Starting with step S20, after step S10 or step S12, the encoder applies a predictive coding scheme. The predictive coding scheme of step S20 includes an enhanced adaptive codebook that has a greater storage size or a higher resolution (i.e., a lower quantization error) than a standard adaptive codebook. Accordingly, the method of FIG. 4 promotes the accurate reproduction of the input speech with a greater selection of excitation vectors from the enhanced adaptive codebook.

In step S22 after step S14, the encoder 11 applies a predictive coding scheme to the pre-processed speech component associated with the interval. The coding uses a standard adaptive codebook with a lesser storage size.

Figure 5:
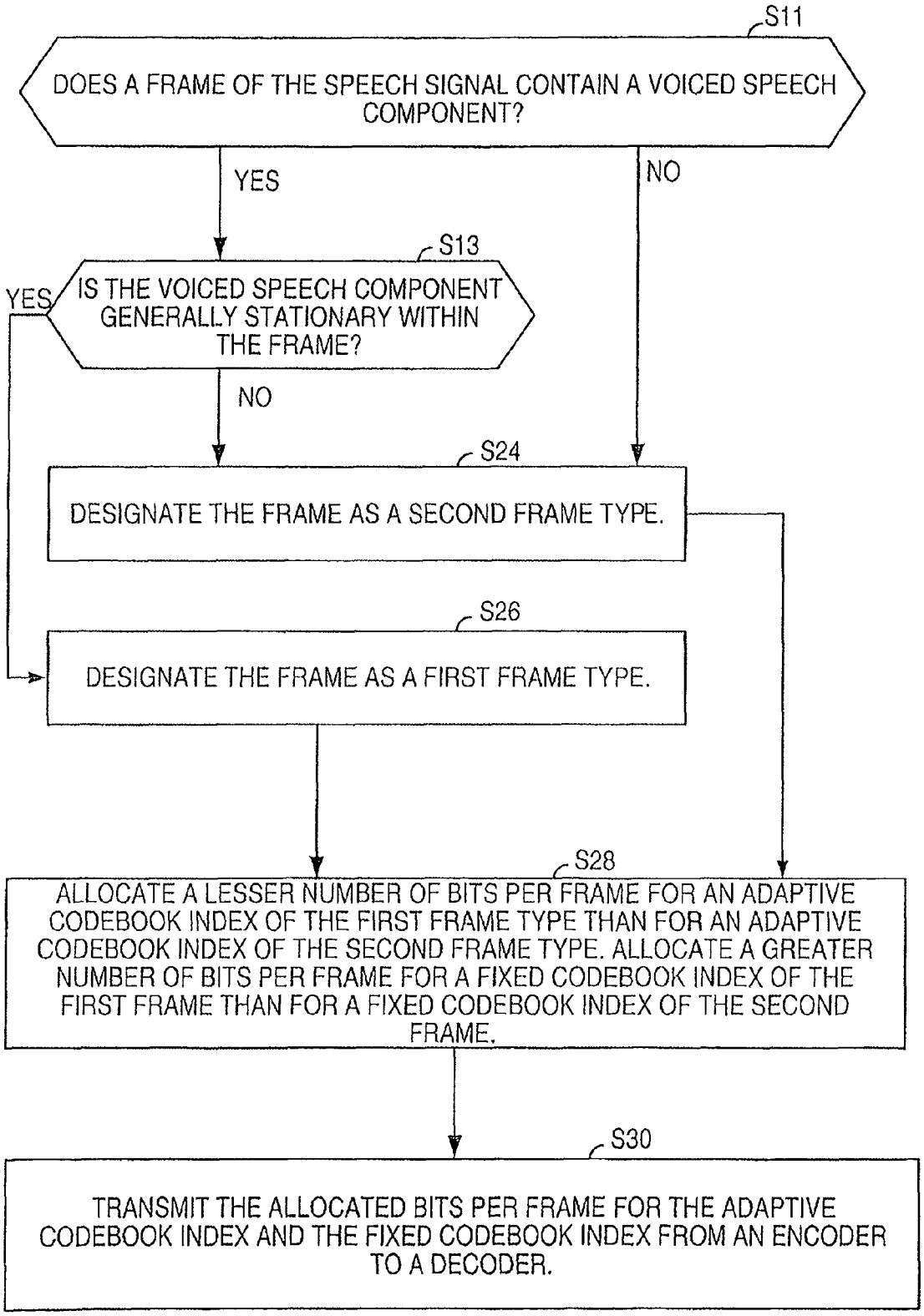
FIG. 5 is a flow chart of a bit allocation procedure.

FIG. 5 shows a method of coding a speech signal in accordance with the invention. The method starts with step S11.

In general, step S11 and step S13 deal with the detection of a triggering characteristic in an input speech signal. A triggering characteristic may include any characteristic that is handled or classified by the speech characteristic classifier 26, the detector 24, or both. As shown in FIG. 5, the triggering characteristic comprises a generally voiced and generally stationary speech component of the speech signal in step S11 and S13.

In step S11, the detector 24 or encoder 11 determines if a frame of the speech signal contains a generally voiced speech component. A generally voiced speech component refers to a periodic portion or quasiperiodic portion of a speech signal. If the frame of an input speech signal contains a generally voiced speech, the method continues with step S13. However, if the frame of the speech signal does not contain the voiced speech component, the method continues with step S24.

In step S13, the detector 24 or encoder 11 determines if the voiced speech component is generally stationary within the frame. A voiced speech component is generally stationary if the predominate frequency or pitch lag of the voiced speech signal does not vary more than a maximum range (e.g., a redefined percentage) within the frame or interval. The maximum range may be expressed as frequency range with respect to the central or predominate frequency of the voiced speech component or as a time range with respect to the central or predominate pitch lag of the voiced speech component. The maximum range may be determined by perceptual speech encoding tests or waveform shapes of the input speech signal. If the voiced speech component is stationary within the frame, the method continues with step S26. Otherwise, if the voiced speech component is not generally stationary within the frame, the method continues with step S24.

In step S24, the encoder 11 designates the frame as a second frame type having a second data structure. An illustrative example of the second data structure of the second frame type is shown in FIG. 6, which will be described in greater detail later.

In an alternate step for step S24, the encoder 11 designates the frame as a second frame type if a higher encoding rate (e.g., full-rate encoding) is applicable and the encoder 11 designates the frame as a fourth frame type if a lesser encoding rate (e.g., half-rate encoding) is applicable. Applicability of the encoding rate may depend upon a target quality mode for the reproduction of a speech signal on a wireless communications system. An illustrative example of the fourth frame type is shown in FIG. 7, which will be described in greater detail later.

In step S26, the encoder designates the frame as a first frame type having a first data structure. An illustrative example of the first frame type is shown in FIG. 6, which will be described in greater detail later.

In an alternate step for step S26, the encoder 11 designates the frame as a first frame type if a higher encoding rate (e.g., full-rate encoding) is applicable and the encoder 11 designates the frame as a third frame type if a lesser encoding rate (e.g., half-rate encoding) is applicable. Applicability of the encoding rate may depend upon a target quality mode for the reproduction of a speech signal on a wireless communications system. An illustrative example of the third frame type is shown in FIG. 7, which will be described in greater detail later.

In step S28, an encoder 11 allocates a lesser number of storage units (e.g., bits) per frame for an adaptive codebook index 72 of the first frame type than for an adaptive codebook index 72 of the second frame type. Further, the encoder allocates a greater number of storage units (e.g., bits) per frame for a fixed codebook index 74 of the first frame type than for a fixed codebook index 74 of the second frame type. The foregoing allocation of storage units may enhance long-term predictive coding for a second frame type and reduce quantization error associated with the fixed codebook for a first frame type. The second allocation of storage units per frame of the second frame type allocates a greater number of storage units to the adaptive codebook index than the first allocation of storage units of the first frame type to facilitate long-term predictive coding on a subframe-by-subframe basis, rather than a frame-by-frame basis. In other words, the second encoding scheme has a pitch track with a greater number of storage units (e.g., bits) per frame than the first encoding scheme to represent the pitch track.

The first allocation of storage units per frame allocates a greater number of storage units for the fixed codebook index than the second allocation does to reduce a quantization error associated with the fixed codebook index.

The differences in the allocation of storage units per frame between the first frame type and the second frame type may be defined in accordance with an allocation ratio. As used herein, the allocation ratio (R) equals the number of storage units per frame for the adaptive codebook index (A) divided by the number of storage units per frame for the adaptive codebook index (A) plus the number of storage units per frame for the fixed codebook index (F). The allocation ratio is mathematically expressed as $R=A/(A+F)$. Accordingly, the allocation ratio of the second frame type is greater than the allocation ratio of the first frame type to foster enhanced perceptual quality of the reproduced speech.

The second frame type has a different balance between the adaptive codebook index and the fixed codebook index than the first frame type has to maximize the perceived quality of the reproduced speech signal. Because the first frame type carries generally stationary voiced data, a lesser number of storage units (e.g., bits) of adaptive codebook index provide a truthful reproduction of the original speech signal consistent with a target perceptual standard. In contrast, a greater number of storage units is required to adequately express the remnant speech characteristics of the second frame type to comply with a target perceptual standard. The lesser number of storage units are required for the adaptive codebook index of the second frame because the long-term information of the speech signal is generally uniformly periodic. Thus, for the first frame type, a past sample of the speech signal provides a reliable basis for a future estimate of the speech signal. The difference between the total number of storage units and the lesser number of storage units provides a bit or word surplus that is used to enhance the performance of the fixed codebook 50 for the first frame type or reduce the bandwidth used for the air interface. The fixed codebook can enhance the quality of speech by improving the accuracy of modeling noise-like speech components and transients in the speech signal.

After step S28 in step S30, the encoder 11 transmits the allocated storage units (e.g., bits) per frame for the adaptive codebook index 72 and the fixed codebook index 74 from an encoder 11 to a decoder 70 over an air interface 64 of a wireless communications system. The encoder 11 may include a rate-determination module for determining a desired transmission rate of the adaptive codebook index 72 and the fixed codebook index 74 over the air interface 64. For example, the rate determination module may receive an input from the speech classifier 26 of the speech classifications for each corresponding time interval, a speech quality mode selection for a particular subscriber station of the wireless communication system, and a classification output from a pitch pre-processing module 22.

FIG. 6 and FIG. 7 illustrate a higher-rate coding scheme (e.g., full-rate) and a lower-rate coding scheme (e.g., half-rate), respectively. As shown the higher-rate coding scheme provides a higher transmission rate per frame over the air interface 64. The higher-rate coding scheme supports a first frame type and a second frame type. The lower-rate coding scheme supports a third frame type and a fourth frame type. The first frame, the second frame, the third frame, and the fourth frame represent data structures that are transmitted over an air interface 64 of a wireless system from the encoder 11 to the decoder 60. A type identifier 71 is a symbol or bit representation that distinguishes on frame type from another. For example, in FIG. 6 the type identifier is used to distinguish the first frame type from the second frame type.

The data structures provide a format for representing the reference data that represents a speech signal. The reference data may include the filter coefficient indicators 76 (e.g., LSF's), the adaptive codebook indices 72, the fixed codebook indices 74, the adaptive codebook gain indices 80, and the fixed codebook gain indices 78, or other reference data, as previously described herein. The foregoing reference data was previously described in conjunction with FIG. 1.

The first frame type represents generally stationary voiced speech. Generally stationary voiced speech is characterized by a generally periodic waveform or quasiperiodic waveform of a long-term component of the speech signal. The second frame type is used to encode speech other than generally stationary voiced speech: As used herein, speech other than stationary voiced speech is referred to a remnant speech. Remnant speech includes noise components of speech, plosives, onset transients, unvoiced speech, among other classifications of speech characteristics. The first frame type and the second frame type preferably include an equivalent number of subframes (e.g., 4 subframes) within a frame. Each of the first frame and the second frame may be approximately 20 milliseconds long, although other different frame durations may be used to practice the invention. The first frame and the second frame each contain an approximately equivalent total number of storage units (e.g., 170 bits).

The column labeled first encoding scheme 97 defines the bit allocation and data structure of the first frame type. The column labeled second encoding scheme 99 defines the bit allocation and data structure of the second frame type. The allocation of the storage units of the first frame differs from the allocation of storage units in the second frame with respect to the balance of storage units allocated to the fixed codebook index 74 and the adaptive codebook index 72. In particular, the second frame type allots more bits to the adaptive codebook index 72 than the first frame type does.

Conversely, the second frame type allots less bits for the fixed codebook index 74 than the first frame type. In one example, the second frame type allocates 26 bits per frame to the adaptive codebook index 72 and 88 bits per frame to the fixed codebook index 74.

Meanwhile, the first frame type allocates 8 bits per frame to the adaptive codebook index 72 and only 120 bits per frame to the fixed codebook index 74.

Lag values provide references to the entries of excitation vectors within the adaptive codebook 36. The second frame type is geared toward transmitting a greater number of lag values per unit time (e.g., frame) than the first frame type. In one embodiment, the second frame type transmits lag values on a subframe-by-subframe basis, whereas the first frame type transmits lag values on a frame by frame basis. For the second frame type, the adaptive codebook 36 indices or data may be transmitted from the encoder 11 and the decoder 70 in accordance with a differential encoding scheme as follows. A first lag value is transmitted as an eight bit code word. A second lag value is transmitted as a five bit codeword with a value that represents a difference between the first lag value and absolute second lag value. A third lag value is transmitted as an eight bit codeword that represents an absolute value of lag. A fourth lag value is transmitted as a five bit codeword that represents a difference between the third lag value an absolute fourth lag value. Accordingly, the resolution of the first lag value through the fourth lag value is substantially uniform despite the fluctuations in the raw numbers of transmitted bits, because of the advantages of differential encoding.

For the lower-rate coding scheme, which is shown in FIG. 7, the encoder 11 supports a third encoding scheme 103 described in the middle column and a fourth encoding scheme 101 described in the rightmost column. The third encoding scheme 103 is associated with the fourth frame type. The fourth encoding scheme 101 is associated with the fourth frame type.

The third frame type is a variant of the second frame type, as shown in the middle column of FIG. 7. The fourth frame type is configured for a lesser transmission rate over the air interface 64 than the second frame type. Similarly, the third frame type is a variant of the first frame type, as shown in the rightmost column of FIG. 7. Accordingly, in any embodiment disclosed in the specification, the third encoding scheme 103 may be substituted for the first encoding scheme 99 where a lower-rate coding technique or lower perceptual quality suffices. Likewise, in any embodiment disclosed in the specification, the fourth encoding scheme 101 may be substituted for the second encoding scheme 97 where a lower rate coding technique or lower perceptual quality suffices.

The third frame type is configured for a lesser transmission rate over the air interface 64 than the second frame. The total number of bits per frame for the lower-rate coding schemes of FIG. 6 is less than the total number of bits per frame for the higher-rate coding scheme of FIG. 7 to facilitate the lower transmission rate. For example, the total number of bits for the higher-rate coding scheme may approximately equal 170 bits, while the number of bits for the lower-rate coding scheme may approximately equal 80 bits. The third frame type preferably includes three subframes per frame. The fourth frame type preferably includes two subframes per frame.

The allocation of bits between the third frame type and the fourth frame type differs in a comparable manner to the allocated difference of storage units within the first frame type and the second frame type. The fourth frame type has a greater number of storage units for adaptive codebook index 72 per frame than the third frame type does. For example, the fourth frame type allocates 14 bits per frame for the adaptive codebook index 72 and the third frame type allocates 7 bits per frame. The difference between the total bits per frame and the adaptive codebook 36 bits per frame for the third frame type represents a surplus. The surplus may be used to improve resolution of the fixed codebook 50 for the third frame type with respect to the fourth frame type. In one example, the fourth frame type has an adaptive codebook 36 resolution of 30 bits per frame and the third frame type has an adaptive codebook 36 resolution of 39 bits per frame.

In practice, the encoder may use one or more additional coding schemes other than the higher-rate coding scheme and the lower-rate coding scheme to communicate a speech signal from an encoder site to a decoder site over an air interface 64. For example, an additional coding schemes may include a quarter-rate coding scheme and an eighth-rate coding scheme. In one embodiment, the additional coding schemes do not use the adaptive codebook 36 data or the fixed codebook 50 data. Instead, additional coding schemes merely transmit the filter coefficient data and energy data from an encoder to a decoder.

The selection of the second frame type versus the first frame type and the selection of the fourth frame type versus the third frame type hinges on the detector 24, the speech characteristic classifier 26, or both. If the detector 24 determines that the speech is generally stationary voiced during an interval, the first frame type and the third frame type are available for coding. In practice, the first frame type and the third frame type may be selected for coding based on the quality mode selection and the contents of the speech signal. The quality mode may represent a speech quality level that is determined by a service provider of a wireless service.

In accordance with one aspect the invention, a speech encoding system for encoding an input speech signal allocates storage units of a frame between an adaptive codebook index and a fixed codebook index depending upon the detection of a triggering characteristic of the input speech signal. The different allocations of storage units facilitate enhanced perceptual quality of reproduced speech, while conserving the available bandwidth of an air interface of a wireless system.

Further technical details that describe the present invention are set forth in co-pending U.S. application Ser. No. 09/154,660, filed on Sep. 18, 1998, entitled SPEECH ENCODER ADAPTIVELY APPLYING PITCH PREPROCESSING WITH CONTINUOUS WARPING, which is hereby incorporated by reference herein.

Figure 8A:
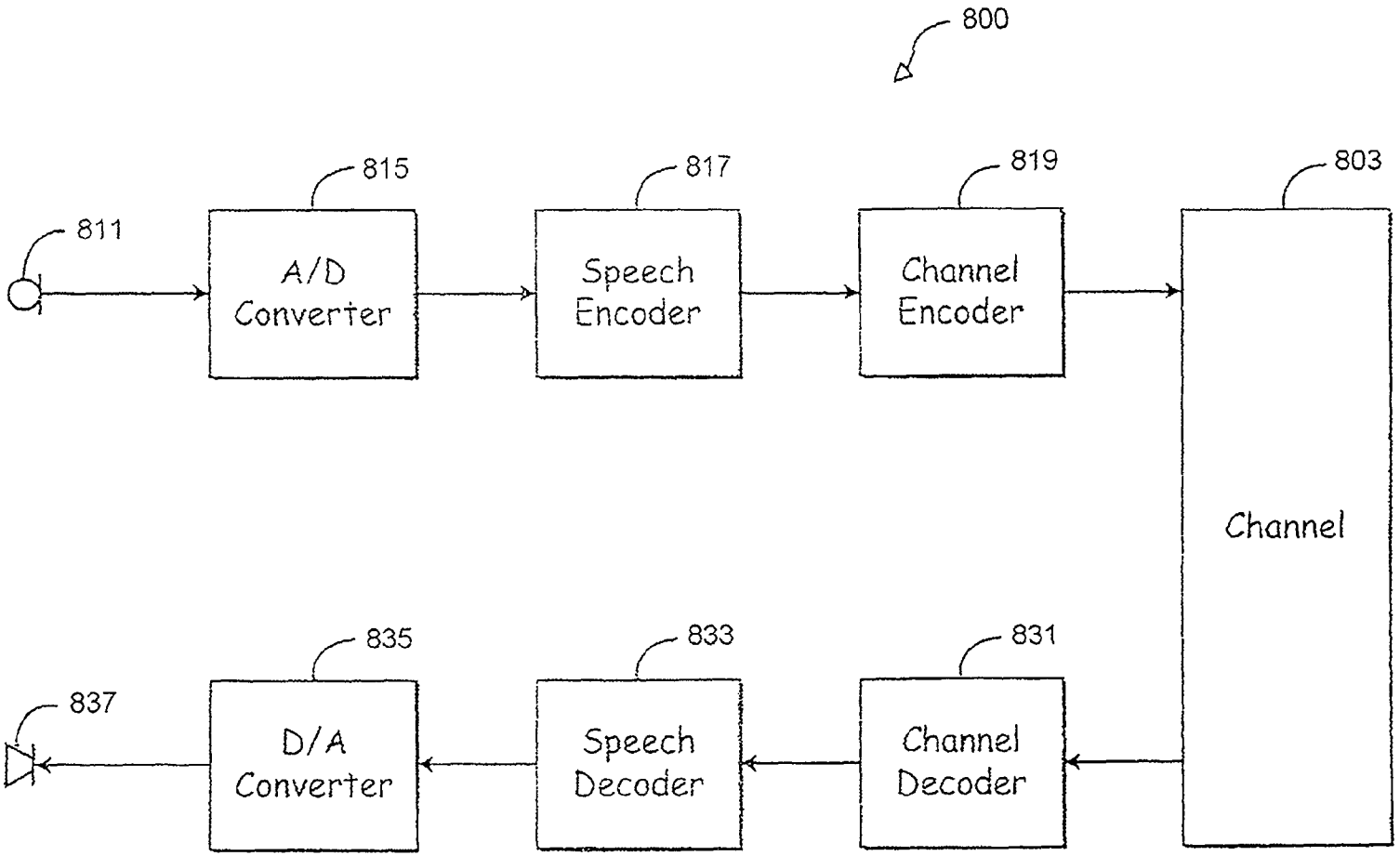
FIG. 8*a* is a schematic block diagram of a speech communication system illustrating the use of source encoding and decoding in accordance with the present invention.

FIG. 8*a* is a schematic block diagram of a speech communication system illustrating the use of source encoding and decoding in accordance with the present invention. Therein, a speech communication system 800 supports communication and reproduction of speech across a communication channel 803. Although it may comprise for example a wire, fiber or optical link, the communication channel 803 typically comprises, at least in part, a radio frequency link that often must support multiple, simultaneous speech exchanges requiring shared bandwidth resources such as may be found with cellular telephony embodiments.

Although not shown, a storage device may be coupled to the communication channel 803 to temporarily store speech information for delayed reproduction or playback, e.g., to perform answering machine functionality, voiced email, etc. Likewise, the communication channel 803 might be replaced by such a storage device in a single device embodiment of the communication system 800 that, for example, merely records and stores speech for subsequent playback.

In particular, a microphone 811 produces a speech signal in real time. The microphone 811 delivers the speech signal to an A/D (analog to digital) converter 815. The A/D converter 815 converts the speech signal to a digital form then delivers the digitized speech signal to a speech encoder 817.

The speech encoder 817 encodes the digitized speech by using a selected one of a plurality of encoding modes. Each of the plurality of encoding modes utilizes particular techniques that attempt to optimize quality of resultant reproduced speech. While operating in any of the plurality of modes, the speech encoder 817 produces a series of modeling and parameter information (hereinafter "speech indices"), and delivers the speech indices to a channel encoder 819.

The channel encoder 819 coordinates with a channel decoder 831 to deliver the speech indices across the communication channel 803. The channel decoder 831 forwards the speech indices to a speech decoder 833. While operating in a mode that corresponds to that of the speech encoder 817, the speech decoder 833 attempts to recreate the original speech from the speech indices as accurately as possible at a speaker 837 via a D/A (digital to analog) converter 835.

The speech encoder 817 adaptively selects one of the plurality of operating modes based on the data rate restrictions through the communication channel 803. The communication channel 803 comprises a bandwidth allocation between the channel encoder 819 and the channel decoder 831. The allocation is established, for example, by telephone switching networks wherein many such channels are allocated and reallocated as need arises. In one such embodiment, either a 22.8 kbps (kilobits per second) channel bandwidth, i.e., a full rate channel, or a 11.4 kbps channel bandwidth, i.e., a half rate channel, may be allocated.

With the full rate channel bandwidth allocation, the speech encoder 817 may adaptively select an encoding mode that supports a bit rate of 11.0, 8.0, 6.65 or 5.8 kbps. The speech encoder 817 adaptively selects an either 8.0, 6.65, 5.8 or 4.5 kbps encoding bit rate mode when only the half rate channel has been allocated. Of course these encoding bit rates and the aforementioned channel allocations are only representative of the present embodiment. Other variations to meet the goals of alternate embodiments are contemplated.

With either the full or half rate allocation, the speech encoder 817 attempts to communicate using the highest encoding bit rate mode that the allocated channel will support. If the allocated channel is or becomes noisy or otherwise restrictive to the highest or higher encoding bit rates, the speech encoder 817 adapts by selecting a lower bit rate encoding mode. Similarly, when the communication channel 803 becomes more favorable, the speech encoder 817 adapts by switching to a higher bit rate encoding mode.

With lower bit rate encoding, the speech encoder 817 incorporates various techniques to generate better low bit rate speech reproduction. Many of the techniques applied are based on characteristics of the speech itself. For example, with lower bit rate encoding, the speech encoder 817 classifies noise, unvoiced speech, and voiced speech so that an appropriate modeling scheme corresponding to a particular classification can be selected and implemented. Thus, the speech encoder 817 adaptively selects from among a plurality of modeling schemes those most suited for the current speech. The speech encoder 817 also applies various other techniques to optimize the modeling as set forth in more detail below.

Figure 8B:
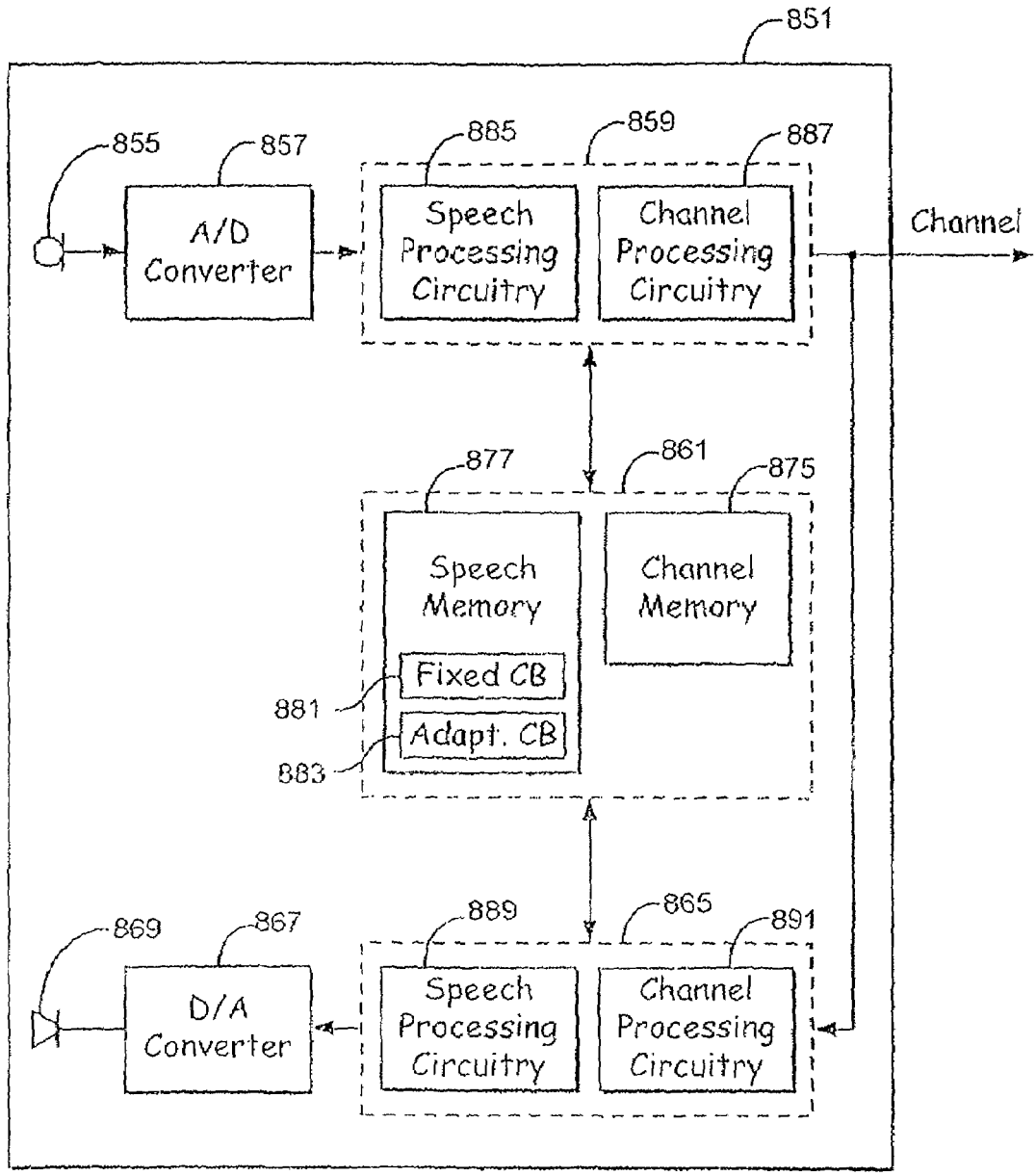
FIG. 8*b* is a schematic block diagram illustrating an exemplary communication device utilizing the source encoding and decoding functionality of FIG. 8*a*.

FIG. 8*b* is a schematic block diagram illustrating several variations of an exemplary communication device employing the functionality of FIG. 8*a*. A communication device 851 comprises both a speech encoder and decoder for simultaneous capture and reproduction of speech. Typically within a single housing, the communication device 851 might, for example, comprise a cellular telephone, portable telephone, computing system, etc. Alternatively, with some modification to include for example a memory element to store encoded speech information the communication device 851 might comprise an answering machine, a recorder, voice mail system, etc.

A microphone 855 and an A/D converter 857 coordinate to deliver a digital voice signal to an encoding system 859. The encoding system 859 performs speech and channel encoding and delivers resultant speech information to the channel. The delivered speech information may be destined for another communication device (not shown) at a remote location.

As speech information is received, a decoding system 865 performs channel and speech decoding then coordinates with a D/A converter 867 and a speaker 869 to reproduce something that sounds like the originally captured speech.

The encoding system 859 comprises both a speech processing circuit 885 that performs speech encoding, and a channel processing circuit 887 that performs channel encoding. Similarly, the decoding system 865 comprises a speech processing circuit 889 that performs speech decoding, and a channel processing circuit 891 that performs channel decoding.

Although the speech processing circuit 885 and the channel processing circuit 887 are separately illustrated, they might be combined in part or in total into a single unit. For example, the speech processing circuit 885 and the channel processing circuitry 887 might share a single DSP (digital signal processor) and/or other processing circuitry. Similarly, the speech processing circuit 889 and the channel processing circuit 891 might be entirely separate or combined in part or in whole. Moreover, combinations in whole or in part might be applied to the speech processing circuits 885 and 889, the channel processing circuits 887 and 891, the processing circuits 885, 887, 889 and 891, or otherwise.

The encoding system 859 and the decoding system 865 both utilize a memory 861. The speech processing circuit 885 utilizes a fixed codebook 881 and an adaptive codebook 883 of a speech memory 877 in the source encoding process. The channel processing circuit 887 utilizes a channel memory 875 to perform channel encoding. Similarly, the speech processing circuit 889 utilizes the fixed codebook 881 and the adaptive codebook 883 in the source decoding process. The channel processing circuit 891 utilizes the channel memory 875 to perform channel decoding.

Although the speech memory 877 is shared as illustrated, separate copies thereof can be assigned for the processing circuits 885 and 889. Likewise, separate channel memory can be allocated to both the processing circuits 887 and 891. The memory 861 also contains software utilized by the processing circuits 885,887,889 and 891 to perform various functionality required in the source and channel encoding and decoding processes.

Figure 9:
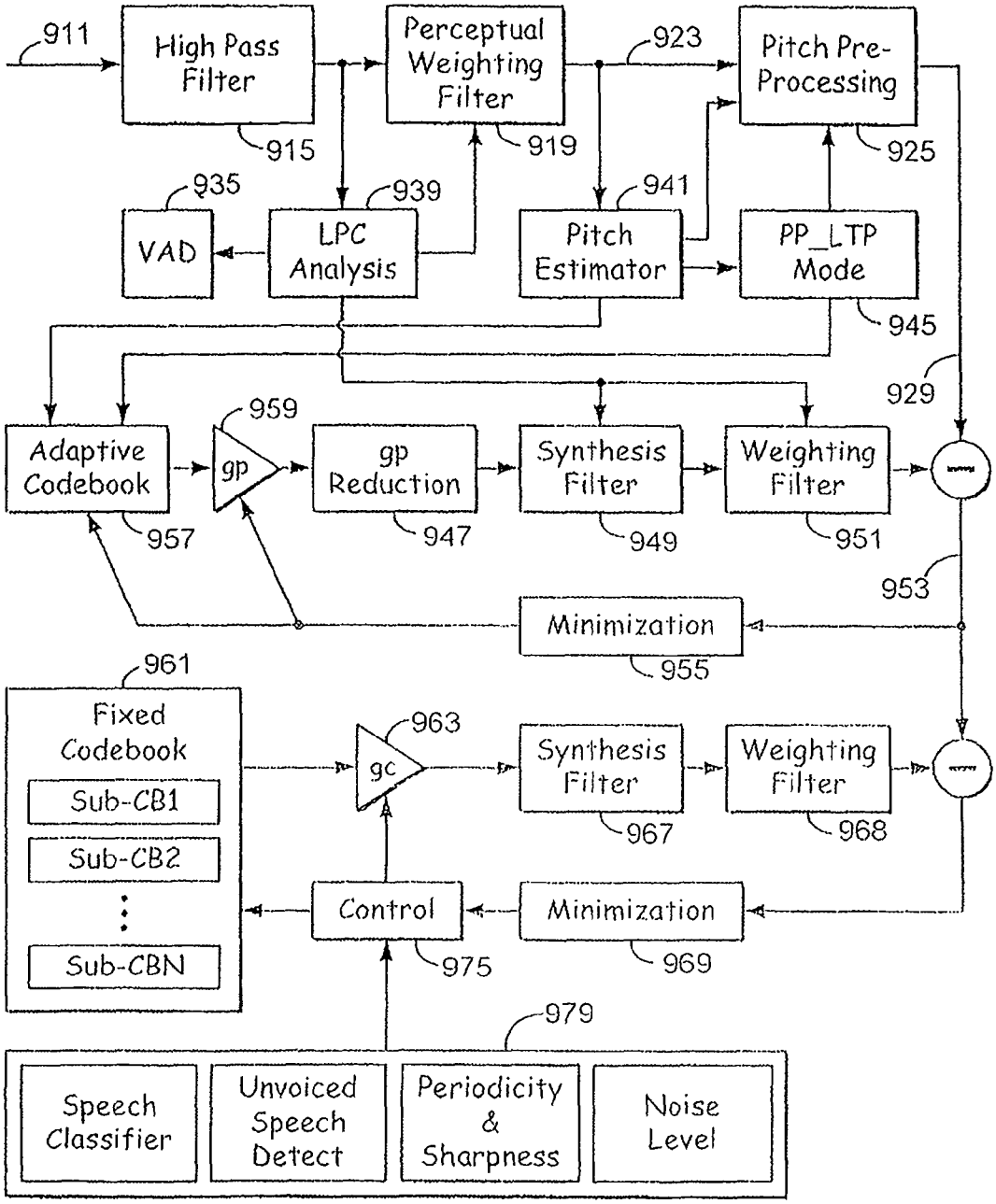
FIGS. 9-11 are functional block diagrams illustrating a multi-step encoding approach used by one embodiment of the speech encoder illustrated in FIGS. 8*a* and 8*b*. In particular.
Figure 10:
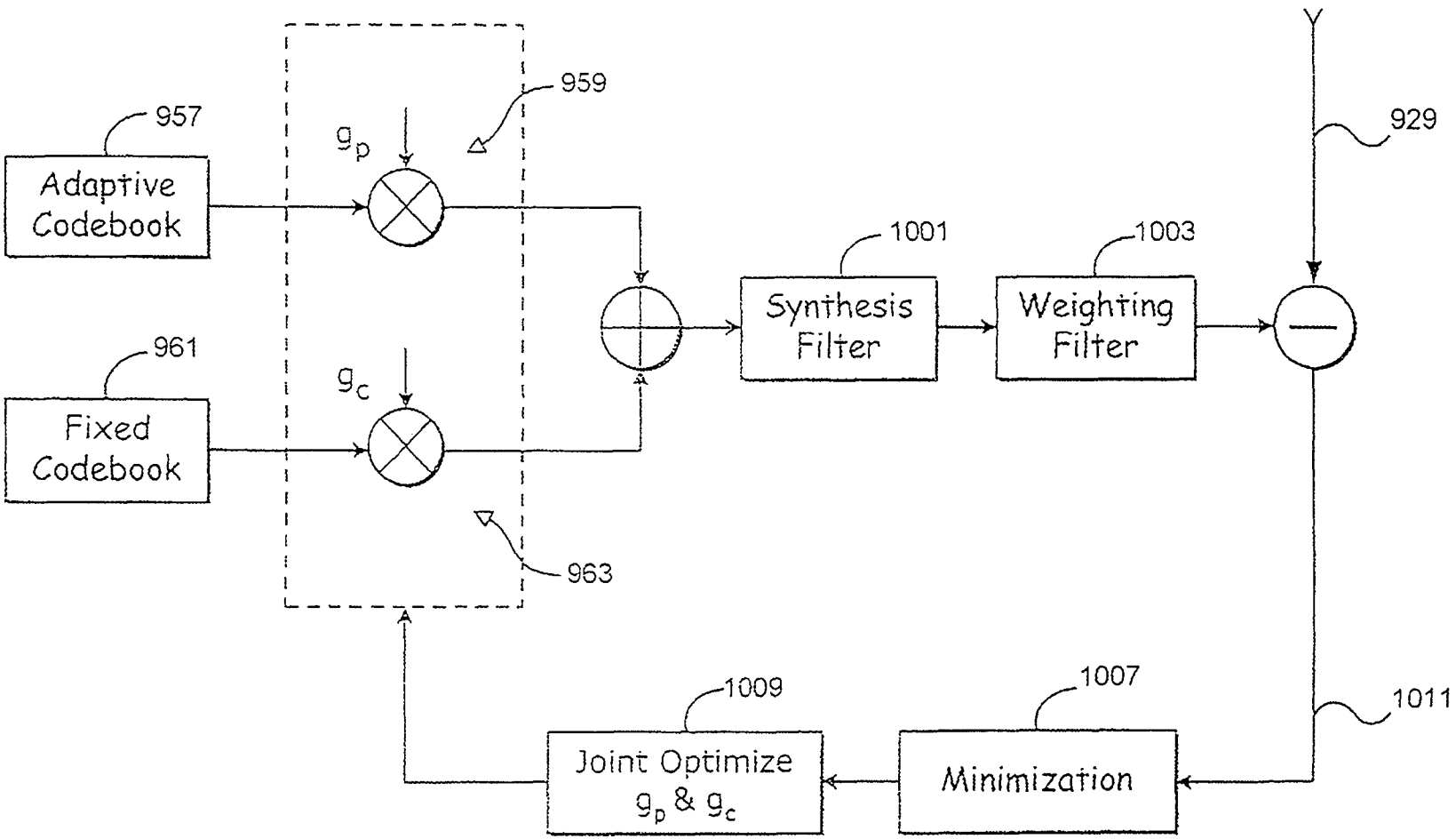
Figure 11:
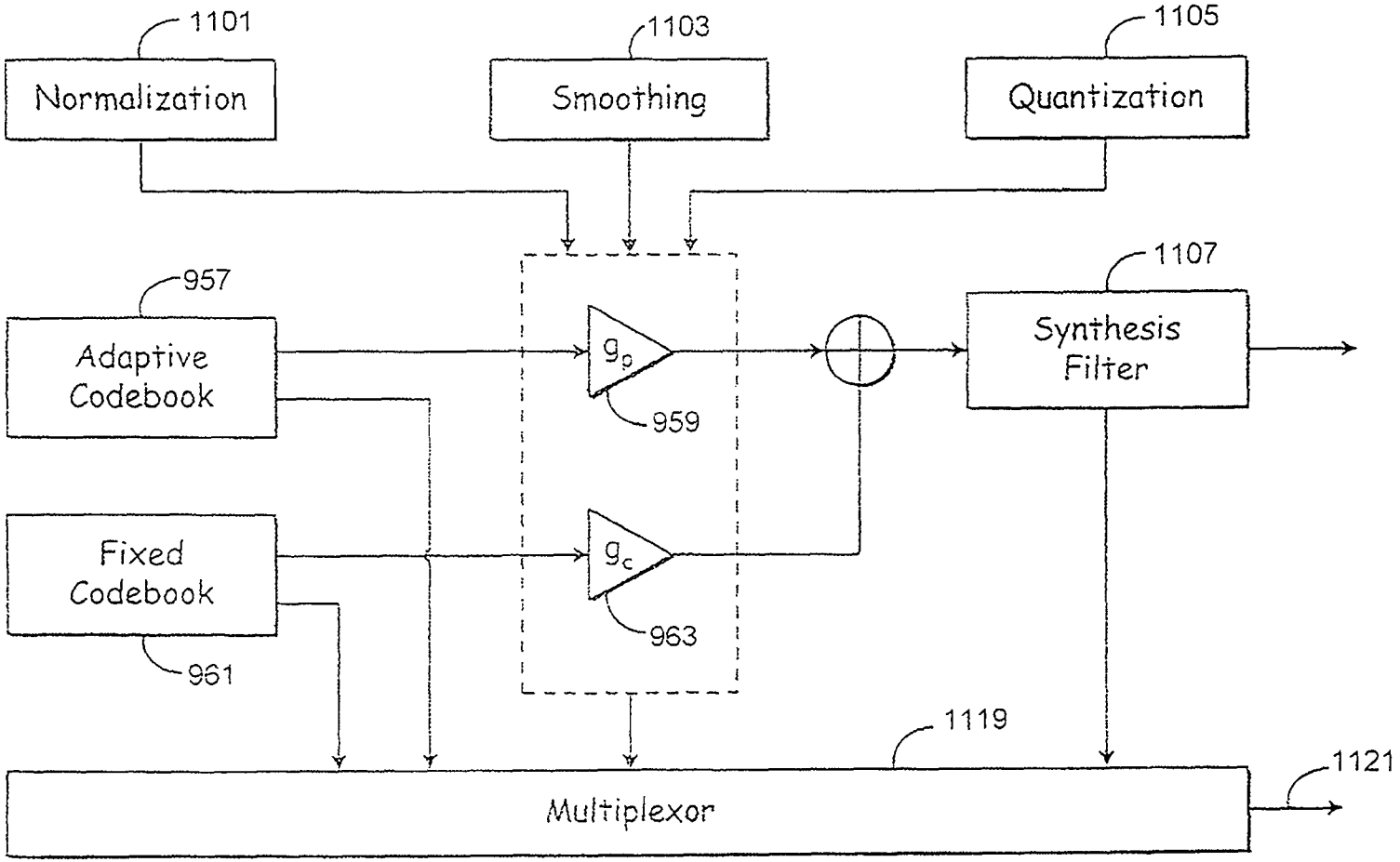

FIGS. 9-11 are functional block diagrams illustrating a multi-step encoding approach used by one embodiment of the speech encoder illustrated in FIGS. 8*a* and 8*b*. In particular, FIG. 9 is a functional block diagram illustrating of a first stage of operations performed by one embodiment of the speech encoder shown in FIGS. 8*a* and 8*b*. The speech encoder, which comprises encoder processing circuitry, typically operates pursuant to software instruction carrying out the following functionality.

At a block 915, source encoder processing circuitry performs high pass filtering of a speech signal 911. The filter uses a cutoff frequency of around 80 Hz to remove, for example, 60 Hz power line noise and other lower frequency signals. After such filtering, the source encoder processing circuitry applies a perceptual weighting filter as represented by a block 919. The perceptual weighting filter operates to emphasize the valley areas of the filtered speech signal.

If the encoder processing circuitry selects operation in a pitch preprocessing (PP) mode as indicated at a control block 945, a pitch preprocessing operation is performed on the weighted speech signal at a block 925. The pitch preprocessing operation involves warping the weighted speech signal to match interpolated pitch values that will be generated by the decoder processing circuitry. When pitch preprocessing is applied, the warped speech signal is designated a first target signal 929. If pitch preprocessing is not selected the control block 945, the weighted speech signal passes through the block 925 without pitch preprocessing and is designated the first target signal 929.

As represented by a block 955, the encoder processing circuitry applies a process wherein a contribution from an adaptive codebook 957 is selected along with a corresponding gain 957 which minimize a first error signal 953. The first error signal 953 comprises the difference between the first target signal 929 and a weighted, synthesized contribution from the adaptive codebook 957.

At blocks 947, 949 and 951, the resultant excitation vector is applied after adaptive gain reduction to both a synthesis and a weighting filter to generate a modeled signal that best matches the first target signal 929. The encoder processing circuitry uses LPC (linear predictive coding) analysis, as indicated by a block 939, to generate filter parameters for the synthesis and weighting filters. The weighting filters 919 and 951 are equivalent in functionality.

Next, the encoder processing circuitry designates the first error signal 953 as a second target signal for matching using contributions from a fixed codebook 961. The encoder processing circuitry searches through at least one of the plurality of subcodebooks within the fixed codebook 961 in an attempt to select a most appropriate contribution while generally attempting to match the second target signal.

More specifically, the encoder processing circuitry selects an excitation vector, its corresponding subcodebook and gain based on a variety of factors. For example, the encoding bit rate, the degree of minimization, and characteristics of the speech itself as represented by a block 979 are considered by the encoder processing circuitry at control block 975. Although many other factors may be considered, exemplary characteristics include speech classification, noise level, sharpness, periodicity, etc. Thus, by considering other such factors, a first subcodebook with its best excitation vector may be selected rather than a second subcodebook's best excitation vector even though the second subcodebook's better minimizes the second target signal 965.

FIG. 10 is a functional block diagram depicting of a second stage of operations performed by the embodiment of the speech encoder illustrated in FIG. 9. In the second stage, the speech encoding circuitry simultaneously uses both the adaptive and the fixed codebook vectors found in the first stage of operations to minimize a third error signal 1011.

The speech encoding circuitry searches for optimum gain values for the previously identified excitation vectors (in the first stage) from both the adaptive and fixed codebooks 957 and 961. As indicated by blocks 1007 and 1009, the speech encoding circuitry identifies the optimum gain by generating a synthesized and weighted signal, i.e., via a block 1001 and 1003, that best matches the first target signal 929 (which minimizes the third error signal 1011). Of course if processing capabilities permit, the first and second stages could be combined wherein joint optimization of both gain and adaptive and fixed codebook rector selection could be used.

FIG. 11 is a functional block diagram depicting of a third stage of operations performed by the embodiment of the speech encoder illustrated in FIGS. 9 and 10. The encoder processing circuitry applies gain normalization, smoothing and quantization, as represented by blocks 1101, 1103 and 1105, respectively, to the jointly optimized gains identified in the second stage of encoder processing. Again, the adaptive and fixed codebook vectors used are those identified in the first stage processing.

With normalization, smoothing and quantization functionally applied, the encoder processing circuitry has completed the modeling process. Therefore, the modeling parameters identified are communicated to the decoder. In particular, the encoder processing circuitry delivers an index to the selected adaptive codebook vector to the channel encoder via a multiplexor 1119. Similarly, the encoder processing circuitry delivers the index to the selected fixed codebook vector, resultant gains, synthesis filter parameters, etc., to the multiplexor 1119. The multiplexor 1119 generates a bit stream 1121 of such information for delivery to the channel encoder for communication to the channel and speech decoder of receiving device.

Figure 12:
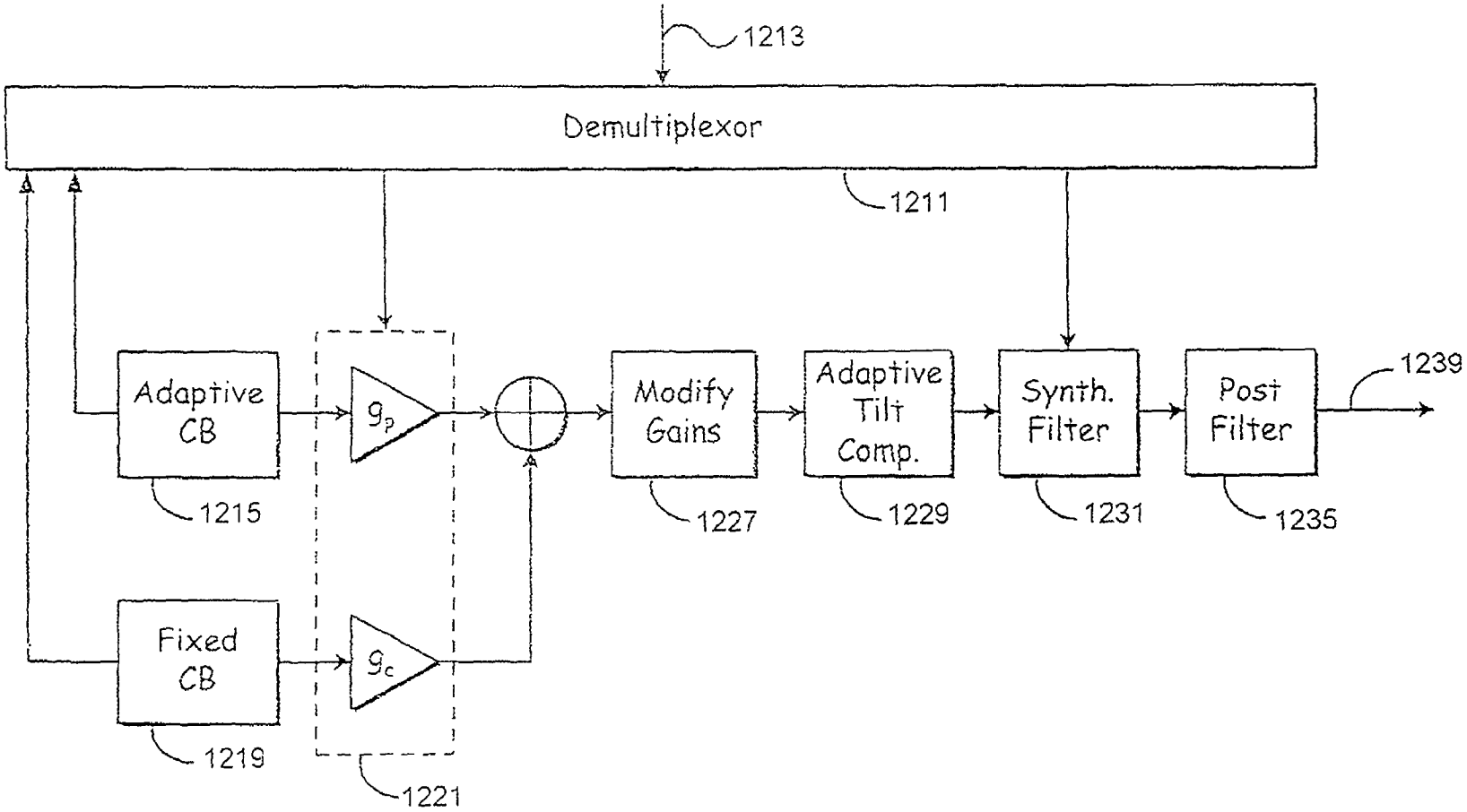
FIG. 12 is a block diagram of one embodiment of the speech decoder shown in FIGS. 8*a* and 8*b* having corresponding functionality to that illustrated in FIGS. 9-11.

FIG. 12 is a block diagram of an embodiment illustrating functionality of speech decoder having corresponding functionality to that illustrated in FIGS. 9-11. As with the speech encoder, the speech decoder, which comprises decoder processing circuitry, typically operates pursuant to software instruction carrying out the following functionality.

A demultiplexor 1211 receives a bit stream 1213 of speech modeling indices from an often remote encoder via a channel decoder. As previously discussed, the encoder selected each index value during the multi-stage encoding process described above in reference to FIGS. 9-11. The decoder processing circuitry utilizes indices, for example, to select excitation vectors from an adaptive codebook 1215 and a fixed codebook 1219, set the adaptive and fixed codebook gains at a block 1221, and set the parameters for a synthesis filter 1231.

With such parameters and vectors selected or set, the decoder processing circuitry generates a reproduced speech signal 1239. In particular, the codebooks 1215 and 1219 generate excitation vectors identified by the indices from the demultiplexor 1211. The decoder processing circuitry applies the indexed gains at the block 1221 to the vectors which are summed. At a block 1227, the decoder processing circuitry modifies the gains to emphasize the contribution of vector from the adaptive codebook 1215. At a block 1229, adaptive tilt compensation is applied to the combined vectors with a goal of flattening the excitation spectrum. The decoder processing circuitry performs synthesis filtering at the block 1231 using the flattened excitation signal. Finally, to generate the reproduced speech signal 1239, post filtering is applied at a block 1235 deemphasizing the valley areas of the reproduced speech signal 1239 to reduce the effect of distortion.

In the exemplary cellular telephony embodiment of the present invention, the A/D converter 815 (FIG. 8*a*) will generally involve analog to uniform digital PCM including: 1) an input level adjustment device; 2) an input anti-aliasing filter; 3) a sample-hold device sampling at 8 kHz; and 4) analog to uniform digital conversion to 13-bit representation.

Similarly, the D/A converter 835 will generally involve uniform digital PCM to analog including: 1) conversion from 13-bit/8 kHz uniform PCM to analog; 2) a hold device; 3) reconstruction filter including x/sin(x) correction; and 4) an output level adjustment device.

In terminal equipment, the A/D function may be achieved by direct conversion to 13-bit uniform PCM format, or by conversion to 8-bit/A-law compounded format. For the D/A operation, the inverse operations take place.

The encoder 817 receives data samples with a resolution of 13 bits left justified in a 16-bit word. The three least significant bits are set to zero. The decoder 833 outputs data in the same format. Outside the speech codec, further processing can be applied to accommodate traffic data having a different representation.

A specific embodiment of an AMR (adaptive multi-rate) codec with the operational functionality illustrated in FIGS. 9-12 uses five source codecs with bit-rates 11.0, 8.0, 6.65, 5.8 and 4.55 kbps. Four of the highest source coding bit-rates are used in the full rate channel and the four lowest bit-rates in the half rate channel.

All five source codecs within the AMR codec are generally based on a code-excited linear predictive (CELP) coding model. A 10th order linear prediction (LP), or short-term, synthesis filter, e.g., used at the blocks 949, 967, 1001, 1107 and 1231 (of FIGS. 9-12), is used which is given by:

$$H(z) = \frac{1}{\hat{A}(z)} = \frac{1}{1 + \sum_{i=1}^{m} \hat{a}_i z^{-i}},$$

where $a_i$, i=1, . . . , m, are the (quantized) linear prediction (LP) parameters.

A long-term filter, i.e., the pitch synthesis filter, is implemented using either an adaptive codebook approach or a pitch pre-processing approach. The pitch synthesis filter is given by:

$$\frac{1}{B(z)} = \frac{1}{1 - g_p z^{-T}},$$

where T is the pitch delay and $g_p$ is the pitch gain.

With reference to FIG. 9, the excitation signal at the input of the short-term LP synthesis filter at the block 949 is constructed by adding two excitation vectors from the adaptive and the fixed codebooks 957 and 961, respectively. The speech is synthesized by feeding the two properly chosen vectors from these codebooks through the short-term synthesis filter at the block 949 and 967, respectively.

The optimum excitation sequence in a codebook is chosen using an analysis-by-synthesis search procedure in which the error between the original and synthesized speech is minimized according to a perceptually weighted distortion measure. The perceptual weighting filter, e.g., at the blocks 951 and 968, used in the analysis-by-synthesis search technique is given by:

$$W(z) = \frac{A(z/\gamma_1)}{A(z/\gamma_2)}.$$

where A(z) is the unquantized LP filter and $0<\gamma_2<\gamma_1\leq 1$ are the perceptual weighting factors. The values $\gamma_1$=[0.9, 0.94] and $\gamma_2$=0.6 are used. The weighting filter, e.g., at the blocks 951 and 968, uses the unquantized LP parameters while the formant synthesis filter, e.g., at the blocks 949 and 967, uses the quantized LP parameters. Both the unquantized and quantized LP parameters are generated at the block 939.

The present encoder embodiment operates on 20 ms (millisecond) speech frames corresponding to 160 samples at the sampling frequency of 8000 samples per second. At each 160 speech samples, the speech signal is analyzed to extract the parameters of the CELP model, i.e., the LP filter coefficients, adaptive and fixed codebook indices and gains. These parameters are encoded and transmitted. At the decoder, these parameters are decoded and speech is synthesized by filtering the reconstructed excitation signal through the LP synthesis filter.

More specifically, LP analysis at the block 939 is performed twice per frame but only a single set of LP parameters is converted to line spectrum frequencies (LSF) and vector quantized using predictive multi-stage quantization (PMVQ). The speech frame is divided into subframes. Parameters from the adaptive and fixed codebooks 957 and 961 are transmitted every subframe. The quantized and unquantized LP parameters or their interpolated versions are used depending on the subframe. An open-loop pitch lag is estimated at the block 941 once or twice per frame for PP mode or LTP mode, respectively.

Each subframe, at least the following operations are repeated. First, the encoder processing circuitry (operating pursuant to software instruction) computes x(n), the first target signal 929, by filtering the LP residual through the weighted synthesis filter W(z)H(z) with the initial states of the filters having been updated by filtering the error between LP residual and excitation. This is equivalent to an alternate approach of subtracting the zero input response of the weighted synthesis filter from the weighted speech signal.

Second, the encoder processing circuitry computes the impulse response, h(n), of the weighted synthesis filter. Third, in the LTP mode, closed-loop pitch analysis is performed to find the pitch lag and gain, using the first target signal 229, x(n), and impulse response, h(n), by searching around the open-loop pitch lag. Fractional pitch with various sample resolutions are used.

In the PP mode, the input original signal has been pitch-preprocessed to match the interpolated pitch contour, so no closed-loop search is needed. The LTP excitation vector is computed using the interpolated pitch contour and the past synthesized excitation.

Fourth, the encoder processing circuitry generates a new target signal $x_2(n)$, the second target signal 953, by removing the adaptive codebook contribution (filtered adaptive code vector) from x(n). The encoder processing circuitry uses the second target signal 953 in the fixed codebook search to find the optimum innovation.

Fifth, for the 11.0 kbps bit rate mode, the gains of the adaptive and fixed codebook are scalar quantized with 4 and 5 bits respectively (with moving average prediction applied to the fixed codebook gain). For the other modes the gains of the adaptive and fixed codebook are vector quantized (with moving average prediction applied to the fixed codebook gain).

Finally, the filter memories are updated using the determined excitation signal for finding the first target signal in the next subframe.

The bit allocation of the AMR codec modes is shown in table 1. For example, for each 20 ms speech frame, 220, 160, 133, 116 or 91 bits are produced, corresponding to bit rates of 11.0, 8.0, 6.65, 5.8 or 4.55 kbps, respectively.

TABLE 1

Bit allocation of the AMR coding algorithm for 20 ms frame

| CODING RATE | 11.0 KBPS | 8.0 KBPS | 6.65 KBPS | 5.80 KBPS | 4.55 KBPS |
|---|---|---|---|---|---|
| Frame size | | | 20 ms | | |
| Look ahead | | | 5 ms | | |
| LPC order | | | $10^{th}$-order | | |
| Predictor for LSF | | 1 predictor: | | | 2 predictors: |
| Quantization | | 0 bit/frame | | | 1 bit/frame |
| LSP Quantization | 28 bit/frame | | 24 bit/frame | | 18 |
| LPC interpolation | 2 bits/frame | 2 bit/f 0 | 2 bits/f 0 | 0 | 0 |
| Coding mode bit | 0 bit | 0 bit | 1 bit/frame | 0 bit | 0 bit |
| Pitch mode | LTP | LTP | LTP PP | PP | PP |
| Subframe size | 5 ms | | | | |
| Pitch Lag | 30 bits/frame (9696) | 8585 | 8585 0008 | 0008 | 0008 |
| Fixed excitation | 31 bits/subframe | 20 | 13 18 | 14 bits/subframe | 10 bits/subframe |
| Gain quantization | 9 bits (scalar) | | 7 bits/subframe | | 6 bits/subframe |
| Total | 220 bits/frame | 160 | 133 133 | 116 | 91 |

With reference to FIG. 12, the decoder processing circuitry, pursuant to software control, reconstructs the speech signal using the transmitted modeling indices extracted from the received bit stream by the demultiplexor 1211. The decoder processing circuitry decodes the indices to obtain the coder parameters at each transmission frame. These parameters are the LSF vectors, the fractional pitch lags, the innovative code vectors, and the two gains.

The LSF vectors are converted to the LP filter coefficients and interpolated to obtain LP filters at each subframe. At each subframe, the decoder processing circuitry constructs the excitation signal by: 1) identifying the adaptive and innovative code vectors from the codebooks 1215 and 1219; 2) scaling the contributions by their respective gains at the block 1221; 3) summing the scaled contributions; and 3) modifying and applying adaptive tilt compensation at the blocks 1227 and 1229. The speech signal is also reconstructed on a subframe basis by filtering the excitation through the LP synthesis at the block 1231. Finally, the speech signal is passed through an adaptive post filter at the block 1235 to generate the reproduced speech signal 1239.

The AMR encoder will produce the speech modeling information in a unique sequence and format, and the AMR decoder receives the same information in the same way. The different parameters of the encoded speech and their individual bits have unequal importance with respect to subjective quality. Before being submitted to the channel encoding function the bits are rearranged in the sequence of importance.

Two pre-processing functions are applied prior to the encoding process: high-pass filtering and signal down-scaling. Down-scaling consists of dividing the input by a factor of 2 to reduce the possibility of overflows in the fixed point implementation. The high-pass filtering at the block 915 (FIG. 9) serves as a precaution against undesired low frequency components. A filter with cut off frequency of 80 Hz is used, and it is given by:

$$H_{hl}(z) = \frac{0.92727435 - 1.8544941z^{-1} + 0.92727435z^{-2}}{1 - 1.9059465z^{-1} + 0.9114024z^{-2}}$$

Down scaling and high-pass filtering are combined by dividing the coefficients of the numerator of $H_{h1}(z)$ by 2.

Short-term prediction, or linear prediction (LP) analysis is performed twice per speech frame using the autocorrelation approach with 30 ms windows. Specifically, two LP analyses are performed twice per frame using two different windows. In the first LP analysis (LP_analysis_1), a hybrid window is used which has its weight concentrated at the fourth subframe. The hybrid window consists of two parts. The first part is half a Hamming window, and the second part is a quarter of a cosine cycle. The window is given by:

$$w_1(n) = \begin{cases} 0.54 - 0.46\cos\left(\frac{\pi n}{L}\right), & n = 0 \text{ to } 214,\ L = 215 \\ \cos\left(\frac{0.49(n-L)\pi}{25}\right), & n = 215 \text{ to } 239 \end{cases}$$

In the second LP analysis (LP_analysis_2), a symmetric Hamming window is used.

$$w_2(n) = \begin{cases} 0.54 - 0.46\cos\left(\frac{\pi n}{L}\right) & n = 0 \text{ to } 119,\ L = 120 \\ 0.54 + 0.46\cos\left(\frac{(n-L)\pi}{120}\right), & n = 120 \text{ to } 239 \end{cases}$$

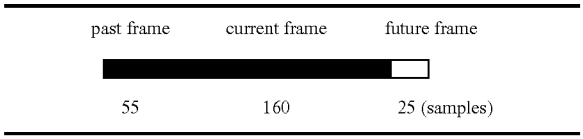

In either LP analysis, the autocorrelations of the windowed speech s (n),n=0.239 are computed by:

$$n(k) = \sum_{n=k}^{239} s(n)s(n-k),\ k = 0, 10.$$

A 60 Hz bandwidth expansion is used by lag windowing, the autocorrelations using the window:

$$w_{lag}(i) = \exp\left[-\frac{1}{2}\left(\frac{2\pi 60 i}{8000}\right)^2\right],\ i = 1, 10.$$

Moreover, r(0) is multiplied by a white noise correction factor 1.0001 which is equivalent to adding a noise floor at −40 dB.

The modified autocorrelations r(0)=1.0001r(0) and r(k)=r(k)$w_{lag}$(k), k=1.10 are used to obtain the reflection coefficients $k_i$ and LP filter coefficients $a_i$, i=1.10 using the Levinson-Durbin algorithm. Furthermore, the LP filter coefficients $a_i$ are used to obtain the Line Spectral Frequencies (LSFs).

The interpolated unquantized LP parameters are obtained by interpolating the LSF coefficients obtained from the LP analysis_1 and those from LP_analysis_2 as:

$$q_1(n)=0.5q_1(n-1)+0.5q_2(n)$$

$$q_2(n)=0.5q_2(n-1)+0.5q_2(n)$$

where $q_1(n)$ is the interpolated LSF for subframe 1, $q_2(n)$ is the LSF of subframe 2 obtained from LP_analysis_2 of current frame, $q_3(n)$ is the interpolated LSF for subframe 3, $q_4(n-1)$ is the LSF (cosine domain) from LP_analysis_1 of previous frame, and $q_4(n)$ is the LSF for subframe 4 obtained from LP_analysis_1 of current frame. The interpolation is carried out in the cosine domain.

A VAD (Voice Activity Detection) algorithm is used to classify input speech frames into either active voice or inactive voice frame (background noise or silence) at a block 935 (FIG. 9).

The input speech s(n) is used to obtain a weighted speech signal $s_w(n)$ by passing s(n) through a filter:

$$W(z) = \frac{A\left(\frac{x}{\gamma 1}\right)}{A\left(\frac{z}{\gamma 2}\right)}.$$

That is, in a subframe of size L_SF, the weighted speech is given by:

$$s_w(n) = s(n) + \sum_{i=1}^{10} a_i \gamma_1^i s(n-i) - \sum_{i=1}^{10} a_i \gamma_2^i s_w(n-i).$$

A voiced/unvoiced classification and mode decision within the block 979 using the input speech s(n) and the residual $r_w(n)$ is derived where:

$$r_w = s(n) + \sum_{i=1}^{10} a_i \gamma_1^i s(n-i),\ n = 0, \text{L_SF} - 1.$$

The classification is based on four measures: 1) speech sharpness P1_SHP; 2) normalized one delay correlation P2_R1; 3) normalized zero-crossing rate P3_ZC; and 4) normalized LP residual energy P4_RE.

The speech sharpness is given by:

$$P1_\text{SHP} = \frac{\sum_{n=0}^{L} \text{abs}(r_w(n))}{\text{Max}L},$$

where Max is the maximum of abs($r_w$(n)) over the specified interval of length L. The normalized one delay correlation and normalized zero-crossing rate are given by:

$$P2_\text{R1} = \frac{\sum_{n=0}^{L-1} s(n)s(n+1)}{\sqrt{\sum_{n=0}^{L-1} s(n)s(n) \sum_{n=0}^{L-1} s(n+1)s(n+1)}}$$

$$P3_\text{ZC} = \frac{1}{2L}\sum_{i=0}^{L-1} [|\text{sgn}[s(i)] - \text{sgn}[s(i-1)]|].$$

where sgn is the sign function whose output is either 1 or −1 depending that the input sample is positive or negative. Finally, the normalized LP residual energy is given by:

$$P4_RE = 1 - \sqrt{\text{lpc_gain}}$$

where $$\text{lpc_gain} = \prod_{i=1}^{10} (1 - k_i^2).$$

where $k_i$ are the reflection coefficients obtained from LP analysis_1.

The voiced/unvoiced decision is derived if the following conditions are met:

if P2_R1<0.6 and P1_SHP>0.2 set mode=2,
if P3_ZC>0.4 and P1_SHP>0.18 set mode=2,
if P4_RE<0.4 and P1_SHP>0.2 set mode=2,
if (P2_R1<−1.2+3.2P1_SHP) set VUV=−3
if (P4)_RE<−0.21+1.4286P1_SHP) set VUV=−3
if (P3_ZC>0.8−0.6P1_SHP) set VUV=−3
if (P4_RE<0.1) set VUV=−3

Open loop pitch analysis is performed once or twice (each 10 ms) per frame depending on the coding rate in order to find estimates of the pitch lag at the block 941 (FIG. 9). It is based on the weighted speech signal $s_w(n+n_m)$, n=0, 1, . . . , 79, in which $n_m$ defines the location of this signal on the first half frame or the last half frame. In the first step, four maxima of the correlation:

$$C_s = \sum_{n=0}^{79} s_w(n_m + n) s_w(n_m + n - k)$$

are found in the four ranges 17 . . . 33, 34 . . . 67, 68 . . . 135, 136 . . . 145, respectively. The retained maxima $C_{k_i}$|, i=1, 2, 3, 4, are normalized by dividing by:

$$\sqrt{\sum_n s_w^2(n_m + n - k)},\ i = 1, \ldots, 4, \text{ respectively.}$$

The normalized maxima and corresponding delays are denoted by ($R_i$,$k_i$), i=1, 2, 3, 4.

In the second step, a delay, $k_l$, among the four candidates, is selected by maximizing the four normalized correlations. In the third step, $k_l$ is probably corrected to $k_i$(i<I) by favoring the lower ranges. That is, $k_i$(i<I) is selected if $k_l$ is within [$k_i$/m−4, $k_i$/m+4], m=2, 3, 4, 5, and if $k_i$>$k_l$ $0.95^{I-i}$ D, i<I, where D is 1.0, 0.85, or 0.65, depending on whether the previous frame is unvoiced, the previous frame is voiced and $k_i$ is in the neighborhood (specified by .+−0.8) of the previous pitch lag, or the previous two frames are voiced and $k_i$ is in the neighborhood of the previous two pitch lags. The final selected pitch lag is denoted by $T_{op}$.

A decision is made every frame to either operate the LTP (long-term prediction) as the traditional CELP approach (LTP_mode=1), or as a modified time warping approach (LTP_mode=0) herein referred to as PP (pitch preprocessing). For 4.55 and 5.8 kbps encoding bit rates, LTP_mode is set to 0 at all times. For 8.0 and 11.0 kbps, LTP_mode is set to 1 all of the time. Whereas, for a 6.65 kbps encoding bit rate, the encoder decides whether to operate in the LTP or PP mode. During the PP mode, only one pitch lag is transmitted per coding frame.

For 6.65 kbps, the decision algorithm is as follows. First, at the block 241, a prediction of the pitch lag pit for the current frame is determined as follows:

```
if(LTP_MODE_m = 1)
    pit = lagl1 + 2.4*(lag_f[3] − lagl1);
else
    pit = lag_f[1] + 2.75*(lag_f[3] − lag_f[1]);
```

where LTP_mode_m is previous frame LTP_mode, lag f[1], lag f[3] are the past closed loop pitch lags for second and fourth subframes respectively, lag1 is the current frame open-loop pitch lag at the second half of the frame, and, lag11 is the previous frame open-loop pitch lag at the first half of the frame.

Second, a normalized spectrum difference between the Line Spectrum Frequencies (LSF) of current and previous frame is computed as:

$$e_lsf = \frac{1}{10}\sum_{i=0}^{9} abs(LSF(i) - LSF_m(i)),$$

```
if (abs(pit-lagl) < TH and abs(lag_f[3] − lagl) < lagl*0.2)
    if (Rp > 0.5 && pgain_past > 0.7 and e_lsf < 0.5/30)
    LTP_mod e = 0;
else LTP_mod e = 1;
```

where Rp is current frame normalized pitch correlation, pgain_past is the quantized pitch gain from the fourth subframe of the past frame, TH=MIN(lag1*0.1, 5), and TH=MAX(2.0, TH).

The estimation of the precise pitch lag at the end of the frame is based on the normalized correlation:

$$R_p = \frac{\sum_{n=0}^{L} s_w(n+n1)s_w(n+n1-k)}{\sqrt{\sum_{n=0}^{L} s_w^2(n+n1-k)}}.$$

where $S_w(n+n1)$, n=0, 1, . . . , L−1, represents the last segment of the weighted speech signal including the look-ahead (the look-ahead length is 25 samples), and the size L is defined according to the open-loop pitch lag $T_{op}$ with the corresponding normalized correlation $C_{T_{op}}$:|

```
if(C_Top > 0.6)
    L = max{50, T_op}
    L = min{80, L}
else
    L = 80
```

In the first step, one integer lag k is selected maximizing the $R_k$ in the range $k\epsilon[T_{op}-10, T_{op}+10]$| bounded by [17, 145]. Then, the precise pitch lag $P_m$ and the corresponding index $I_m$ for the current frame is searched around the integer lag, [k−1, k+1], by up-sampling $R_k$.

The possible candidates of the precise pitch lag are obtained from the table named as PitLagTab8b[i], i=0, 1, . . . , 127. In the last step, the precise pitch lag $P_m$=PitLagTab8b[$I_m$] is possibly modified by checking the accumulated delay $\tau_{acc}$ due to the modification of the speech signal:

$$\text{if } (\tau_{acc} > 5) I_m \leftarrow \min\{I_m + 1, 127\},$$

and $$\text{if } (\tau_{acc} < -5) I_m \leftarrow \max\{I_m - 1, 0\}.$$

The precise pitch lag could be modified again:

$$\text{if } (\tau_{acc} > 10) I_m \leftarrow \min\{I_m + 1, 127\},$$

and $$\text{if } (\tau_{acc} < -10) I_m \leftarrow \max\{I_m - 1, 0\}.$$

The obtained index $I_m$ will be sent to the decoder.

The pitch lag contour, $\tau_c(n)$, is defined using both the current lag $P_m$ and the previous lag $P_{m-1}$:

```
if(|P_m − P_m−1| < 0.2 min{P_m, P_m−1})
    τ_c(n) = P_m−1 + n(P_m − P_m−1)/ L_f, n = 0, 1, ... , L_f − 1
    τ_c(n) = P_m, n = L_f, ... , 170
else
    τ_c(n) = P_m−1, n = 0, 1, ... , 39;
    τ_c(n) = P_m, n = 40, ... , 170
```

where $L_f$=160 is the frame size.

One frame is divided into 3 subframes for the long-term preprocessing. For the first two subframes, the subframe size, $L_s$, is 53, and the subframe size for searching, $L_{sr}$, is 70. For the last subframe, $L_s$ is 54 and $L_{sr}$ is:

$$L_{sr}=\min\{70, L_s+L_{khd}-10-\tau_{acc}\},$$

where $L_{khd}$=25 is the look-ahead and the maximum of the accumulated delay $\tau_{acc}$ is limited to 14.

The target for the modification process of the weighted speech temporally memorized in $\{\hat{s}_w(m0+n)$, n=0, 1, . . . , $L_{sr}-1\}$ is calculated by warping the past modified weighted speech buffer, $\hat{s}_w(m0+n)$, n<0, with the pitch lag contour, $\tau_c(n+m\cdot L_s)$, m=0, 1, 2, $$\hat{s}_w = (m0 + n) = \sum_{i=-f_t}^{f_t} \hat{s}_w(m0 + n - T_c(n) + i) I_s(i, T_{IC}(n)),$$

$$n = 0, 1, \ldots, L_{sr} - 1,$$

where $T_C(n)$ and $T_{IC}(n)$ are calculated by:

$$T_c(n) = \text{trunc}\{\tau_c(n + m \cdot L_s)\},$$

$$T_{IC}(n) = \tau_c(n) - T_C(n),$$

m is subframe number, $I_s(i, T_{IC}(n))$ is a set of interpolation coefficients, and $f_1$ is 10. Then, the target for matching, $\hat{s}_t(n)$, n=0, 1, . . . , $L_{sr}-1$, is calculated by weighting $$\hat{s}_w(m0+n),|$$

n=0, 1, . . . , $L_{sr}-1$, in the time domain:

$$\hat{s}_t(n) = n \cdot \hat{s}_w(m0+n)/L_s,$$

n=0, 1, . . . , $L_s-1$, $$\hat{s}_t(n) = \hat{s}_w(m0+n),$$

n=$L_s$, . . . , $L_{sr}-1$

The local integer shifting range [SR0, SR1] for searching for the best local delay is computed as the following:

```
if speech is unvoiced
    SR0=−1,
    SR1=1,
else
    SR0=round{−4 min{1.0, max{0.0 , 1−0.4 (P_sh−0.2)}}},
    SR1=round{4 min{1.0, max{0.0, 1−0.4 (P_sh−0.2)}}},
```

where $P_{sh}=\max\{P_{sh1}, P_{sh2}\}$, $P_{sh1}$ is the average to peak ratio (i.e., sharpness) from the target signal:

$$P_{sh1} = \frac{\sum_{n=0}^{L_{sr}-1} |\hat{s}_w(m0 + n)|}{L_{ss} \max\{|\hat{s}_w(m0 + n)|, n = 0, 1, \ldots, L_{sr} - 1\}}$$

and $P_{sh2}$ is the sharpness from the weighted speech signal:

$$P_{sh2} = \frac{\sum_{n=0}^{L_{sr}-L_s/2-1} |s_w(n + n0 + L_s/2)|}{(L_{sr} - L_s/2) \max\left\{ \begin{array}{c} |s_w(n + n0 + L_s/2)|, \\ n = 0, 1, \ldots, L_{sr} - L_s/2 - 1 \end{array} \right\}}$$

where n0=trunc$\{m0+\tau_{acc}+0.5\}$ (here, m is subframe number and $\tau_{acc}$ is the previous accumulated delay).

In order to find the best local delay, $\tau_{opt}$, at the end of the current processing subframe, a normalized correlation vector between the original weighted speech signal and the modified matching target is defined as:

$$R_l(k) = \frac{\sum_{n=0}^{L_{sr}-1} s_w(n0 + n + k) \hat{s}_t(n)}{\sqrt{\sum_{n=0}^{L-1} s_w^2(n0 + n + k) \sum_{n=0}^{L_{sr}-1} \hat{s}_t^2(n)}}$$

A best local delay in the integer domain, $k_{opt}$, is selected by maximizing $R_l(k)$ in the range of k∈[SR0,SR1], which is corresponding to the real delay:

$$k_r = k_{opt} + n0 - m0 - \tau_{acc}$$

If $R_l(k_{opt})<0.5$, $k_r$ is set to zero.

In order to get a more precise local delay in the range $\{k_r-0.75+0.1j, j=0, 1, \ldots 15\}$ around $k_r$, $R_l(k)$ is interpolated to obtain the fractional correlation vector, $R_f(j)$, by:

$$R_f(j) = \sum_{i=-7}^{8} R_l(k_{opt} + I_j + i) I_f(i, j), \; j = 0, 1, \ldots, 15,$$

where $\{I_f(i,j)\}$ is a set of interpolation coefficients. The optimal fractional delay index, $j_{opt}$, is selected by maximizing $R_f(j)$. Finally, the best local delay, $\tau_{opt}$, at the end of the current processing subframe, is given by, $$\tau_{opt} = k_r - 0.75 + 0.1 j_{opt}|$$

The local delay is then adjusted by:

$$\tau_{opt} = \begin{cases} 0, & \text{if } \tau_{acc} + \tau_{opt} > 14 \\ \tau_{opt}, & \text{otherwise} \end{cases}$$

The modified weighted speech of the current subframe, memorized in $\{\hat{s}_w(m0+n), n=0, 1, \ldots, L_s-1\}$ I to update the buffer and produce the second target signal 953 for searching the fixed codebook 961, is generated by warping the original weighted speech $\{s_w(n)\}$ from the original time region, $$[m0+\tau_{acc}, m0+\tau_{acc}+L_s+\tau_{opt}],$$

to the modified time region, $[m0, m0+L_s]$:

$$\hat{s}_w(m0 + n) = \sum_{i=-f_t+1}^{f_t} s_w(m0 + n + T_W(n) + i) I_s(i, T_{1W}(n)),$$

$$n = 0, 1, \ldots, L_s - 1,$$

where $T_W(n)$ and $T_{IW}(n)$ are calculated by:

$$T_W(n) = \text{trunc}\{\tau_{acc} + n \cdot \tau_{opt}/L_s\},$$

$$T_{IW}(n) = \tau_{acc} + n \cdot \tau_{opt}/L_s - T_W(n),$$

$\{I_s(i, T_{IW}(n))\}$ is a set of interpolation coefficients.

After having completed the modification of the weighted speech for the current subframe, the modified target weighted speech buffer is updated as follows:

$$\hat{s}_w(n) \Leftarrow \hat{s}_w(n+L_s),|$$

$$n=0,1, \ldots, n_m,-1.$$

The accumulated delay at the end of the current subframe is renewed by:

$$\tau_{acc} \Leftarrow \tau_{acc}+\tau_{opt}|$$

Prior to quantization the LSFs are smoothed in order to improve the perceptual quality. In principle, no smoothing is applied during speech and segments with rapid variations in the spectral envelope. During non-speech with slow variations in the spectral envelope, smoothing is applied to reduce unwanted spectral variations. Unwanted spectral variations could typically occur due to the estimation of the LPC parameters and LSF quantization. As an example, in stationary noise-like signals with constant spectral envelope introducing even very small variations in the spectral envelope is picked up easily by the human ear and perceived as an annoying modulation.

The smoothing of the LSFs is done as a running mean according to:

$$\mathrm{lsf}_i(n)=\beta(n)\cdot\mathrm{lsf}_i(n-1)+(1-\beta(n))\cdot\mathrm{lsf_est}_i(n), i=1, \ldots, 10$$

where $\mathrm{lsf_est}_i(n)$ is the $i^{th}$ estimated LSF of frame n, and $\mathrm{lsf}_i(n)$ is the $i^{th}$ LSF for quantization of frame n. The parameter β(n) controls the amount of smoothing, e.g. if β(n) is zero no smoothing is applied.

β(n) is calculated from the VAD information (generated at the block 935) and two estimates of the evolution of the spectral envelope. The two estimates of the evolution are defined as:

$$\Delta SP = \sum_{i=1}^{10} (\mathrm{lsf_est}_i(n) = \mathrm{lsf_est}_i(n-1))^2$$

$$\Delta SP_{int} = \sum_{i=1}^{10} (\mathrm{lsf_est}_i(n) - \mathrm{ma_lsf}_i(n-1))^2$$

$$\mathrm{ma_lsf}_i(n) = \beta(n)\cdot \mathrm{ma_lsf}_i(n-1) + (1-\beta(n))\cdot \mathrm{lsf_est}_i(n),$$

$$i = 1, \ldots, 10$$

The parameter β(n) is controlled by the following logic:

```
Step 1:
if (Vad = 1|PastVad = 1|k1 > 0.5)
   N_mode_frm (n − 1) = 0
   β(n) = 0.0
elseif (N_mode_frm (n − 1) > 0 & (ΔSP > 0.0015|ΔSP_int > 0.0024))
   N_mode_frm (n − 1) = 0
   β(n) = 0.0
elseif (N_mode_frm (n − 1) > 1 & ΔSP > 0.0025)
   N_mode_frm (n − 1) = 1
endif
Step 2:
if (Vad = 0 & PastVad = 0)
   N_mode_frm (n) = N_mode_frm (n −0 1) + 1
if (N_mode_frm (n) > 5)
      N_mode_frm (n) = 5
   endif

   β(n) = 0.9/16 · (N_mode_frm(n − 1)

else
   N_mode_frm (n) = N_mode_frm (n − 1)
endif
```

where $k_l$ is the first reflection coefficient.

In step 1, the encoder processing circuitry checks the VAD and the evolution of the spectral envelope, and performs a full or partial reset of the smoothing if required. In step 2, the encoder processing circuitry updates the counter, $N_{mode_frm}|(n)$, and calculates the smoothing parameter, β(n). The parameter β(n) varies between 0.0 and 0.9, being 0.0 for speech, music, tonal-like signals, and non-stationary background noise and ramping up towards 0.9 when stationary background noise occurs.

The LSFs are quantized once per 20 ms frame using a predictive multi-stage vector quantization. A minimal spacing of 50 Hz is ensured between each two neighboring LSFs before quantization. A set of weights is calculated from the LSFs, given by $w_i=K|P(f_i)|^{0.4}$ where $f_i$ is the $i^{th}$ LSF value and $P(f_i)$ is the LPC power spectrum at $f_i$ (K is an irrelevant multiplicative constant). The reciprocal of the power spectrum is obtained by (up to a multiplicative constant):

$$P(f_i)^{-1} \approx \begin{cases} (1-\cos(2\pi f_i)\prod_{odd\ j}[\cos(2\pi f_i)-\cos(2\pi f_j)]^2 & \text{even } i \\ (1+\cos(2\pi f_i)\prod_{even\ j}[\cos(2\pi f_i)-\cos(2\pi f_i)]^2 & \text{odd } i \end{cases}$$

and the power of −0.4 is then calculated using a lookup table and cubic-spline interpolation between table entries.

A vector of mean values is subtracted from the LSFs, and a vector of prediction error vector fe is calculated from the mean removed LSFs vector, using a full-matrix AR(2) predictor. A single predictor is used for the rates 5.8, 6.65, 8.0, and 11.0 kbps coders, and two sets of prediction coefficients are tested as possible predictors for the 4.55 kbps coder.

The vector of prediction error is quantized using a multi-stage VQ, with multi-surviving candidates from each stage to the next stage. The two possible sets of prediction error vectors generated for the 4.55 kbps coder are considered as surviving candidates for the first stage.

The first 4 stages have 64 entries each, and the fifth and last table have 16 entries. The first 3 stages are used for the 4.55 kbps coder, the first 4 stages are used for the 5.8, 6.65 and 8.0 kbps coders, and all 5 stages are used for the 11.0 kbps coder. The following table summarizes the number of bits used for the quantization of the LSFs for each rate.

| | prediction | $1^{st}$ stage | $2^{nd}$ stage | $3^{rd}$ stage | $4^{th}$ stage | $5^{th}$ stage | total |
|---|---|---|---|---|---|---|---|
| 4.55 kbps | 1 | 6 | 6 | 6 | | | 19 |
| 5.8 kbps | 0 | 6 | 6 | 6 | 6 | | 24 |
| 6.65 kbps | 0 | 6 | 6 | 6 | 6 | | 24 |
| 8.0 kbps | 0 | 6 | 6 | 6 | 6 | | 24 |
| 11.0 kbps | 0 | 6 | 6 | 6 | 6 | 4 | 28 |

The number of surviving candidates for each stage is summarized in the following table.

| | prediction candidates into the $1^{st}$ stage | surviving candidates from the $1^{st}$ stage | surviving candidates from the $2^{nd}$ stage | surviving candidates from the $3^{rd}$ stage | surviving candidates from the $4^{th}$ stage |
|---|---|---|---|---|---|
| 4.55 kbps | 2 | 10 | 6 | 4 | |
| 5.8 kbps | 1 | 8 | 6 | 4 | |
| 6.65 kbps | 1 | 8 | 8 | 4 | |
| 8.0 kbps | 1 | 8 | 8 | 4 | |
| 11.0 kbps | 1 | 8 | 6 | 4 | 4 |

The quantization in each stage is done by minimizing the weighted distortion measure given by:

$$\varepsilon_k = \sum_{i=0}^{9} (w_i(fe_i - C_i^k))^2.$$

The code vector with index $k_{min}$ which minimizes $\epsilon_k$ such that $\epsilon_{k_{min}} < \epsilon_k$ for all k, is chosen to represent the prediction/quantization error (fe represents in this equation both the initial prediction error to the first stage and the successive quantization error from each stage to the next one).

The final choice of vectors from all of the surviving candidates (and for the 4.55 kbps coder—also the predictor) is done at the end, after the last stage is searched, by choosing a combined set of vectors (and predictor) which minimizes the total error. The contribution from all of the stages is summed to form the quantized prediction error vector, and the quantized prediction error is added to the prediction states and the mean LSFs value to generate the quantized LSFs vector.

For the 4.55 kbps coder, the number of order flips of the LSFs as the result of the quantization is counted, and if the number of flips is more than 1, the LSFs vector is replaced with 0.9·(LSFs of previous frame)+0.1·(mean LSFs value). For all the rates, the quantized LSFs are ordered and spaced with a minimal spacing of 50 Hz.

The interpolation of the quantized LSF is performed in the cosine domain in two ways depending on the LTP_mode. If the LTP_mode is 0, a linear interpolation between the quantized LSF set of the current frame and the quantized LSF set of the previous frame is performed to get the LSF set for the first, second and third subframes as:

$$\bar{q}_1(n)=0.75\bar{q}_4(n-1)+0.25\bar{q}_4(n)$$

$$\bar{q}_2(n)=0.5\bar{q}_4(n-1)+0.5\bar{q}_4(n)$$

$$\bar{q}_3(n)=0.25\bar{q}_4(n-1)+0.75\bar{q}_4(n)$$

where $q_4(n-1)$ and $q_4(n)$ are the cosines of the quantized LSF sets of the previous and current frames, respectively, and $q_1(n)$, $q_2(n)$ and $q_3(n)$ are the interpolated LSF sets in cosine domain for the first, second and third subframes respectively.

If the LTP_mode is 1, a search of the best interpolation path is performed in order to get the interpolated LSF sets. The search is based on a weighted mean absolute difference between a reference LSF set rl(n) and the LSF set obtained from LP analysis_2 l(n). The weights w are computed as follows:

$$w(0)=(1-l(0))(1-l(1)+l(0))$$

$$w(9)=(1-l(9))(1-l(9)+l(8))$$

for i=1 to 9

$$w(i)=(1-l(l))(1-\mathrm{Min}(l(l+1)-l(l)l(l)-l(i-1)))$$

where Min(a,b) returns the smallest of a and b.

There are four different interpolation paths. For each path, a reference LSF set rq(n) in cosine domain is obtained as follows:

$$r\bar{q}(n)=\alpha(k)\bar{q}_4(n)+(1-\alpha(k))\bar{q}_s(n-1), k=1 \text{ to } 4|$$

$\alpha$=={0.4, 0.5, 0.6, 0.7} for each path respectively. Then the following distance measure is computed for each path as:

$$D=|rt(n)-l(n)|'\bar{w}|$$

The path leading to the minimum distance D is chosen and the corresponding reference LSF set rq(n) is obtained as:

$$r\bar{q}(n)=\alpha_{app}\bar{q}_4(n)+(1-\alpha_{app})\bar{q}_4(n-1)$$

The interpolated LSF sets in the cosine domain are then given by:

$$\bar{q}_1(n)=0.5\bar{q}_4(n-1)+0.5r\bar{q}(n)$$

$$\bar{q}_2(n)=r\bar{q}(n)$$

$$\bar{q}_3(n)=0.5r\bar{q}(n)+0.5\bar{q}_s(n)$$

The impulse response, h(n), of the weighted synthesis filter $H(z)W(z)=A(z/\gamma_1)/[A(z)A(z/\gamma_2)]$ is computed each subframe. This impulse response is needed for the search of adaptive and fixed codebooks 957 and 961. The impulse response h(n) is computed by filtering the vector of coefficients of the filter $A(z/\gamma_1)$ extended by zeros through the two filters $1/A(z)$ and $1/A(z/\gamma_2)$.

The target signal for the search of the adaptive codebook 957 is usually computed by subtracting the zero input response of the weighted synthesis filter H(z)W(z) from the weighted speech signal $s_w(n)$. This operation is performed on a frame basis. An equivalent procedure for computing the target signal is the filtering of the LP residual signal r(n) through the combination of the synthesis filter 1/A(z) and the weighting filter W(z).

After determining the excitation for the subframe, the initial states of these filters are updated by filtering the difference between the LP residual and the excitation. The LP residual is given by:

$$r(n) = s(n) + \sum_{i=1}^{10} \bar{a}_i s(n-1),\ n = 0, \text{L_SF} - 1$$

The residual signal r(n) which is needed for finding the target vector is also used in the adaptive codebook search to extend the past excitation buffer. This simplifies the adaptive codebook search procedure for delays less than the subframe size of 40 samples.

In the present embodiment, there are two ways to produce an LTP contribution. One uses pitch preprocessing (PP) when the PP-mode is selected, and another is computed like the traditional LTP when the LTP-mode is chosen. With the PP-mode, there is no need to do the adaptive codebook search, and LTP excitation is directly computed according to past synthesized excitation because the interpolated pitch contour is set for each frame. When the AMR coder operates with LTP-mode, the pitch lag is constant within one subframe, and searched and coded on a subframe basis.

Suppose the past synthesized excitation is memorized in {ext(MAX_LAG+n), n<0}, which is also called adaptive codebook. The LTP excitation codevector, temporally memorized in {ext(MAX_LAG+n), 0<=n<L_SF}, is calculated by interpolating the past excitation (adaptive codebook) with the pitch lag contour, $\tau_c$ (n+m·L_SF), m=0, 1, 2, 3. The interpolation is performed using an FIR filter (Hamming windowed sinc functions):

$$ext(MAX_LAG+n)=\sum_{i=-f_t}^{f_t} ext\begin{pmatrix}\text{MAX_LAG}+\\ n-T_c(n)+1\end{pmatrix}\cdot I_s(i,T_{IC}(n)),$$

$$n=0,1,\ldots,\text{L_SF}-1,\ldots$$

where $T_C(n)$ and $T_{IC}(n)$ are calculated by $$T_c(n)=\text{trunc}\{\tau_c(n+m\cdot L_SF)\},$$

$$T_{IC}(n)=\tau_c(n)-T_C(n),$$

m is subframe number, $\{Is(i,T_{IC}(n))\}$ is a set of interpolation coefficients, $f_1$ is 10, MAX_LAG is 145+11, and L_SF=40 is the subframe size. Note that the interpolated values {ext (MAX_LAG+n), 0<=n<L_SF-1 7+11} might be used again to do the interpolation when the pitch lag is small. Once the interpolation is finished, the adaptive codevector Va={$\upsilon_a$(n), n=0 to 39} is obtained by copying the interpolated values:

$$v_a(n)=\text{ext}(\text{MAX_LAG}+n),0<=n<L_SF|$$

Adaptive codebook searching is performed on a subframe basis. It consists of performing closed-loop pitch lag search, and then computing the adaptive code vector by interpolating the past excitation at the selected fractional pitch lag. The LTP parameters (or the adaptive codebook parameters) are the pitch lag (or the delay) and gain of the pitch filter. In the search stage, the excitation is extended by the LP residual to simplify the closed-loop search.

For the bit rate of 11.0 kbps, the pitch delay is encoded with 9 bits for the $1^{st}$ and $3^{rd}$ subframes and the relative delay of the other subframes is encoded with 6 bits. A fractional pitch delay is used in the first and third subframes with resolutions:

⅙ in the range $$\left[17,93\frac{4}{6}\right],$$

and integers only in the range [95,145]. For the second and fourth subframes, a pitch resolution of ⅙ is always used for the rate 11.0 kbps in the ranges $$\left[T_1-5\frac{3}{6},T_1+4\frac{3}{6}\right],$$

where $T_1$ is the pitch lag of the previous ($1^{st}$ or $3^{rd}$) subframe.

The close-loop pitch search is performed by minimizing the mean-square weighted error between the original and synthesized speech. This is achieved by maximizing the term:

$$R(k)=\frac{\sum_{n=0}^{39} T_{gs}(n)y_k(n)}{\sqrt{\sum_{n=0}^{39} y_k(n)y_k(n)}},$$

where $T_{gs}(n)$ is the target signal and $y_k(n)$ is the past filtered excitation at delay k (past excitation convoluted with h(n)). The convolution $y_k(n)$ is computed for the first delay $t_{min}$ in the search range, and for the other delays in the search range $k=t_{min}+1,\ldots,t_{max}$, it is updated using the recursive relation:

$$y_k(n)=y_{k-1}(n-1)+u(-)k(n):$$

where u(n),n=−(143+11) to 39 is the excitation buffer.

Note that in the search stage, the samples u(n),n=0 to 39, are not available and are needed for pitch delays less than 40. To simplify the search, the LP residual is copied to u(n) to make the relation in the calculations valid for all delays. Once the optimum integer pitch delay is determined, the fractions, as defined above, around that integer are tested. The fractional pitch search is performed by interpolating the normalized correlation and searching for its maximum.

Once the fractional pitch lag is determined, the adaptive codebook vector, $\upsilon$(n), is computed by interpolating the past excitation u(n) at the given phase (fraction). The interpolations are performed using two FIR filters (Hamming windowed sinc functions), one for interpolating the term in the calculations to find the fractional pitch lag and the other for interpolating the past excitation as previously described. The adaptive codebook gain, $g_p$, is temporally given then by:

$$g_p=\frac{\sum_{n=0}^{39} T_{gs}(n)y(n)}{\sum_{n=0}^{39} y(n)y(n)},$$

bounded by $0<g_p<1.2$, where y(n)=$\upsilon$(n)*h(n) is the filtered adaptive codebook vector (zero state response of H(z)W(z) to $\upsilon$(n)). The adaptive codebook gain could be modified again due to joint optimization of the gains, gain normalization and smoothing. The term y(n) is also referred to herein as $C_p(n)$.

With conventional approaches, pitch lag maximizing correlation might result in two or more times the correct one. Thus, with such conventional approaches, the candidate of shorter pitch lag is favored by weighting the correlations of different candidates with constant weighting coefficients. At times this approach does not correct the double or treble pitch lag because the weighting coefficients are not aggressive enough or could result in halving the pitch lag due to the strong weighting coefficients.

In the present embodiment, these weighting coefficients become adaptive by checking if the present candidate is in the neighborhood of the previous pitch lags (when the previous frames are voiced) and if the candidate of shorter lag is in the neighborhood of the value obtained by dividing the longer lag (which maximizes the correlation) with an integer.

In order to improve the perceptual quality, a speech classifier is used to direct the searching procedure of the fixed codebook (as indicated by the blocks 975 and 979) and to control gain normalization (as indicated in the block 1101 of FIG. 11). The speech classifier serves to improve the background noise performance for the lower rate coders, and to get a quick start-up of the noise level estimation. The speech classifier distinguishes stationary noise-like segments from segments of speech, music, tonal-like signals, non-stationary noise, etc.

The speech classification is performed in two steps. An initial classification (speech_mode) is obtained based on the modified input signal. The final classification (exc_mode) is obtained from the initial classification and the residual signal after the pitch contribution has been removed. The two outputs from the speech classification are the excitation mode, exc_mode, and the parameter $\beta_{sub}$(n), used to control the subframe based smoothing of the gains.

The speech classification is used to direct the encoder according to the characteristics of the input signal and need not be transmitted to the decoder. Thus, the bit allocation, codebooks, and decoding remain the same regardless of the classification. The encoder emphasizes the perceptually important features of the input signal on a subframe basis by adapting the encoding in response to such features. It is important to notice that misclassification will not result in disastrous speech quality degradations. Thus, as opposed to the VAD 935, the speech classifier identified within the block 979 (FIG. 9) is designed to be somewhat more aggressive for optimal perceptual quality. The initial classifier (speech_classifier) has adaptive thresholds and is performed in six steps:

1. Adapt thresholds:
   if (updates_noise ≥ 30 & updates_speech ≥ 30)

$$SNR_max = \min\left(\frac{ma_max_speech}{ma_max_noise}, 32\right)$$

```
else
   SNR_max = 3.5
endif
if (SNR_max < 1.75)
   deci_max_mes = 1.30
   deci_ma_cp = 0.70
   update_max_mes = 1.10
   update_ma_cp_speech = 0.72
elseif (SNR_max < 2.50)
   deci_max_mes = 1.65
   deci_ma_cp = 0.73
   update_max_mes = 1.30
   update_ma_cp_speech = 0.72
else
   deci_max_mes = 1.75
   deci_ma_cp = 0.77
   update_max_mes = 1.30
   update_ma_cp_speech = 0.77
endif
```

2. Calculate parameters:
   Pitch correlation:

$$cp = \frac{\sum_{i=0}^{L_SF-1} \tilde{s}(i)\cdot\tilde{s}(i-lag)}{\sqrt{\left(\sum_{i=0}^{L_SF-1} \tilde{s}(i)\cdot\tilde{s}(i)\right)\cdot\left(\sum_{i=0}^{L_SF-1} \tilde{s}(i-lag)\cdot\tilde{s}(i-lag)\right)}}$$

Running mean of pitch correlation:
$ma_cp(n) = 0.9 \cdot ma_cp(n-1) + 0.1 \cdot cp$
Maximum of signal amplitude in current pitch cycle:
$max(n) = \max\{|\tilde{s}(i)|, i = start, \ldots, L_SF-1\}$
where:
$start = \min\{L_SF - lag, 0\}$
Sum of signal amplitudes in current pitch cycle:

$$mean(n) = \sum_{i=start}^{L_SF-1} |\tilde{s}(i)|$$

Measure of relative maximum:

$$max_mes = \frac{max(n)}{ma_max_noise(n-1)}$$

Maximum to long-term sum:

$$max2sum = \frac{max(n)}{\sum_{k=1}^{14} mean(n-k)}$$

-continued

Maximum in groups of 3 subframes for past 15 subframes:
$max_group(n, k) = \max\{\max(n - 3\cdot(4-k) - j), j = 0, \ldots, 2\}, k = 0, \ldots, 4$
Group-maximum to minimum of previous 4 group-maxima:

$$endmax2minmax = \frac{max_group(n, 4)}{\min\{max_group(n, k), k = 0, \ldots, 3\}}$$

Slope of 5 group maxima:

$$slope = 0.1 \cdot \sum_{k=0}^{4} (k-2)\cdot max_group(n, k)$$

3. Classify subframe:
```
if (((max_mes < deci_max_mes & ma_cp < deci_ma_cp)|VAD = 0)) &
      (LTP_MODE = 1|5.8kbit/s|14.55kbit/s))
      speech_mode = 0/* class1 */
else
      speech_mode = 1/* class2 */
endif
```
4. Check for change in background noise level, i.e. reset required:
```
      Check for decrease in level:
      if (updates_noise = 31 & max_mes <= 0.30)
         if (consec_low < 15)
           consec_low++
         endif
      else
         consec_low = 0
      endif
      if (consec_low = 15)
         updates_noise = 0
         lev_reset = −1 /* low level reset */
      endif
      Check for increase in level:
      if ((updates_noise >= 30 | lev_reset = −1) & max_mes >
         1.5 & ma_cp < 0.70 & cp < 0.85 & k1 < −0.4 &
         endmax2minmax < 50 & max2sum < 35 & slope > −100 &
         slope < 120)
           consec_high++
         endif
      else
         consec_high = 0
      endif
      if (consec_high = 15 & endmax2minmax < 6 &
      max2sum < 5))
         updates_moise = 30
         lev_reset = 1 /* high level reset */
      endif
```
5. Update running mean of maximum of class 1 segments, i.e. stationary noise:
```
if (
      / *1. condition:regular update */
      (max_mes < update_max_mes & ma_cp < 0.6 & cp < 0.65 &
      max_mes > 0.3) |
      / *2.condition:VAD continued update */
      (consec_vad_0 = 8)|
      / *3.condition:start − up/reset update */
      (updates_noise ≤ 30 & ma_cp < 0.7 & cp < 0.75 & k1 < −0.4 &
      endmax2minmax < 5 & (lev_reset ≠ 1|(lev_reset = −1 &
      max_mes < 2)))
)
      ma_max_noise(n) = 0.9 · ma_max_noise(n − 1) + 0.1 · max(n)
      if (updates_noise ≤ 30)
         updates_noise ++
      else
         lev_reset = 0
      endif
.
.
.
```
where $k_1$ is the first reflection coefficient.

6. Update running mean of maximum of class 2 segments, i.e. speech, music, tonal-like signals, non-stationary noise, etc, continued from above:
.
.

-continued

```
.
elseif (ma_cp > update_ma_cp_speech)
    if (updates_speech ≤ 80)
      α_speech = 0.95
    else
      α_speech = 0.999
    endif
    ma_max_speech(n) = α_speech · ma_max_speech(n − 1) +
    (1 − α_speech) · max(n)
    if (updats_speech ≤ 80)
      update_speech ++
endif
```

The final classifier (exc_preselect) provides the final class, exc_mode, and the subframe based smoothing parameter, $\beta_{sub}(n)$. It has three steps:

```
1.  Calculate paramters:
      Maximum amplitude of ideal excitation in current subframe:
      max_res2 (n) = max {|res2(i)|, i = 0, . . . , L_SF − 1}
      Measure of relative maximum:

      max_mes_res2 = max_res2 (n) / ma_max_res2(n − 1)

2.  Classify subframe and calculate smoothing:
      if (speech_mode = 1|max_mes_res2 ≥ 1.75)
          exc_mode = 1 /*class 2*/
          β_sub (n) = 0
          N_mode_sub(n) = −4
      else
          exc_mode = 0 /*class 1*/
          N_mode_sub(n) = N_mode_sub(n − 1) + 1
          if (N_mode_sub(n) > 4)
            N_mode_sub(n) = 4
          endif
          if (N_mode_sub(n) > 0)

          β_sub(n) = 0.7/9 · (N_mode_sub(n) − 1)^2

          else
            β_sub (n) = 0
          endif
      endif
3.  Update running mean of maximum:
      if(max_mes_res2 ≤ 0.5)
          if(consec < 51)
            consec ++
          endif
      else
          consec = 0
      endif
      if((exc_mode = 0 & (max_mes_res2 > 0.5|consec > 50))|
          (updates ≤ 30 & ma_cp < 0.6 & cp < 0.65))
          ma_max(n) = 0.9 · ma_max(n − 1) + 0.1 · max_res2(n)
          if(updates ≤ 30)
          updates ++
      endif
endif
```

When this process is completed, the final subframe based classification, exc_mode, and the smoothing parameter, $\beta_{sub}(n)$, are available.

To enhance the quality of the search of the fixed codebook 961, the target signal, $T_g(n)$, is produced by temporally reducing the LTP contribution with a gain factor, $G_r$:

$$T_g(n)=T_{gs}(n)-G_r*g_p*Y_a(n), n=0,1,\ldots,39$$

where $T_{gs}(n)$ is the original target signal 953, $Y_a(n)$ is the filtered signal from the adaptive codebook, $g_p$ is the LTP gain for the selected adaptive codebook vector, and the gain factor is determined according to the normalized LTP gain, $R_p$, and the bit rate:

```
if (rate<=0)/*for 4.45 kbps and 5.8 kbps*/
    G_r=0.7 R_p+0.3;
if (rate==1)/*for 6.65 kbps*/
    G_r=0.6 R_p+0.4;
if (rate==2)/*for 8.0 kbps*/
    G_r=0.3 R_p+0.7;
if (rate==3)/*for 11.0 kbps*/
    G_r=0.95;
if (T_op>L_SF & g_p>0.5 & rate<=2)
    G_r<=G_r(0.3 R_p + 0.7);
```

where normalized LTP gain, $R_p$, is defined as:

$$R_p = \frac{\sum_{n=0}^{39} T_{gs}(n)y_a(n)}{\sqrt{\sum_{n=0}^{39} T_{gs}(n)T_{gs}(n)}\sqrt{\sum_{n=0}^{39} y_o(n)y_o(n)}}$$

Another factor considered at the control block 975 in conducting the fixed codebook search and at the block 1101 (FIG. 11) during gain normalization is the noise level +“)” which is given by:

$$P_{NSR} = \sqrt{\frac{\max\{(E_n - 100), 0.0\}}{E_s}}$$

where $E_s$ is the energy of the current input signal including background noise, and $E_n$ is a running average energy of the background noise. $E_n$ is updated only when the input signal is detected to be background noise as follows:

```
if (first background noise frame is true)
    E_n=0.75 E_s;
else if (background noise frame is true)
    E_n=0.75 E_n_m+0.25 E_s;
```

where $E_{n_m}$ is the last estimation of the background noise energy.

For each bit rate mode, the fixed codebook 961 (FIG. 9) consists of two or more subcodebooks which are constructed with different structure. For example, in the present embodiment at higher rates, all the subcodebooks only contain pulses. At lower bit rates, one of the subcodebooks is populated with Gaussian noise. For the lower bit-rates (e.g., 6.65, 5.8, 4.55 kbps), the speech classifier forces the encoder to choose from the Gaussian subcodebook in case of stationary noise-like subframes, exc_mode=0. For exc_mode=1 all subcodebooks are searched using adaptive weighting.

For the pulse subcodebooks, a fast searching approach is used to choose a subcodebook and select the code word for the current subframe. The same searching routine is used for all the bit rate modes with different input parameters.

In particular, the long-term enhancement filter, $F_p(z)$, is used to filter through the selected pulse excitation. The filter is defined as $F_p(z)=1/(1-\beta z^{-T})$, where T is the integer part of pitch lag at the center of the current subframe, and $\beta$ is the pitch gain of previous subframe, bounded by [0.2, 1.0]. Prior to the codebook search, the impulsive response h(n) includes the filter $F_p(z)$.

For the Gaussian subcodebooks, a special structure is used in order to bring down the storage requirement and the computational complexity. Furthermore, no pitch enhancement is applied to the Gaussian subcodebooks.

There are two kinds of pulse subcodebooks in the present AMR coder embodiment. All pulses have the amplitudes of +1 or −1. Each pulse has 0, 1, 2, 3 or 4 bits to code the pulse position. The signs of some pulses are transmitted to the decoder with one bit coding one sign. The signs of other pulses are determined in a way related to the coded signs and their pulse positions.

In the first kind of pulse subcodebook, each pulse has 3 or 4 bits to code the pulse position. The possible locations of individual pulses are defined by two basic non-regular tracks and initial phases:

$$POS(n_p,i)=TRACK(m_p,i)+PHAS(n_p,phas_mode),$$

where i=0, 1, . . . , 7 or 15 (corresponding to 3 or 4 bits to code the position), is the possible position index, $n_p=0, \ldots, N_p-1$ ($N_p$ is the total number of pulses), distinguishes different pulses, $m_p=0$ or 1, defines two tracks, and phase_mode=0 or 1, specifies two phase modes.

For 3 bits to code the pulse position, the two basic tracks are:

{TRACK(0,i)}={0, 4, 8, 12, 18, 24, 30, 36}, and

{TRACK(1,i)}={0, 6, 12, 18, 22, 26, 30, 34}.

If the position of each pulse is coded with 4 bits, the basic tracks are:

{TRACK(0,i)}={0, 2, 4, 6, 8, 10, 12, 14, 17, 20, 23, 26, 29, 32, 35, 38}, and

{TRACK(1,i)}={0, 3, 6, 9, 12, 15, 18, 21, 23, 25, 27, 29, 31, 33, 35, 37}.

The initial phase of each pulse is fixed as:

$$PHAS(n_p, 0) = \text{modulus}(n_p / MAXPHAS)$$

$$PHAS(n_p, 1) = PHAS(N_p - 1 - n_p, 0)$$

where MAXPHAS is the maximum phase value.

For any pulse subcodebook, at least the first sign for the first pulse, $SIGN(n_p)$, $n_p=0$, is encoded because the gain sign is embedded. Suppose $N_{sign}$ is the number of pulses with encoded signs; that is, $SIGN(n_p)$, for $n_p<N_{sign}$, $<=N_p$, is encoded while $SIGN(n_p)$, for $n_p>=N_{sign}$, is not encoded. Generally, all the signs can be determined in the following way:

$$SIGN(n_p)=-SIGN(n_p-1), \text{ for } n_p>=N_{sign},$$

due to that the pulse positions are sequentially searched from $n_p=0$ to $n_p=N_p-1$ using an iteration approach. If two pulses are located in the same track while only the sign of the first pulse in the track is encoded, the sign of the second pulse depends on its position relative to the first pulse. If the position of the second pulse is smaller, then it has opposite sign, otherwise it has the same sign as the first pulse.

In the second kind of pulse subcodebook, the innovation vector contains 10 signed pulses. Each pulse has 0, 1, or 2 bits to code the pulse position. One subframe with the size of 40 samples is divided into 10 small segments with the length of 4 samples. 10 pulses are respectively located into 10 segments. Since the position of each pulse is limited into one segment, the possible locations for the pulse numbered with $n_p$ are, $\{4\ n_p\}$, $\{4\ n_p, 4\ n_p+2\}$, or $\{4\ n_p, 4\ n_p+1, 4\ n_p+2, 4\ n_p+3\}$, respectively for 0, 1, or 2 bits to code the pulse position. All the signs for all the 10 pulses are encoded.

The fixed codebook 961 is searched by minimizing the mean square error between the weighted input speech and the weighted synthesized speech. The target signal used for the LTP excitation is updated by subtracting the adaptive codebook contribution. That is:

$$x_2(n)=x(n)=g_p y(n), n=0, \ldots, 39,$$

where $y(n)=\upsilon(n)*h(n)$ is the filtered adaptive codebook vector and $g_p$ is the modified (reduced) LTP gain.

If $c_k$ is the code vector at index k from the fixed codebook, then the pulse codebook is searched by maximizing the term:

$$A_g = \frac{(C_k)^2}{E_{D_k}} = \frac{(d^t c_k)^2}{c_k^t \Phi c_k},$$

where $d=H^t x_2$ is the correlation between the target signal $x_2(n)$ and the impulse response h(n), H is a the lower triangular Toepliz convolution matrix with diagonal h(0) and lower diagonals h(1), . . . , h(39), and $\Phi=H_t H$ is the matrix of correlations of h(n). The vector d (backward filtered target) and the matrix Φ are computed prior to the codebook search. The elements of the vector d are computed by:

$$d(n) = \sum_{i=n}^{39} x_2(i)h(i-n), n = 0, \ldots, 39,$$

and the elements of the symmetric matrix Φ are computed by:

$$\phi(i, j) = \sum_{n=j}^{39} h(n-i)h(n-j), (j \geq i).$$

The correlation in the numerator is given by:

$$C = \sum_{i=0}^{N_p-1} \vartheta_k d(m_i),$$

where $m_i$ is the position of the i th pulse and $\upsilon_i$ is its amplitude. For the complexity reason, all the amplitudes $\{\upsilon_i\}$ are set to +1 or −1; that is, $$\upsilon_i=SIGN(i), i=n_p=0, \ldots, N_p-1.$$

The energy in the denominator is given by:

$$E_D = \sum_{i=0}^{N_p-1} \Phi(m_i, m_i) + 2 \sum_{i=0}^{N_p-2} \sum_{j=i+0}^{N_p-1} d_i \vartheta_j \phi(m_j, m_j).$$

To simplify the search procedure, the pulse signs are preset by using the signal b(n), which is a weighted sum of the normalized d(n) vector and the normalized target signal of $x_2(n)$ in the residual domain $res_2(n)$:

$$b(n) = \frac{res_2(n)}{\sqrt{\sum_{i=0}^{39} res_2(i)res_2(i)}} + \frac{2d(n)}{\sqrt{\sum_{i=0}^{39} d(i)d(i)}}, n = 0, 1, \ldots, 39$$

If the sign of the i th ($i=n_p$) pulse located at $mi_i$ is encoded, it is set to the sign of signal b(n) at that position, i.e., SIGN(i) =sign[b($m_i$)].

In the present embodiment, the fixed codebook 961 has 2 or 3 subcodebooks for each of the encoding bit rates. Of course many more might be used in other embodiments. Even with several subcodebooks, however, the searching of the fixed codebook 961 is very fast using the following procedure. In a first searching turn, the encoder processing circuitry searches the pulse positions sequentially from the first pulse ($n_p=0$) to the last pulse ($n_p=N_p-1$) by considering the influence of all the existing pulses.

In a second searching turn, the encoder processing circuitry corrects each pulse position sequentially from the first pulse to the last pulse by checking the criterion value $A_k$ contributed from all the pulses for all possible locations of the current pulse. In a third turn, the functionality of the second searching turn is repeated a final time. Of course further turns may be utilized if the added complexity is not prohibitive.

The above searching approach proves very efficient, because only one position of one pulse is changed leading to changes in only one term in the criterion numerator C and few terms in the criterion denominator $E_D$ for each computation of the $A_k$. As an example, suppose a pulse subcodebook is constructed with 4 pulses and 3 bits per pulse to encode the position. Only 96 (4 pulses×$2^3$ positions per pulse×3 turns=96) simplified computations of the criterion $A_k$ need be performed.

Moreover, to save the complexity, usually one of the subcodebooks in the fixed codebook 961 is chosen after finishing the first searching turn. Further searching turns are done only with the chosen subcodebook. In other embodiments, one of the subcodebooks might be chosen only after the second searching turn or thereafter should processing resources so permit.

The Gaussian codebook is structured to reduce the storage requirement and the computational complexity. A comb-structure with two basis vectors is used. In the comb-structure, the basis vectors are orthogonal, facilitating a low complexity search. In the AMR coder, the first basis vector occupies the even sample positions, (0, 2, . . . , 38), and the second basis vector occupies the odd sample positions, (1, 3, . . . , 39).

The same codebook is used for both basis vectors, and the length of the codebook vectors is 20 samples (half the subframe size).

All rates (6.65, 5.8 and 4.55 kbps) use the same Gaussian codebook. The Gaussian codebook, $CB_{Gauss}$, has only 10 entries, and thus the storage requirement is 10·20=200 16-bit words. From the 10 entries, as many as 32 code vectors are generated. An index, $idx_\delta$, to one basis vector 22 populates the corresponding part of a code vector, $c_{idx_\delta}$,l, in the following way:

$$c_{idx_\delta}(2\cdot(i-\tau)+\delta) = CB_{Gauss}(l, i) i = \tau, \tau+1, \ldots, 19$$

$$c_{idx_\delta}(2\cdot(i+20-\tau)+\delta) = CB_{Gauss}(l, i) i = 0, 1, \ldots, \tau-1$$

where the table entry, 1, and the shift, τ, are calculated from the index, $idx_\delta$, according to:

$$\tau = \text{trunc}\{idx_\delta/10\}$$

$$l = idx_\delta - 10\cdot\tau$$

and δ is 0 for the first basis vector and 1 for the second basis vector. In addition, a sign is applied to each basis vector.

Basically, each entry in the Gaussian table can produce as many as 20 unique vectors, all with the same energy due to the circular shift. The 10 entries are all normalized to have identical energy of 0.5, i.e., $$\sum_{i=0}^{19} (CB_{Gauss}(l, i))^2 = 0.5, l = 0, 1, \ldots, 9$$

That means that when both basis vectors have been selected, the combined code vector, $c_{idx_0, idx_1}$, will have unity energy, and thus the final excitation vector from the Gaussian subcodebook will have unity energy since no pitch enhancement is applied to candidate vectors from the Gaussian subcodebook.

The search of the Gaussian codebook utilizes the structure of the codebook to facilitate a low complexity search. Initially, the candidates for the two basis vectors are searched independently based on the ideal excitation, $res_2$. For each basis vector, the two best candidates, along with the respective signs, are found according to the mean squared error. This is exemplified by the equations to find the best candidate, index $idx_\delta$, and its sign, $s_{idx_\delta}$:|

$$idx_\delta = \max_{k=0,1,\ldots N_{Gauss}} \left\{ \left| \sum_{i=0}^{19} res_2(2\cdot i+\delta)\cdot c_k(2\cdot i+\delta) \right| \right\}$$

$$s_{idx_\delta} = \text{sign}\left( \sum_{i=0}^{19} res_2(2\cdot i+\delta)\cdot c_{k_0,k_1}(2\cdot i+\delta) \right)$$

where $N_{Gauss}$ is the number of candidate entries for the basis vector. The remaining parameters are explained above. The total number of entries in the Gaussian codebook is $2\cdot 2\cdot N_{Gauss}^2$. The fine search minimizes the error between the weighted speech and the weighted synthesized speech considering the possible combination of candidates for the two basis vectors from the pre-selection. If $c_{k_0k_1}$ is the Gaussian code vector from the candidate vectors represented by the indices $k_0$ 1 and $k_1$ and the respective signs for the two basis vectors, then the final Gaussian code vector is selected by maximizing the term:

$$A_{c_0k_1} = \frac{(C_{k_0,k_1})^2}{E_{D_{k_0k_1}}} = \frac{(d^t c_{k_0k_1})^2}{c_{k_0k_1}^t \Phi c_{k_0k_1}},$$

over the candidate vectors. $d=H^t x_2$ is the correlation between the target signal $x_2(n)$ and the impulse response h(n) (without the pitch enhancement), and H is a the lower triangular Toepliz convolution matrix with diagonal h(0) and lower diagonals h(1), . . . , h(39), and $\Phi=H^tH$ is the matrix of correlations of h(n).

More particularly, in the present embodiment, two subcodebooks are included (or utilized) in the fixed codebook 961 with 31 bits in the 11 kbps encoding mode. In the first subcodebook, the innovation vector contains 8 pulses. Each pulse has 3 bits to code the pulse position. The signs of 6 pulses are transmitted to the decoder with 6 bits. The second subcodebook contains innovation vectors comprising 10 pulses. Two bits for each pulse are assigned to code the pulse position which is limited in one of the 10 segments. Ten bits are spent for 10 signs of the 10 pulses. The bit allocation for the subcodebooks used in the fixed codebook 961 can be summarized as follows Subcodebook1: 8 pulses×3 bits/pulse+6 signs=30 bits Subcodebook2: 10 pulses×2 bits/pulse+10 signs=30 bits One of the two subcodebooks is chosen at the block 975 (FIG. 9) by favoring the second subcodebook using adaptive weighting applied when comparing the criterion value F1 from the first subcodebook to the criterion value F2 from the second subcodebook:

if ($W_c$·F1>F2), the first subcodebook is chosen, else, the second subcodebook is chosen, where the weighting, $0<W_c<=1$, is defined as:

$P_{NSR}$ is the background noise to speech signal ratio (i.e., the "noise level" in the block 979), $R_p$ is the normalized LTP gain, and $P_{Sharp}$ is the sharpness parameter of the ideal excitation $res_2(n)$ (i.e., the "sharpness" in the block 979).

In the 8 kbps mode, two subcodebooks are included in the fixed codebook 961 with 20 bits. In the first subcodebook, the innovation vector contains 4 pulses. Each pulse has 4 bits to code the pulse position. The signs of 3 pulses are transmitted to the decoder with 3 bits. The second subcodebook contains innovation vectors having 10 pulses. One bit for each of 9 pulses is assigned to code the pulse position which is limited in one of the 10 segments. Ten bits are spent for 10 signs of the 10 pulses. The bit allocation for the subcodebook can be summarized as the following:

Subcodebook1: 4 pulses×4 bits/pulse+3 signs=19 bits

Subcodebook2: 9 pulses×1 bits/pulse+1 pulse×0 bit+10 signs=19 bits

One of the two subcodebooks is chosen by favoring the second subcodebook using adaptive weighting applied when comparing the criterion value F1 from the first subcodebook to the criterion value F2 from the second subcodebook as in the 11 kbps mode. The weighting, $0<W_c<=1$, is defined as:

$$W_c=1.0-0.6P_{NSR}(1.0-05R_p)\cdot\min\{P_{sharp}+0.5,1.0\}.$$

The 6.65 kbps mode operates using the long-term preprocessing (PP) or the traditional LTP. A pulse subcodebook of 18 bits is used when in the PP-mode. A total of 13 bits are allocated for three subcodebooks when operating in the LTP-mode. The bit allocation for the subcodebooks can be summarized as follows:

PP-mode:

Subcodebook: 5 pulses×3 bits/pulse+3 signs=18 bits

LTP-mode:

Subcodebook1: 3 pulses×3 bits/pulse+3 signs=12 bits, phase_mode=1,

Subcodebook2: 3 pulses×3 bits/pulse+2 signs=11 bits, phase_mode=0,

Subcodebook3: Gaussian subcodebook of 11 bits.

One of the 3 subcodebooks is chosen by favoring the Gaussian subcodebook when searching with LTP-mode. Adaptive weighting is applied when comparing the criterion value from the two pulse subcodebooks to the criterion value from the Gaussian subcodebook. The weighting, $0<W_c<=1$, is defined as:

$$W_c=1.0-0.9P_{NSR}(1.0-0.5R_p)\cdot\min\{P_{sharp}+0.5,1.0\},$$

if (noise-like unvoiced), $W_c \Leftarrow W_c\cdot(0.2\,R_p(1.0-P_{sharp})+0.8)$.

The 5.8 kbps encoding mode works only with the long-term preprocessing (PP). Total 14 bits are allocated for three subcodebooks. The bit allocation for the subcodebooks can be summarized as the following:

Subcodebook1: 4 pulses×3 bits/pulse+1 signs=13 bits, phase_mode=1,

Subcodebook2: 3 pulses×3 bits/pulse+3 signs=12 bits, phase_mode=0,

Subcodebook3: Gaussian subcodebook of 12 bits.

One of the 3 subcodebooks is chosen favoring the Gaussian subcodebook with adaptive weighting applied when comparing the criterion value from the two pulse subcodebooks to the criterion value from the Gaussian subcodebook. The weighting, $0<W_c<=1$, is defined as:

$$W_c = 1.0 - P_{NSR}(1.0 - 0.5R_p)\cdot\min\{P_{sharp} + 0.6,\ 1.0\},$$

if (noise-like unvoiced), $$W_c \Leftarrow W_c\cdot(0.3R_p(1.0 - P_{sharp}) + 0.7).$$

The 4.55 kbps bit rate mode works only with the long-term preprocessing (PP). Total 10 bits are allocated for three subcodebooks. The bit allocation for the subcodebooks can be summarized as the following:

Subcodebook1: 2 pulses×4 bits/pulse+1 signs=9 bits, phase_mode=1,

Subcodebook2: 2 pulses×3 bits/pulse+2 signs=8 bits, phase_mode=0,

Subcodebook3: Gaussian subcodebook of 8 bits.

One of the 3 subcodebooks is chosen by favoring the Gaussian subcodebook with weighting applied when comparing the criterion value from the two pulse subcodebooks to the criterion value from the Gaussian subcodebook. The weighting, $0<W_c<=1$, is defined as:

$$W_c=1.0-1.2P_{NSR}(1.0-0.5R_c)\cdot\min\{P_{sharp}+0.6,1.0\},$$

if (noise-like unvoiced), $W_c \Leftarrow W_c\cdot(0.6\,R_c(1.0-P_{sharp})+0.4)$.

For 4.55, 5.8, 6.65 and 8.0 kbps bit rate encoding modes, a gain re-optimization procedure is performed to jointly optimize the adaptive and fixed codebook gains, $g_p$ and $g_c$, respectively, as indicated in FIG. 3. The optimal gains are obtained from the following correlations given by:

$$g_p = \frac{R_1R_2 - R_3R_4}{R_3R_2 - R_3R_3}$$

$$g_c = \frac{R_4 - g_pR_3}{R_2}.$$

where $R_1=\langle C_p,T_{gs}\rangle$, $R_2=\langle C_c,C_c\rangle$, $R_3=\langle C_p,C_c\rangle$, $R4=\langle C_c,T_{gs}\rangle$, and $R_5=\langle C_pC_p\rangle C_c,C_p$, and $T_{gs}$ are filtered fixed codebook excitation, filtered adaptive codebook excitation and the target signal for the adaptive codebook search.

For 11 kbps bit rate encoding, the adaptive codebook gain, $g_p$, remains the same as that computed in the closeloop pitch search. The fixed codebook gain, $g_c$, is obtained as:

$$g_c = \frac{R_{\hat{c}}}{R_2}.$$

where $R_6=\langle C_c,T_g\rangle$ and $T_g=T_{gs}-g_pC_p$.

Original CELP algorithm is based on the concept of analysis by synthesis (waveform matching). At low bit rate or when coding noisy speech, the waveform matching becomes difficult so that the gains are up-down, frequently resulting in unnatural sounds. To compensate for this problem, the gains obtained in the analysis by synthesis close-loop sometimes need to be modified or normalized.

There are two basic gain normalization approaches. One is called open-loop approach which normalizes the energy of the synthesized excitation to the energy of the unquantized residual signal. Another one is close-loop approach with which the normalization is done considering the perceptual weighting. The gain normalization factor is a linear combination of the one from the close-loop approach and the one from the open-loop approach; the weighting coefficients used for the combination are controlled according to the LPC gain.

The decision to do the gain normalization is made if one of the following conditions is met: (a) the bit rate is 8.0 or 6.65 kbps, and noise-like unvoiced speech is true; (b) the noise level $P_{NSR}$ is larger than 0.5; (c) the bit rate is 6.65 kbps, and the noise level $P_{NSR}$ is larger than 0.2; and (d) the bit rate is 5.8 or 4.45 kbps.

The residual energy, $E_{res}$, and the target signal energy, $E_{Tgs}$, are defined respectively as:

$$E_{res} = \sum_{n=0}^{L_SF-1} res^2(n)$$

$$E_{Tg_s} = \sum_{n=0}^{L_SF-1} T_{gs}^2(n)$$

Then the smoothed open-loop energy and the smoothed closed-loop energy are evaluated by:

```
if(first subframe is true)
    Ol_Eg = E_res
else
    Ol_Eg ⇐ β_sub · Ol_Eg + (1 − β_sub)E_res
if(first subframe is true)
    Cl_Eg = E_Tgs
else
    Cl_Eg ⇐ β_sub · Cl_Eg + (1 − β_sub)E_Tgs
```

where $\beta_{sub}$ is the smoothing coefficient which is determined according to the classification. After having the reference energy, the open-loop gain normalization factor is calculated:

$$\text{ol_g} = \text{MIN}\left\{C_{ol}\sqrt{\frac{\text{Ol_Eg}}{\sum_{n=0}^{L_SF-1} r^2(n)}}, \frac{1.2}{g_p}\right\}$$

where $C_{ol}$ is 0.8 for the bit rate 11.0 kbps, for the other rates $C_{ol}$ is 0.7, and $\upsilon(n)$ is the excitation:

$$v(n)=v_a(n)g_p+v_c(n)g_c, n=0.1, \ldots, L_SF-1.$$

where $g_p$ and $g_c$ are unquantized gains. Similarly, the closed-loop gain normalization factor is:

$$\text{Cl_g} = \text{MIN}\left\{C_{cl}\sqrt{\frac{\text{Cl_Eg}}{\sum_{n=0}^{L_SF-1} y^2(n)}} \cdot \frac{1.2}{g_p}\right\}$$

where $C_{cl}$ is 0.9 for the bit rate 11.0 kbps, for the other rates $C_{cl}$ is 0.8, and y(n) is the filtered signal (y(n)=υ(n)*h(n)):

$$y(n)=y_2(n)g_p+y_c(n)g_c, n=0,1, \ldots L_SF-1.$$

The final gain normalization factor, $g_f$, is a combination of Cl_g and Ol_g, controlled in terms of an LPC gain parameter, $C_{LPC}$,

```
if(speech is true or the rate is 11 kbps)
    g_f=C_LPC Ol_g+(1−C_LPC)Cl_g
    g_f=MAX(1.0,g_f)
    g_f=MIN(g_f,1+C_LPC)
if (background noise is true and the rate is smaller than 11 kbps)
    g_f=1.2MIN{Cl_g,Ol_g}
```

where $C_{LPC}$ is defined as:

$$C_{LPC}=\text{MIN}\{sqrt(E_{res}/E_{Tgs})0.8\}0.8$$

Once the gain normalization factor is determined, the unquantized gains are modified:

$$g_p=g_p \cdot g_f$$

For 4.55, 5.8, 6.65 and 8.0 kbps bit rate encoding, the adaptive codebook gain and the fixed codebook gain are vector quantized using 6 bits for rate 4.55 kbps and 7 bits for the other rates. The gain codebook search is done by minimizing the mean squared weighted error, Err, between the original and reconstructed speech signals:

$$\text{Err}=\|\overline{T}_{Gs}-g_p\overline{C}_p-g_c\overline{C}_c\|^2.$$

For rate 11.0 kbps, scalar quantization is performed to quantize both the adaptive codebook gain, $g_p$, using 4 bits and the fixed codebook gain, $g_c$, using 5 bits each.

The fixed codebook gain, $g_c$, is obtained by MA prediction of the energy of the scaled fixed codebook excitation in the following manner. Let E(n) be the mean removed energy of the scaled fixed codebook excitation in (dB) at subframe n be given by:

$$E(n) = 10\log\left(\frac{1}{40}g_c^2\sum_{i=0}^{39} c^2(i)\right) - E.$$

where c(i) is the unscaled fixed codebook excitation, and E=30 dB is the mean energy of scaled fixed codebook excitation.

The predicted energy is given by:

$$\overline{E}(n) = \sum_{i=1}^{4} b_i\hat{R}(n-i)$$

where $[b_1b_2b_3b_4]$=[0.68 0.58 0.34 0.19] are the MA prediction coefficients and R(n) is the quantized prediction error at subframe n.

The predicted energy is used to compute a predicted fixed codebook gain $g_c$ (by substituting E(n) by E(n) and $g_c$ by $g_c$).

This is done as follows. First, the mean energy of the unscaled fixed codebook excitation is computed as:

$$E_i = 10\log\left(\frac{1}{40}\sum_{i=0}^{39} c^2(i)\right),$$

and then the predicted gain $g_c$ is obtained as:

$$g_c = 10^{(0.05(\overline{E}(n)+\overline{E}-E_i))}.$$

A correction factor between the gain, $g_c$, and the estimated one, $g_c$, is given by:

$$\gamma = g_c/g_c'.$$

It is also related to the prediction error as:

$$R(n) = E(n) - \overline{E}(n) - 20\log\gamma.$$

The codebook search for 4.55, 5.8, 6.65 and 8.0 kbps encoding bit rates consists of two steps. In the first step, a binary search of a single entry table representing the quantized prediction error is performed. In the second step, the index Index_1 of the optimum entry that is closest to the unquantized prediction error in mean square error sense is used to limit the search of the two-dimensional VQ table representing the adaptive codebook gain and the prediction error. Taking advantage of the particular arrangement and ordering of the VQ table, a fast search using few candidates around the entry pointed by Index_1 is performed. In fact, only about half of the VQ table entries are tested to lead to the optimum entry with Index_2. Only Index_2 is transmitted.

For 11.0 kbps bit rate encoding mode, a full search of both scalar gain codebooks are used to quantize $g_p$, and $g_c$. For $g_p$, the search is performed by minimizing the error Err=abs($g_p$−$g_p$). Whereas for $g_c$, the search is performed by minimizing the error $$\mathrm{Err} = \|T_{gs} - g_p C_p - g_c C_c\|^2.$$

An update of the states of the synthesis and weighting filters is needed in order to compute the target signal for the next subframe. After the two gains are quantized, the excitation signal, u(n), in the present subframe is computed as:

$$u(n) = \overline{g}_p v(n) + \overline{g}_c c(n), n = 0, 39,$$

where $g_p$ and $g_c$ are the quantized adaptive and fixed codebook gains respectively, υ(n) the adaptive codebook excitation (interpolated past excitation), and c(n) is the fixed codebook excitation. The state of the filters can be updated by filtering the signal r(n)-u(n) through the filters 1/A(z) and W(z) for the 40-sample subframe and saving the states of the filters. This would normally require 3 filterings.

A simpler approach which requires only one filtering is as follows. The local synthesized speech at the encoder, ŝ(n), is computed by filtering the excitation signal through 1/A(z). The output of the filter due to the input r(n)−u(n) is equivalent to e(n)=s(n)−ŝ(n), so the states of the synthesis filter 1/A(z) are given by e(n), n=0, 39. Updating the states of the filter W(z) can be done by filtering the error signal e(n) through this filter to find the perceptually weighted error $e_w$(n). However, the signal $e_w$(n) can be equivalently found by:

$$e_w(n) = T_{gs}(n) - \overline{g}_p C_p(n) - \overline{g}_c C_c(n).$$

The states of the weighting filter are updated by computing $e_w$(n) for n=30 to 39.

The function of the decoder consists of decoding the transmitted parameters (LP parameters, adaptive codebook vector and its gain, fixed codebook vector and its gain) and performing synthesis to obtain the reconstructed speech. The reconstructed speech is then postfiltered and upscaled.

The decoding process is performed in the following order. First, the LP filter parameters are encoded. The received indices of LSF quantization are used to reconstruct the quantized LSF vector. Interpolation is performed to obtain 4 interpolated LSF vectors (corresponding to 4 subframes). For each subframe, the interpolated LSF vector is converted to LP filter coefficient domain, $a_k$, which is used for synthesizing the reconstructed speech in the subframe.

For rates 4.55, 5.8 and 6.65 (during PP_mode) kbps bit rate encoding modes, the received pitch index is used to interpolate the pitch lag across the entire subframe. The following three steps are repeated for each subframe:

1) Decoding of the gains: for bit rates of 4.55, 5.8, 6.65 and 8.0 kbps, the received index is used to find the quantized adaptive codebook gain, $g_p$, from the 2-dimensional VQ table. The same index is used to get the fixed codebook gain correction factor γ from the same quantization table. The quantized fixed codebook gain, $g_c$, is obtained following these steps:

the predicted energy is computed $$\overline{E}(n) = \sum_{i=1}^{4} b_i \hat{R}(n-i);$$

the energy of the unscaled fixed codebook excitation is calculated as $$E_i = 10\log\left(\frac{1}{40}\sum_{i=0}^{39} c^2(i)\right);$$

and the predicted gain $g_c'$ is obtained as $g_c' = 10^{(0.05(E(n)+E-E_i))}$. The quantized fixed codebook gain is given as $g_c = \gamma g_c'$. For 11 kbps bit rate, the received adaptive codebook gain index is used to readily find the quantized adaptive gain, $g_p$ from the quantization table. The received fixed codebook gain index gives the fixed codebook gain correction factor γ'. The calculation of the quantized fixed codebook gain, $g_c$ follows the same steps as the other rates.

2) Decoding of adaptive codebook vector: for 8.0, 11.0 and 6.65 (during LTP_mode=1) kbps bit rate encoding modes, the received pitch index (adaptive codebook index) is used to find the integer and fractional parts of the pitch lag. The adaptive codebook υ(n) is found by interpolating the past excitation u(n) (at the pitch delay) using the FIR filters.

3) Decoding of fixed codebook vector: the received codebook indices are used to extract the type of the codebook (pulse or Gaussian) and either the amplitudes and positions of the excitation pulses or the bases and signs of the Gaussian excitation. In either case, the reconstructed fixed codebook excitation is given as c(n). If the integer part of the pitch lag is less than the subframe size 40 and the chosen excitation is pulse type, the pitch sharpening is applied. This translates into modifying c(n) as c(n)=c(n)+βc(n−T), where β is the decoded pitch gain $g_p$ from the previous subframe bounded by [0.2, 1.0].

The excitation at the input of the synthesis filter is given by u(n)=$g_p$υ(n)+$g_c$ c(n), n=0, 39. Before the speech synthesis, a post-processing of the excitation elements is performed. This means that the total excitation is modified by emphasizing the contribution of the adaptive codebook vector:

$$\bar{u}(n) = \begin{cases} u(n) + 0.25\beta\bar{g}_p v(n), & \bar{g}_p > 0.5 \\ u(n), & \bar{g}_p <= 0.5 \end{cases}$$

Adaptive gain control (AGC) is used to compensate for the gain difference between the unemphasized excitation u(n) and emphasized excitation u(n). The gain scaling factor η for the emphasized excitation is computed by:

$$\eta = \begin{cases} \sqrt{\dfrac{\sum_{n=0}^{39} u^2(n)}{\sum_{n=0}^{39} \bar{u}^2(n)}} & \bar{g}_p > 0.5 \\ 1.0 & \bar{g}_p <= 0.5 \end{cases}$$

The gain-scaled emphasized excitation u(n) is given by:

$$\bar{u}(n)=\eta\bar{u}(n).$$

The reconstructed speech is given by:

$$\bar{s}(n) = \bar{u}(n) - \sum_{i=1}^{10} \bar{a}_i \bar{s}(n-i),\ n = 0 \text{ to } 39,$$

where $a_i$ are the interpolated LP filter coefficients. The synthesized speech s(n) is then passed through an adaptive postfilter.

Post-processing consists of two functions: adaptive postfiltering and signal up-scaling. The adaptive postfilter is the cascade of three filters: a formant postfilter and two tilt compensation filters. The postfilter is updated every subframe of 5 ms. The formant postfilter is given by:

$$H_f(z) = \frac{\bar{A}\left(\dfrac{\bar{z}}{\gamma_n}\right)}{\bar{A}\left(\dfrac{\bar{z}}{\gamma_d}\right)}$$

where A(z) is the received quantized and interpolated LP inverse filter and $\gamma_n$ and $\gamma_d$ control the amount of the formant postfiltering.

The first tilt compensation filter $H_{t1}(z)$ compensates for the tilt in the formant postfilter $H_f(z)$ and is given by:

$$H_{t1}(z)=(1-\mu z^{-1})$$

where $\mu=\gamma_{t1}k_1$ is a tilt factor, with $k_1$ being the first reflection coefficient calculated on the truncated impulse response $h_f(n)$, of the formant postfilter $$k_1 = \frac{r_h(1)}{r_h(0)}$$

with:

$$r_h(i) = \sum_{j=0}^{L_h-i-1} h_f(j)h_f(j+i),\ (L_h = 22),$$

The postfiltering process is performed as follows. First, the synthesized speech s(n) is inverse filtered through A(z/γn) to produce the residual signal r(n). The signal r(n) is filtered by the synthesis filter 1/A(z/yd) is passed to the first tilt compensation filter ht1(z) resulting in the postfiltered speech signal sf(n).

Adaptive gain control (AGC) is used to compensate for the gain difference between the synthesized speech signal s(n) and the postfiltered signal $s_f(n)$. The gain scaling factor γ for the present subframe is computed by:

$$\gamma = \sqrt{\frac{\sum_{n=0}^{39} \bar{s}^2(n)}{\sum_{n=0}^{39} \bar{s}_f^2(n)}}$$

The gain-scaled postfiltered signal s'(n) is given by:

$$\bar{s}'(n)=\beta(n)\bar{s}_f(n)|$$

where β(n) is updated in sample by sample basis and given by:

$$\beta(n)=\alpha\beta(n-1)+(1-\alpha)\gamma|$$

where α is an AGC factor with value 0.9. Finally, up-scaling consists of multiplying the postfiltered speech by a factor 2 to undo the down scaling by 2 which is applied to the input signal.

Figure 13:
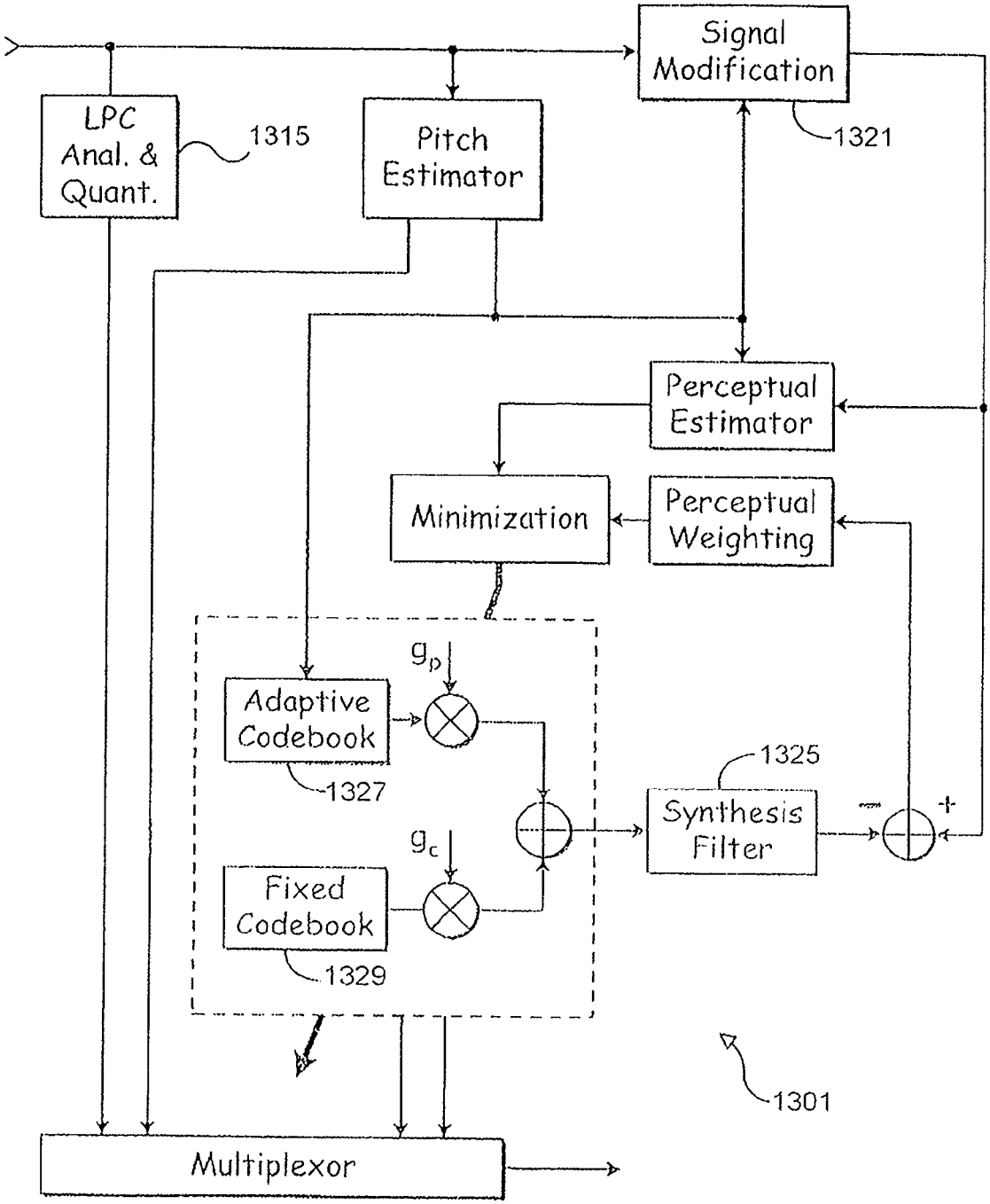
FIG. 13 is a block diagram of an alternate embodiment of a speech encoder that is built in accordance with the present invention.
Figure 14:
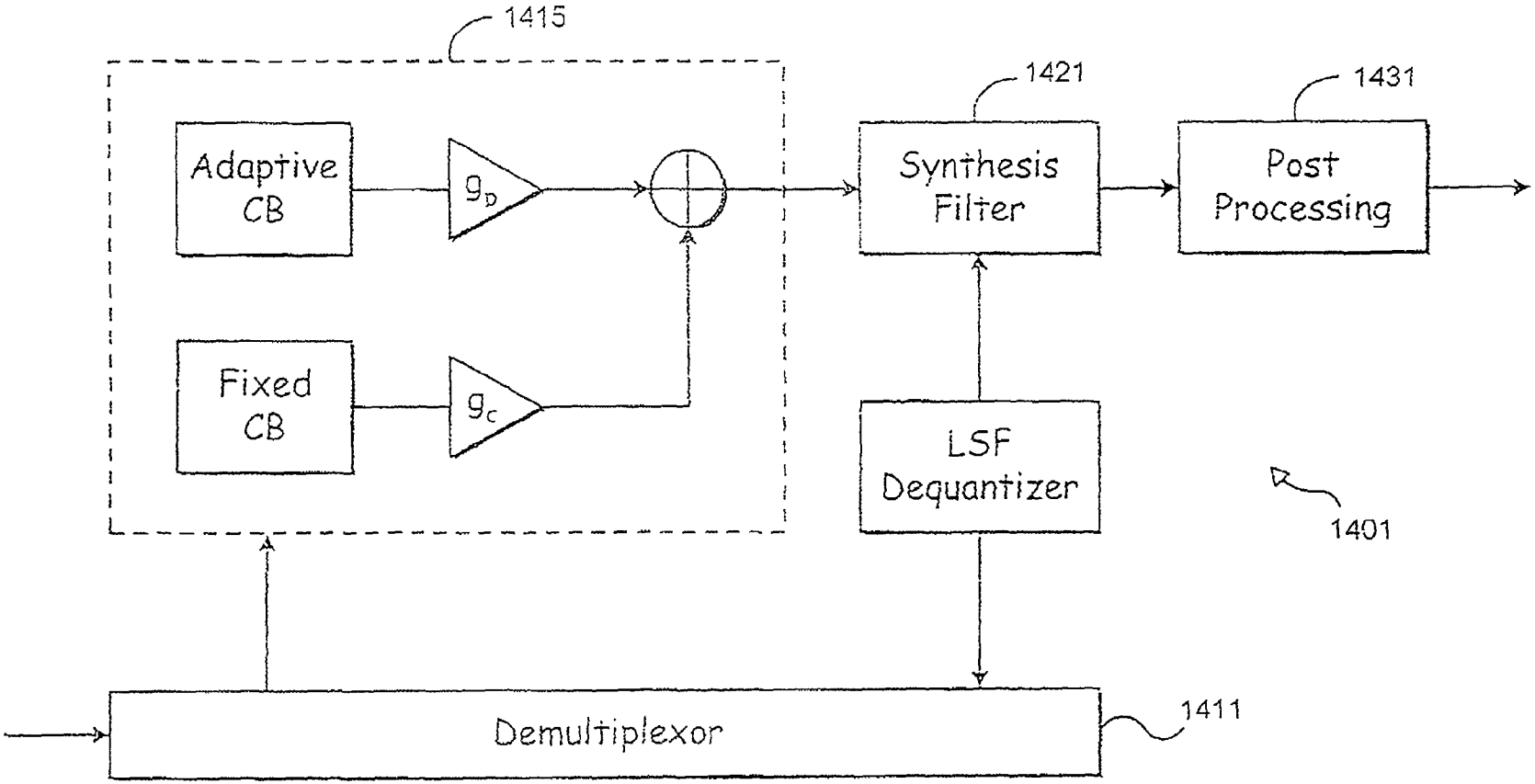
FIG. 14 is a block diagram of an embodiment of a speech decoder having corresponding functionality to that of the speech encoder of FIG. 13.

FIGS. 13 and 14 are drawings of an alternate embodiment of a 4 kbps speech codec that also illustrates various aspects of the present invention. In particular, FIG. 13 is a block diagram of a speech encoder 1301 that is built in accordance with the present invention. The speech encoder 1301 is based on the analysis-by-synthesis principle. To achieve toll quality at 4 kbps, the speech encoder 1301 departs from the strict waveform-matching criterion of regular CELP coders and strives to catch the perceptually important features of the input signal.

The speech encoder 1301 operates on a frame size of 20 ms with three subframes (two of 6.625 ms and one of 6.75 ms). A look-ahead of 15 ms is used. The one-way coding delay of the codec adds up to 55 ms.

At a block 1315, the spectral envelope is represented by a $10^{th}$ order LPC analysis for each frame. The prediction coefficients are transformed to the Line Spectrum Frequencies (LSFs) for quantization. The input signal is modified to better fit the coding model without loss of quality. This processing is denoted "signal modification" as indicated by a block 1321. In order to improve the quality of the reconstructed sign, perceptually important features are estimated and emphasized during encoding.

The excitation signal for an LPC synthesis filter 1325 is build from the two traditional components: 1) the pitch contribution; and 2) the innovation contribution. The pitch contribution is provided through use of an adaptive codebook 1327. An innovation codebook 1329 has several subcodebooks in order to provide robustness against a wide range of input signals. To each of the two contributions a gain is applied which, multiplied with their respective codebook vectors and summed, provide the excitation signal.

The LSFs and pitch lag are coded on a frame basis, and the remaining parameters (the innovation codebook index, the pitch gain, and the innovation codebook gain) are coded for every subframe. The LSF vector is coded using predictive vector quantization. The pitch lag has an integer part and a fractional part constituting the pitch period. The quantized pitch period has a non-uniform resolution with higher density of quantized values at lower delays. The bit allocation for the parameters is shown in the following table.

Table of Bit Allocation

| Parameter | Bits per 20 ms |
|---|---|
| LSFs | 21 |
| Pitch lag (adaptive codebook) | 8 |
| Gains | 12 |
| Innovation codebook | 3 × 13 = 39 |
| Total | 80 |

When the quantization of all parameters for a frame is complete the indices are multiplexed to form the 80 bits for the serial bit-stream.

FIG. 14 is a block diagram of a decoder 1401 with corresponding functionality to that of the encoder of FIG. 13. The decoder 1401 receives the 80 bits on a frame basis from a demultiplexor 1411. Upon receipt of the bits, the decoder 1401 checks the sync-word for a bad frame indication, and decides whether the entire 80 bits should be disregarded and frame erasure concealment applied. If the frame is not declared a frame erasure, the 80 bits are mapped to the parameter indices of the codec, and the parameters are decoded from the indices using the inverse quantization schemes of the encoder of FIG. 13.

When the LSFs, pitch lag, pitch gains, innovation vectors, and gains for the innovation vectors are decoded, the excitation signal is reconstructed via a block 1415. The output signal is synthesized by passing the reconstructed excitation signal through an LPC synthesis filter 1421. To enhance the perceptual quality of the reconstructed signal both short-term and long-term post-processing are applied at a block 1431.

Regarding the bit allocation of the 4 kbps codec (as shown in the prior table), the LSFs and pitch lag are quantized with 21 and 8 bits per 20 ms, respectively. Although the three subframes are of different size the remaining bits are allocated evenly among them. Thus, the innovation vector is quantized with 13 bits per subframe. This adds up to a total of 80 bits per 20 ms, equivalent to 4 kbps.

The estimated complexity numbers for the proposed 4 kbps codec are listed in the following table. All numbers are under the assumption that the codec is implemented on commercially available 16-bit fixed point DSPs in full duplex mode. All storage numbers are under the assumption of 16-bit words, and the complexity estimates are based on the floating point C-source code of the codec.

Table of Complexity Estimates

| Computational complexity | 30 MIPS |
|---|---|
| Program and data ROM | 18 kwords |
| RAM | 3 kwords |

The decoder 1401 comprises decode processing circuitry that generally operates pursuant to software control. Similarly, the encoder 1301 (FIG. 13) comprises encoder processing circuitry also operating pursuant to software control. Such processing circuitry may coexist, at least in part, within a single processing unit such as a single DSP.

Figure 15:
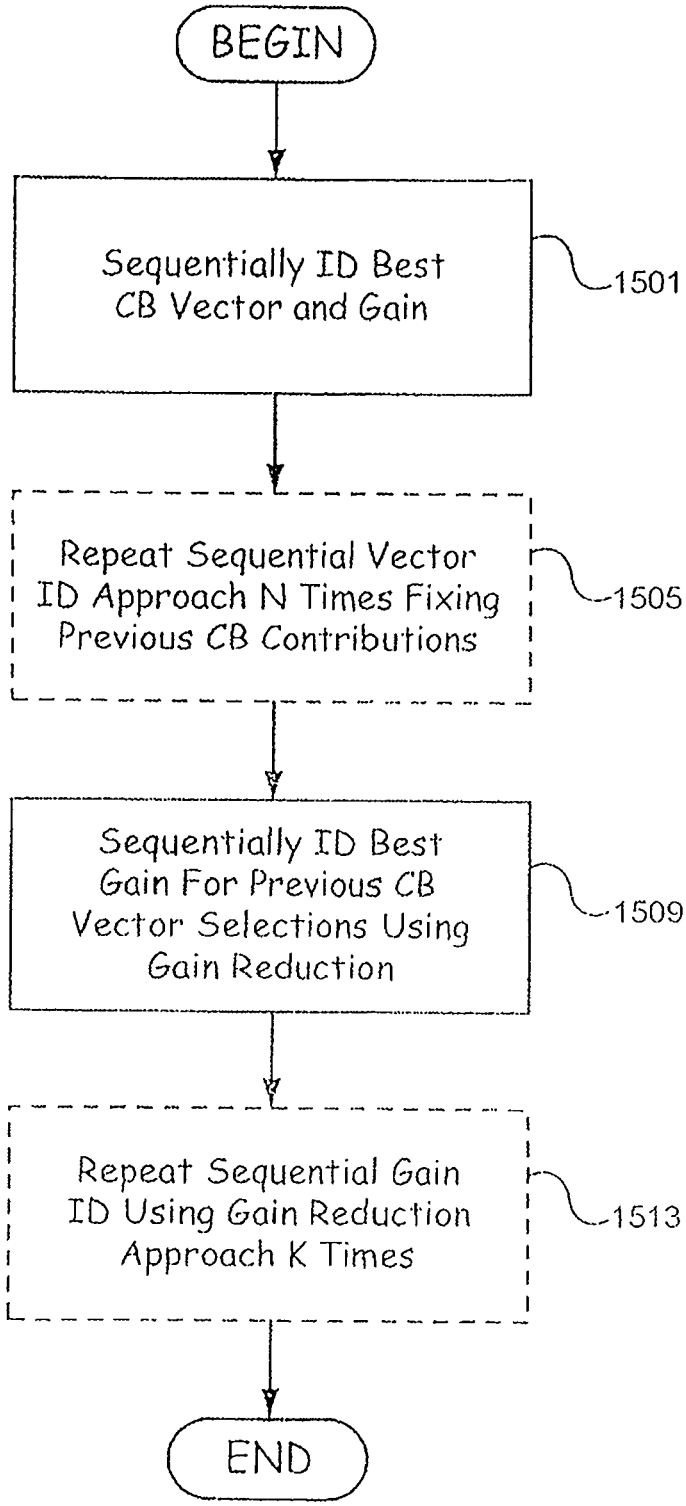
FIG. 15 is a flow diagram illustrating a process used by an encoder of the present invention to fine tune excitation contributions from a plurality of codebooks using code excited linear prediction.

FIG. 15 is a flow diagram illustrating a process used by an encoder of the present invention to fine tune excitation contributions from a plurality of codebooks using code excited linear prediction. Using a code-excited linear prediction approach, a plurality of codebooks are used to generate excitation contributions as previous described, for example, with reference to the adaptive and fixed codebooks. Although typically only two codebooks are used at any time to generate contributions, many more might be used with the present searching and optimization approach.

Specifically, an encoder processing circuit at a block 1501 sequentially identifies a best codebook vector and associated gain from each codebook contribution used. For example, an adaptive codebook vector and associated gain are identified by minimizing a first target signal as described previously with reference to FIG. 9.

At a block 1505 if employed, the encoder processing circuit repeats at least part of the sequential identification process represented by the block 1501 yet with at least one of the previous codebook contributions fixed. For example, having first found the adaptive then the fixed codebook contributions, the adaptive codebook vector and gain might be searched for a second time. Of course, to continue the sequential process, after finding the best adaptive codebook contribution the second time, the fixed codebook contribution might also be reestablished. The process represented by the block 1505 might also be reapplied several times, or not at all as is the case of the embodiment identified in FIG. 9, for example.

Thereafter, at a block 1509, the encoder processing circuit only attempts to optimize the gains of the contributions of the plurality of codebooks at issue. In particular, the best gain for a first of the codebooks is reduced, and a second codebook gain is optimally selected. Similarly, if more than two codebooks are simultaneously employed, the second and/or the first codebook gains can be reduced before optimal gain calculation for a third codebook is undertaken.

For example, with reference to FIG. 10, the adaptive codebook gain is reduced before calculating an optimum gain for the fixed codebook, wherein both codebook vectors themselves remain fixed. Although a fixed gain reduction might be applied, in the embodiment of FIG. 10, the gain reduction is adaptive. As will be described with reference to FIG. 17 below, such adaptation may involve a consideration of the encoding bit rate and the normalized LTP gain.

Although further processing need not be employed, at a block 1513, in some embodiments, the encoder processing circuitry may repeat the sequential gain identification process a number of times. For example, after calculating the optimal gain for the fixed codebook with the reduced gain applied to the adaptive codebook (at the block 1509), the fixed codebook gain might be (adaptively) reduced so that the fixed codebook gain might be recalculated. Further fine-tuning turns might also apply should processing resources support. However, with limited processing resources, neither processing at the block 1505 nor at the block 1513 need be applied.

Figure 16:
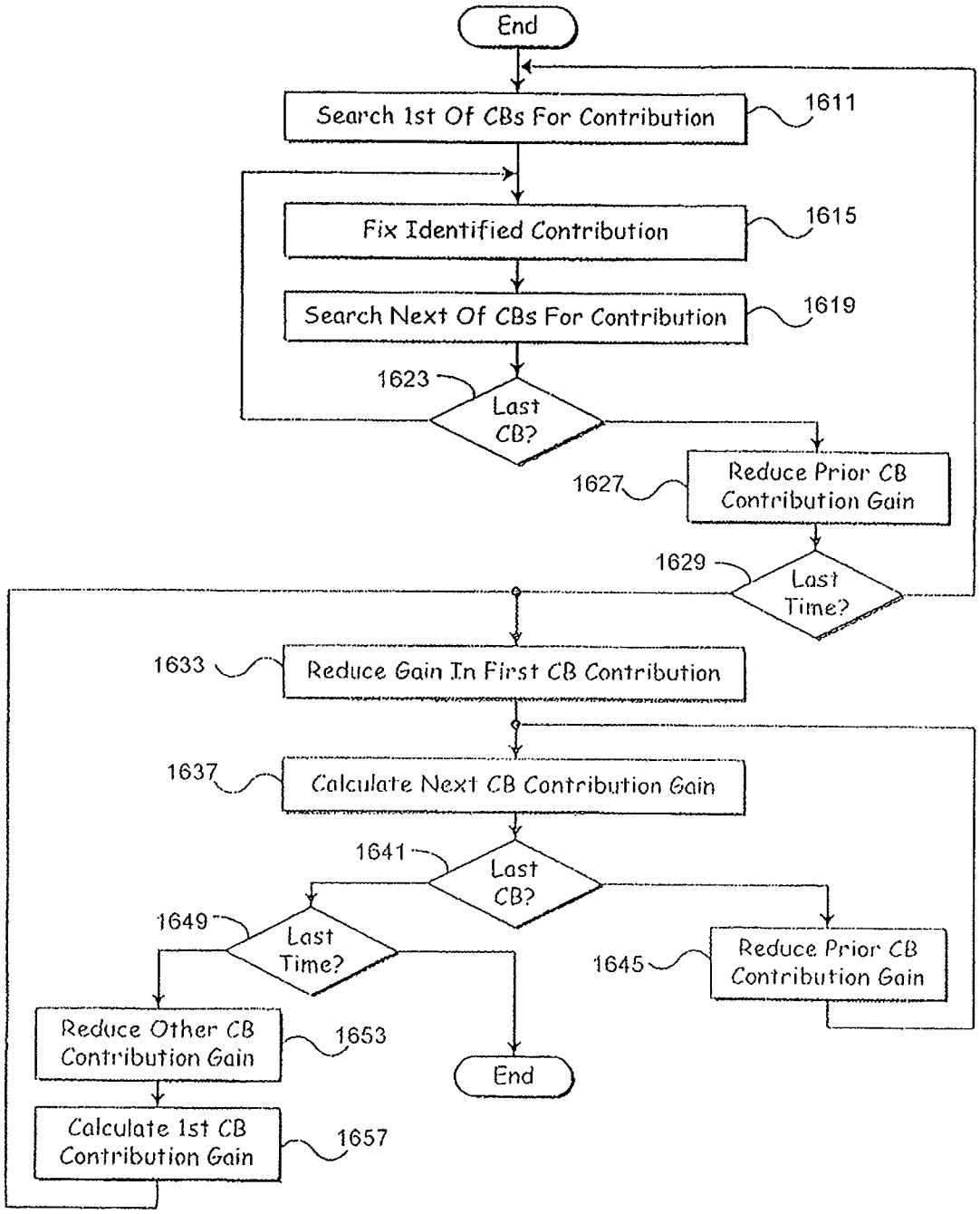
FIG. 16 is a flow diagram illustrating use of adaptive LTP gain reduction to produce a second target signal for fixed codebook searching in accordance with the present invention, in a specific embodiment of the functionality of FIG. 15.

FIG. 16 is a flow diagram illustrating use of adaptive LTP gain reduction to produce a second target signal for fixed codebook searching in accordance with the present invention, in a specific embodiment of the functionality of FIG. 15. In particular, at a block 1611, a first of a plurality of codebooks is searched to attempt to find a best contribution. The codebook contribution comprises an excitation vector and a gain. With the first contribution applied as indicated by a block 1615, a best contribution from a next codebook is found at a block 1619. This process is repeated until all of the "best" codebook contributions are found as indicated by the looping associated with a decision block 1623.

When only an adaptive codebook and a fixed codebook are used, the process identified in the blocks 1611-1619 involves identifying the adaptive codebook contribution, then, with the adaptive codebook contribution in place, identifying the fixed codebook contribution. Further detail regarding one example of this process can be found above in reference to FIG. 10.

Having identified the "best" codebook contributions, in some embodiments, the encoder will repeat the process of the blocks 1611-1623 a plurality of times in an attempt to fine tune the "best" codebook contributions. Whether or not such fine tuning is applied, once completed, the encoder, having fixed all of the "best" excitation vectors, attempts to fine tune the codebook gains. Particularly, at a block 1633, the gain of at least one of the codebooks is reduced so that the gain of the other(s) may be recalculated via a loop through blocks 1637, 1641 and 1645. For example, with only an adaptive and a fixed codebook, the adaptive codebook gain is reduced, in some embodiments adaptively, so that the fixed codebook gain may be recalculated with the reduced, adaptive codebook contribution in place.

Again, multiple passes of such gain fine-tuning may be applied a number of times should processing constraints permit via blocks 1649, 1653 and 1657. For example, once the fixed codebook gain is recalculated, it might be reduced to permit fine tuning of the adaptive codebook gain, and so on.

Figure 17:
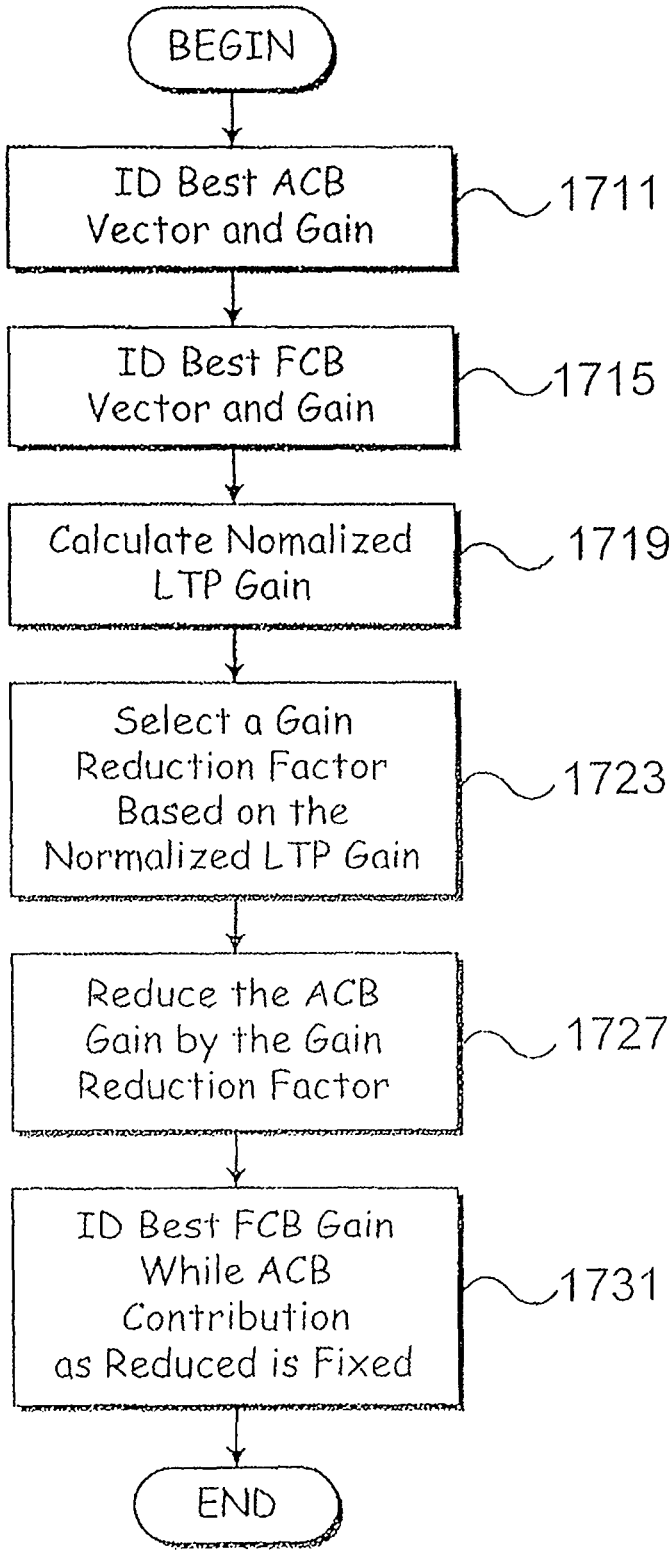
FIG. 17 illustrates a particular embodiment of adaptive gain optimization wherein an encoder, having an adaptive codebook and a fixed codebook, uses only a single pass to select codebook excitation vectors and a single pass of adaptive gain reduction.

FIG. 17 illustrates a particular embodiment of adaptive gain optimization wherein an encoder, having an adaptive codebook and a fixed codebook, uses only a single pass to select codebook excitation vectors and a single pass of adaptive gain reduction. At a block 1711, an encoder searches for and identifies a "best" adaptive codebook contribution (i.e., a gain and an excitation vector).

The best adaptive codebook contribution is used to produce a target signal, $T_g(n)$, for the fixed codebook search. At a block 1715, such search is performed to find a "best" fixed codebook contribution. Thereafter, only the code vectors of the adaptive and fixed codebook contributions are fixed, while the gains are jointly optimized.

At blocks 1719 and 1723, the gain associated with the best adaptive codebook contribution is reduced by a varying amount. Although other adaptive techniques might be employed, the encoder calculates a gain reduction factor, $G_r$, which is generally based on the decoding bit rate and the degree of correlation between the original target signal, $T_{gs}(n)$, and the filtered signal from the adaptive codebook, $Y_a(n)$.

Thereafter, at a block 1727, the adaptive codebook gain is reduced by the gain reduction factor and a new target signal is generated for use in selecting an optimal fixed codebook gain at a block 1731. Of course, although not utilized, repeated application of such an approach might be employed to further fine tune the fixed and adaptive codebook contributions.

More specifically, to enhance the quality of the fixed codebook search, the target signal, $T_g(n)$, for the fixed codebook search is produced by temporally reducing the LTP contribution with a gain factor, $G_r$, as follows:

$$T_g(n)=T_{gs}(n)-G_r \cdot g_p \cdot Y_a(n)_2, n=0,1,\ldots,39$$

where $T_{gs}(n)$ is the original target, $Y_a(n)$ is the filtered signal from the adaptive codebook, $g_p$ is the LTP gain defined above, and the gain factor is determined according to the normalized LTP gain, $R_p$, and the bit rate as follows:

```
if (rate<=0)/*for 4.45 kbps and 5.8 kbps*/
    Gr =0.7 Rp +0.3;
if (rate==1)/*for 6.65 kbps*/
    Gr=0.6 Rp+0.4;
if (rate==2)/*for 8.0 kbps*/
```

-continued

```
    Gr=0.3 Rp+0.7;
if (rate==3)/*for 11.0 kbps*/
    Gr=0.95;
if (Top>L__SF & gp>0.5 & rate<=2)
    Gr<=Gr(0.3 Rp+0.7);
```

In addition, the normalized LTP gain, $R_p$, is defined as:

$$R_p = \frac{\sum_{n=0}^{39} T_{gs}(n)Y_a(n)}{\sqrt{\sum_{n=0}^{39} T_{gs}(n)T_{gs}(n)}\sqrt{\sum_{n=0}^{39} Y_a(n)Y_a(n)}}$$

Of course, many other modifications and variations are also possible. In view of the above detailed description of the present invention and associated drawings, such other modifications and variations will now become apparent to those skilled in the art. It should also be apparent that such other modifications and variations may be effected without departing from the spirit and scope of the present invention.

In addition, the following Appendix A provides a list of many of the definitions, symbols and abbreviations used in this application. Appendices B and C respectively provide source and channel bit ordering information at various encoding bit rates used in one embodiment of the present invention. Appendices A, B and C comprise part of the detailed description of the present application, and, otherwise, are hereby incorporated herein by reference in its entirety.

APPENDIX A

For purposes of this application, the following symbols, definitions and abbreviations apply.

| | |
|---|---|
| adaptive codebook: | The adaptive codebook contains excitation vectors that are adapted for every subframe. The adaptive codebook is derived from the long term filter state. The pitch lag value can be viewed as an index into the adaptive codebook. |
| adaptive postfilter: | The adaptive postfilter is applied to the output of the short term synthesis filter to enhance the perceptual quality of the reconstructed speech. In the adaptive multi-rate codec (AMR), the adaptive postfilter is a cascade of two filters: a formant postfilter and a tilt compensation filter. |
| Adaptive Multi Rate codec: | The adaptive multi-rate code (AMR) is a speech and channel codec capable of operating at gross bit-rates of 11.4 kbps ("half-rate") and 22.8 kbs ("fill-rate"). In addition, the codec may operate at various combinations of speech and channel coding (codec mode) bit-rates for each channel mode. |
| AMR handover: | Handover between the full rate and half rate channel modes to optimize AMR operation. |
| channel mode: | Half-rate (HR) or full-rate (FR) operation. |
| channel mode adaptation: | The control and selection of the (FR or HR) channel mode. |
| channel repacking: | Repacking of HR (and FR) radio channels of a given radio cell to achieve higher capacity within the cell. |
| closed-loop pitch analysis: | This is the adaptive codebook search, i.e., a process of estimating the pitch (lag) value from the weighted input speech and the long term filter state. In the closed-loop search, the lag is searched using error minimization loop (analysis-by-synthesis). In the adaptive |

APPENDIX A-continued

For purposes of this application, the following symbols, definitions and abbreviations apply.

| | |
|---|---|
| | multi rate codec, closed-loop pitch search is performed for every subframe. |
| codec mode: | For a given channel mode, the bit partitioning between the speech and channel codecs. |
| codec mode adaptation: | The control and selection of the codec mode bit-rates. Normally, implies no change to the channel mode. |
| direct form coefficients: | One of the formats for storing the short term filter parameters. In the adaptive multi rate codec, all filters used to modify speech samples use direct form coefficients. |
| fixed codebook: | The fixed codebook contains excitation vectors for speech synthesis filters. The contents of the codebook are non-adaptive (i.e., fixed). In the adaptive multi rate codec, the fixed codebook for a specific rate is implemented using a multi-function codebook. |
| fractional lags: | A set of lag values having sub-sample resolution. In the adaptive multi rate codec of sub-sample resolution between $1/6^{th}$ and 1.0 of a sample is used. |
| full-rate (FR): | Full-rate channel or channel mode. |
| frame: | A time interval equal to 20 ms (160 samples at an 8 kHz sampling rate). |
| gross bit-rate: | The bit-rate of the channel mode selected (22.8 kbps or 11.4 kbps). |
| half-rate (HR): | Half-rate channel or channel mode. |
| in-band signaling: | Signaling for DTX, Link Control, Channel and codec mode modification, etc. carried within the traffic. |
| integer lags: | A set of lag values having whole sample resolution. |
| interpolating filter: | An FIR filter used to produce an estimate of sub-sample resolution samples, given an input sampled with integer sample resolution. |
| inverse filter: | This filter removes the short term correlation from the speech signal. The filter models an inverse frequency response of the vocal tract. |
| lag: | The long term filter delay. This is typically the true pitch period, or its multiple or sub-multiple. |
| Line Spectral Frequencies: | (see Line Spectral Pair) |
| Line Spectral Pair: | Transformation of LPC parameters. Line Spectral Pairs are obtained by decomposing the inverse filter transfer function A(z) to a set of two transfer functions, one having even symmetry and the other having odd symmetry. The Line Spectral Pairs (also called as Line Spectral Frequencies) are the roots of these polynomials on the z-unit circle). |
| LP analysis window: | For each frame, the short term filter coefficients are computed using the high pass filtered speech samples within the analysis window. In the adaptive multi rate codec, the length of the analysis window is always 240 samples. For each frame, two asymmetric windows are used to generate two sets of LP coefficient coefficients which are interpolated in the LSF domain to construct the perceptual weighting filter. Only a single set of LP coefficients per frame is quantized and transmitted to the decoder to obtain the synthesis filter. A lookahead of 25 samples is used for both HR and FR. |
| LP coefficients: | Linear Prediction (LP) coefficients (also referred as Linear Predictive Coding (LPC) coefficients) is a generic descriptive term for describing the short term filter coefficients. |
| LTP Mode: | Codec works with traditional LTP. |
| mode: | When used alone, refers to the source codec mode, i.e., to one of the source codecs employed in the AMR codec. (See also codec mode and channel mode.) |
| multi-function codebook: | A fixed codebook consisting of several subcodebooks constructed with different kinds of pulse innovation vector structures and noise innovation vectors, where codeword from the codebook is used to synthesize the excitation vectors. |
| open-look pitch search: | A process of estimating the near optimal pitch lag directly from the weighted input speech. This is done to simplify the pitch analysis and confine the closed-loop pitch search to a small number of lags around the open-loop estimated lags. In the adaptive multi rate codec, open-loop pitch search is performed once per frame for PP mode and twice per frame for LTP mode. |
| out-of-band signaling: | Signaling on the GSM control channels to support link control. |
| PP Mode: | Codec works with pitch preprocessing. |
| residual: | The output signal resulting from an inverse filtering operation. |
| short term synthesis filter: | This filter introduces, into the excitation signal, short term correlation which models the impulse response of the vocal tract. |
| perceptual weighting filter: | This filter is employed in the analysis-by-synthesis search of the codebooks. The filter exploits the noise masking properties of the formants (vocal tract resonances) by weighting the error less in regions near the formant frequencies and more in regions away from them. |
| subframe: | A time interval equal to 5-10 ms (40-80 samples at an 8 kHz sampling rate). |
| vector quantization: | A method of grouping several parameters into a vector and quantizing them simultaneously. |
| zero input response: | The output of a filter due to past inputs, i.e. due to the present state of the filter, given that an input of zeros is applied. |
| zero state response: | The output of a filter due to the present input, given that no past inputs have been applied, i.e., given the state information in the filter is all zeroes. |
| A(z) | The inverse filter with unquantized coefficients |
| $\hat{A}(z)$ | The inverse filter with quantized coefficients |
| $H(z) = \frac{1}{\hat{A}(z)}$ | The speech synthesis filter with quantized coefficients |
| $a_i$ | The unquantized linear prediction parameters (direct form coefficients) |
| $\hat{a}_i$ | The quantized linear prediction parameters |
| $\frac{1}{B(z)}$ | The long-term synthesis filter |
| W(z) | The perceptual weighting filter (unquantized coefficients) |
| $\gamma_1, \gamma_2$ | The perceptual weighting factors |
| $F_E(z)$ | Adaptive pre-filter |
| T | The nearest integer pitch lag to be closed-loop fractional pitch lag of the subframe |
| β | The adaptive pre-filter coefficient (the quantized pitch gain) |
| $H_f(z) = \frac{\hat{A}(z/\gamma_n)}{\hat{A}(z/\gamma_d)}$ | The formant postfilter |
| $\gamma_n$ | Control coefficient for the amount of the formant post-filtering |
| $\gamma_d$ | Control coefficient for the amount of the formant post-filtering |

APPENDIX A-continued

For purposes of this application, the following symbols, definitions and abbreviations apply.

| | |
|---|---|
| $H_t(z)$ | Tilt compensation filter |
| $\gamma_t$ | Control coefficient for the amount of the tilt compensation filtering |
| $\mu = \gamma_t k_1'$ | A tilt factor, with $k_1'$ being the first reflection coefficient |
| $h_f(n)$ | The truncated impulse response of the formant postfilter |
| $L_h$ | The length of $h_f(n)$ |
| $r_h(i)$ | The auto-correlations of $h_f(n)$ |
| $\hat{A}(z/\gamma_n)$ | The inverse filter (numerator) part of the formant postfilter |
| $1/\hat{A}(z/\gamma_e)$. | The synthesis filter (denominator) part of the formant postfilter |
| $\hat{r}(n)$ | The residual signal of the inverse filter $\hat{A}(z/\gamma_n)$ |
| $h_t(z)$ | Impulse response of the tilt compensation filter |
| $\gamma_{sc}(n)$ | The AGC-controlled gain scaling factor of the adaptive postfilter |
| $\alpha$ | The AGC factor of the adaptive postfilter |
| $H_{h1}(z)$ | Pre-processing high-pass filter |
| $w_I(n)$, $w_{II}(n)$ | LP analysis windows |
| $L_1^{(I)}$ | Length of the first part of the LP analysis window $^{w}I^{(n)}$ |
| $L_2^{(I)}$ | Length of the second part of the LP analysis window $^{w}I^{(n)}$ |
| $L_1^{(II)}$ | Length of the first part of the LP analysis window $^{w}II^{(n)}$ |
| $L_2^{(II)}$ | Length of the second part of the LP analysis window $^{w}II^{(n)}$ |
| $r_{ac}(k)$ | The auto-correlations of the windowed speech s'(n) |
| $w_{lag}(i)$ | Lag window for the auto-correlations (60 Hz bandwidth expansion) |
| $f_0$ | The bandwidth expansion in Hz |
| $f_s$ | The sampling frequency in Hz |
| $r'_{ac}(k)$ | The modified (bandwidth expanded) auto-correlations |
| $E_{LD}(i)$ | The prediction error in the ith iteration of the Levinson algorithm |
| $k_i$ | The ith reflection coefficient |
| $a_j^{(i)}$ | The jth direct form coefficient in the ith iteration of the Levinson algorithm |
| $F_1'(z)$ | Symmetric LSF polynomial |
| $F_2'(z)$ | Antisymmetric LSF polynomial |
| $F_1(z)$ | Polynomial $F_1'(z)$ with root $Z = -1$ eliminated |
| $F_2(z)$ | Polynomial $F_2'(z)$ with root $z = 1$ eliminated |
| $q_i$ | The line spectral pairs (LSFs) in the cosine domain |
| q | An LSF vector in the cosine domain |
| $\hat{q}_i^{(n)}$ | The quantized LSF vector at the ith subframe of the frame n |
| $\omega_i$ | The line spectral frequencies (LSFs) |
| $T_m(x)$ | A mth order Chebyshev polynomial |
| $f_1(i)$, $f_2(i)$ | The coefficients of the polynomials $F_1(z)$ and $F_2(z)$ |
| $f_1'(i)$, $f_2'(i)$ | The coefficients of the polynomials $F_1'(z)$ and $F_2'(z)$ |
| f(i) | The coefficients of either $F_1(z)$ or $F_2(z)$ |
| C(x) | Sum polynomial of the Chebyshev polynomials |
| x | Cosine of angular frequency $\omega$ |
| $\lambda_k$ | Recursion coefficients for the Chebyshev polynomial evaluation |
| $f_i$ | The line spectral frequencies (LSFs) in Hz |
| $f^T = [f_1\ f_2 \ldots f_{10}]$ | The vector representation of the LSFs in Hz |
| $z^{(1)}(n)$, $z^{(2)}(n)$ | The mean-removed LSF vectors at frame n |
| $r^{(1)}(n)$, $r^{(2)}(n)$ | The LSF prediction residual vectors at frame n |
| p(n) | The predicted LSF vector at frame n |
| $\hat{r}^{(2)}(n-1)$ | The quantized second residual vector at the past frame |
| $\hat{f}^k$ | The quantized LSF vector at quantization index k |

APPENDIX A-continued

For purposes of this application, the following symbols, definitions and abbreviations apply.

| | |
|---|---|
| $E_{LSP}$ | The LSF quantization error |
| $w_i$, $i = 1, \ldots, 10$, | LSF-quantization weighting factors |
| $d_i$ | The distance between the line spectral frequencies $f_{i+1}$ and $f_{i-1}$ |
| h(n) | The impulse response of the weighted synthesis filter |
| $O_k$ | The correlation maximum of open-loop pitch analysis at delay k |
| $O_{t_i}$, $i = 1, \ldots, 3$ | The correlation maxima at delays $t_i$, $i = 1, \ldots, 3$ |
| $(M_i, t_i)$, $i = 1, \ldots, 3$ | The normalized correlation maxima $M_i$ and the corresponding delays $t_i$, $i = 1, \ldots, 3$ |
| $H(z)W(z) = \dfrac{A(z/\gamma_1)}{\hat{A}(z)A(z/\gamma_2)}$ | The weighted synthesis filter |
| $A(z/\gamma_1)$ | The numerator of the perceptual weighting filter |
| $1/A(z/\gamma_2)$ | The denominator of the perceptual weighting filter |
| $T_1$ | The nearest integer to the fractional pitch lag of the previous (1st or 3rd) subframe |
| s'(n) | The windowed speech signal |
| $s_w(n)$ | The weighted speech signal |
| $\hat{s}(n)$ | Reconstructed speech signal |
| $\hat{s}'(n)$ | The gain-scaled post-filtered signal |
| $\hat{s}_f(n)$ | Post-filtered speech signal (before scaling) |
| x(n) | The target signal for adaptive codebook search |
| $x_2(n)$, $x_2'$ | The target signal for Fixed codebook search |
| $res_{LP}(n)$ | The LP residual signal |
| c(n) | The fixed codebook vector |
| v(n) | The adaptive codebook vector |
| y(n) = v(n)*h(n) | The filtered adaptive codebook vector |
| | The filtered fixed codebook vector |
| $y_k(n)$ | The past filtered excitation |
| u(n) | The excitation signal |
| $\hat{u}(n)$ | The fully quantized excitation signal |
| $\hat{u}'(n)$ | The gain-scaled emphasized excitation signal |
| $T_{op}$ | The best open-loop lag |
| $t_{min}$ | Minimum lag search value |
| $t_{max}$ | Maximum lag search value |
| R(k) | Correlation term to be maximized in the adaptive codebook search |
| $R(k)_t$ | The interpolated value of R(k) for the integer delay k and fraction t |
| $A_k$ | Correlation term to be maximized in the algebraic codebook search at index k |
| $C_k$ | The correlation in the numerator of $A_k$ at index k |
| $E_{Dk}$ | The energy in the denominator of $A_k$ at index k |
| $d = H^t x_2$ | The correlation between the target signal $x_2(n)$ and the impulse response h(n), i.e., backward filtered target |
| H | The lower triangular Toepliz convolution matrix with diagonal h(0) and lower diagonals h(1), . . . , h(39) |
| $\Phi = H^t H$ | The matrix of correlations of h(n) |
| d(n) | The elements of the vector d |
| $\phi(i, j)$ | The elements of the symmetric matrix $\Phi$ |
| $c_k$ | The innovation vector |
| C | The correlation in the numerator of $A_k$ |
| $m_i$ | The position of the i th pulse |
| $\theta_i$ | The amplitude of the i th pulse |
| $N_p$ | The number of pulses in the fixed codebook excitation |
| $E_D$ | The energy in the denominator of $A_k$ |
| $res_{LTP}(n)$ | The normalized long-term prediction residual |
| b(n) | The sum of the normalized d(n) vector and normalized long-term prediction residual $res_{LTP}(n)$ |
| $s_b(n)$ | The sign signal for the algebraic codebook search |
| $z'$, z(n) | The fixed codebook vector convolved with h(n) |

APPENDIX A-continued

For purposes of this application, the following symbols, definitions and abbreviations apply.

| | |
|---|---|
| E(n) | The mean-removed innovation energy (in dB) |
| $\bar{E}$ | The mean of the innovation energy |
| $\tilde{E}(n)$ | The predicted energy |
| $[b_1\ b_2\ b_3\ b_4]$ | The MA prediction coefficients |
| $\hat{R}(k)$ | The quantized prediction error at subframe k |
| $E_I$ | The mean innovation energy |
| R(n) | The prediction error of the fixed-codebook gain quantization |
| $E_Q$ | The quantization error of the fixed-codebook gain quantization |
| e(n) | The states of the synthesis filter $1/\hat{A}(z)$ |
| $e_w(n)$ | The perceptually weighted error of the analysis-by-synthesis search |
| $\eta$ | The gain scaling factor for the emphasized excitation |
| $g_c$ | The fixed-codebook gain |
| $g'_c$ | The predicted fixed-codebook gain |
| $\hat{g}_c$ | The quantized fixed codebook gain |
| $g_p$ | The adaptive codebook gain |
| $\hat{g}_p$ | The quantized adaptive codebook gain |
| $\gamma_{gc} = g_c/g'_c$ | A correction factor between the gain $g_c$ and the estimated one $g'_c$ |
| $\hat{\gamma}_{gc}$ | The optimum value for $\gamma_{gc}$ |
| $\gamma'_{sc}$ | Gain scaling factor |
| AGC | Adaptive Gain Control |
| AMR | Adaptive Multi Rate |
| CELP | Code Excited Linear Prediction |
| C/I | Carrier-to-Interferer ratio |
| DTX | Discontinuous Transmission |
| EFR | Enhanced Full Rate |
| FIR | Finite Impulse Response |
| FR | Full Rate |
| HR | Half Rate |
| LP | Linear Prediction |
| LPC | Linear Predictive Coding |
| LSF | Line Spectral Frequency |
| LSF | Line Spectral Pair |
| LTP | Long Term Predictor (or Long Term Prediction) |
| MA | Moving Average |
| TFO | Tandem Free Operation |
| VAD | Voice Activity Detection |

APPENDIX B

Bit ordering (source coding)

| Bits | Description |
|---|---|
| | Bit ordering of output bits from source encoder (11 kbit/s). |
| 1-6 | Index of 1st LSF stage |
| 7-12 | Index of 2nd LSF stage |
| 13-18 | Index of 3rd LSF stage |
| 19-24 | Index of 4th LSF stage |
| 25-28 | Index of 5th LSF stage |
| 29-32 | Index of adaptive codebook gain, 1st subframe |
| 33-37 | Index of fixed codebook gain, 1st subframe |
| 38-41 | Index of adaptive codebook gain, 2nd subframe |
| 42-46 | Index of fixed codebook gain, 2nd subframe |
| 47-50 | Index of adaptive codebook gain, 3rd subframe |
| 51-55 | Index of fixed codebook gain, 3rd subframe |
| 56-59 | Index of adaptive codebook gain, 4th subframe |
| 60-64 | Index of fixed codebook gain, 4th subframe |
| 65-73 | Index of adaptive codebook, 1st subframe |
| 74-82 | Index of adaptive codebook, 3rd subframe |
| 83-88 | Index of adaptive codebook (relative), 2nd subframe |
| 89-94 | Index of adaptive codebook (relative), 4th subframe |
| 95-96 | Index for LSF interpolation |
| 97-127 | Index for fixed codebook 1st subframe |
| 128-158 | Index for fixed codebook, 2nd subframe |
| 159-189 | Index for fixed codebook, 3rd subframe |
| 190-220 | Index for fixed codebook, 4th subframe |

APPENDIX B-continued

Bit ordering (source coding)

| Bits | Description |
|---|---|
| | Bit ordering of output bits from source encoder (8 kbit/s). |
| 1-6 | Index of 1st LSF stage |
| 7-12 | Index of 2nd LSF stage |
| 13-18 | Index of 3rd LSF stage |
| 19-24 | Index of 4th LSF stage |
| 25-31 | Index of fixed and adaptive codebook gains, 1st subframe |
| 32-38 | Index of fixed and adaptive codebook gains, 2nd subframe |
| 39-45 | Index of fixed and adaptive codebook gains, 3rd subframe |
| 46-52 | Index of fixed and adaptive codebook gains, 4th subframe |
| 53-60 | Index of adaptive codebook, 1st subframe |
| 61-68 | Index of adaptive codebook, 3rd subframe |
| 69-73 | Index of adaptive codebook (relative), 2nd subframe |
| 74-78 | Index of adaptive codebook (relative), 4th subframe |
| 79-80 | Index for LSF interpolation |
| 81-100 | Index for fixed codebook, 1st subframe |
| 101-120 | Index for fixed codebook, 2nd subframe |
| 121-140 | Index for fixed codebook, 3rd subframe |
| 141-160 | Index for fixed codebook, 4th subframe |
| | Bit ordering of output bits from source encoder (6.65 kbit/s). |
| 1-6 | Index of 1st LSF stage |
| 7-12 | Index of 2nd LSF stage |
| 13-18 | Index of 3rd LSF stage |
| 19-24 | Index of 4th LSF stage |
| 25-31 | Index of fixed and adaptive codebook gains, 1st subframe |
| 32-38 | Index of fixed and adaptive codebook gains, 2nd subframe |
| 39-45 | Index of fixed and adaptive codebook gains, 3rd subframe |
| 46-52 | Index of fixed and adaptive codebook gains, 4th subframe |
| 53 | Index for mode (LTP or PP) |

| | LTP mode | PP mode |
|---|---|---|
| 54-61 | Index of adaptive codebook, 1st subframe | Index of pitch |
| 62-69 | Index of adaptive codebook, 3rd subframe | |
| 70-74 | Index of adaptive codebook (relative), 2nd subframe | |
| 75-79 | Index of adaptive codebook (relative), 4th subframe | |
| 80-81 | Index for LSF interpolation | Index for LSF interpolation |
| 82-94 | Index for fixed codebook, 1st subframe | Index for fixed codebook, 1st subframe |
| 95-107 | Index for fixed codebook, 2nd subframe | Index for fixed codebook, 2nd subframe |
| 108-120 | Index for fixed codebook, 3rd subframe | Index for fixed codebook, 3rd subframe |
| 121-133 | Index for fixed codebook, 4th subframe | Index for fixed codebook, 4th subframe |

| | |
|---|---|
| | Bit ordering of output bits from source encoder (5.8 kbit/s). |
| 1-6 | Index of 1st LSF stage |
| 7-12 | Index of 2nd LSF stage |
| 13-18 | Index of 3rd LSF stage |
| 19-24 | Index of 4th LSF stage |
| 25-31 | Index of fixed and adaptive codebook gains, 1st subframe |
| 32-38 | Index of fixed and adaptive codebook gains, 2nd subframe |
| 39-45 | Index of fixed and adaptive codebook gains, 3rd subframe |
| 46-52 | Index of fixed and adaptive codebook gains, 4th subframe |
| 53-60 | Index of pitch |
| 61-74 | Index for fixed codebook, 1st subframe |
| 75-88 | Index for fixed codebook, 2nd subframe |
| 89-102 | Index for fixed codebook, 3rd subframe |
| 93-116 | Index for fixed codebook, 4th subframe |
| | Bit ordering of output bits from source encoder (4.55 kbit/s). |
| 1-6 | Index of 1st LSF stage |
| 7-12 | Index of 2nd LSF stage |
| 13-18 | Index of 3rd LSF stage |

APPENDIX B-continued

| Bit ordering (source coding) | |
|---|---|
| Bits | Description |
| 19 | Index of predictor |
| 20-25 | Index of fixed and adaptive codebook gains, 1st subframe |
| 26-31 | Index of fixed and adaptive codebook gains, 2nd subframe |
| 32-37 | Index of fixed and adaptive codebook gains, 3rd subframe |
| 38-43 | Index of fixed and adaptive codebook gains, 4th subframe |
| 44-51 | Index of pitch |
| 52-61 | Index for fixed codebook, 1st subframe |
| 62-71 | Index for fixed codebook, 2nd subframe |
| 72-81 | Index for fixed codebook, 3rd subframe |
| 82-91 | Index for fixed codebook, 4th subframe |

APPENDIX C

| Bit ordering (channel coding) | |
|---|---|
| Bits, see table XXX | Description |
| Ordering of bits according to subjective importance (11 kbit/s FRTCH). | |
| 1 | lsf1-0 |
| 2 | lsf1-1 |
| 3 | lsf1-2 |
| 4 | lsf1-3 |
| 5 | lsf1-4 |
| 6 | lsf1-5 |
| 7 | lsf2-0 |
| 8 | lsf2-1 |
| 9 | lsf2-2 |
| 10 | lsf2-3 |
| 11 | lsf2-4 |
| 12 | lsf2-5 |
| 65 | pitch1-0 |
| 66 | pitch1-1 |
| 67 | pitch1-2 |
| 68 | pitch1-3 |
| 69 | pitch1-4 |
| 70 | pitch1-5 |
| 74 | pitch3-0 |
| 75 | pitch3-1 |
| 76 | pitch3-2 |
| 77 | pitch3-3 |
| 78 | pitch3-4 |
| 79 | pitch3-5 |
| 29 | gp1-0 |
| 30 | gp1-1 |
| 38 | gp2-0 |
| 39 | gp2-1 |
| 47 | gp3-0 |
| 48 | gp3-1 |
| 56 | gp4-0 |
| 57 | gp4-1 |
| 33 | gc1-0 |
| 34 | gc1-1 |
| 35 | gc1-2 |
| 42 | gc2-0 |
| 43 | gc2-1 |
| 44 | gc2-2 |
| 51 | gc3-0 |
| 52 | gc3-1 |
| 53 | gc3-2 |
| 60 | gc4-0 |
| 61 | gc4-1 |
| 62 | gc4-2 |
| 71 | pitch1-6 |
| 72 | pitch1-7 |
| 73 | pitch1-8 |
| 80 | pitch3-6 |
| 81 | pitch3-7 |
| 82 | pitch3-8 |
| 83 | pitch2-0 |
| 84 | pitch2-1 |
| 85 | pitch2-2 |
| 86 | pitch2-3 |

APPENDIX C-continued

| Bit ordering (channel coding) | |
|---|---|
| Bits, see table XXX | Description |
| 87 | pitch2-4 |
| 88 | pitch2-5 |
| 89 | pitch4-0 |
| 90 | pitch4-1 |
| 91 | pitch4-2 |
| 92 | pitch4-3 |
| 93 | pitch4-4 |
| 94 | pitch4-5 |
| 13 | lsf3-0 |
| 14 | lsf3-1 |
| 15 | lsf3-2 |
| 16 | lsf3-3 |
| 17 | lsf3-4 |
| 18 | lsf3-5 |
| 19 | lsf4-0 |
| 20 | lsf4-1 |
| 21 | lsf4-2 |
| 22 | lsf4-3 |
| 23 | lsf4-4 |
| 24 | lsf4-5 |
| 25 | lsf5-0 |
| 26 | lsf5-1 |
| 27 | lsf5-2 |
| 28 | lsf5-3 |
| 31 | gp1-2 |
| 32 | gp1-3 |
| 40 | gp2-2 |
| 41 | gp2-3 |
| 49 | gp3-2 |
| 50 | gp3-3 |
| 58 | gp4-2 |
| 59 | gp4-3 |
| 36 | gc1-3 |
| 45 | gc2-3 |
| 54 | gc3-3 |
| 63 | gc4-3 |
| 97 | exc1-0 |
| 98 | exc1-1 |
| 99 | exc1-2 |
| 100 | exc1-3 |
| 101 | exc1-4 |
| 102 | exc1-5 |
| 103 | exc1-6 |
| 104 | exc1-7 |
| 105 | exc1-8 |
| 106 | exc1-9 |
| 107 | exc1-10 |
| 108 | exc1-11 |
| 109 | exc1-12 |
| 110 | exc1-13 |
| 111 | exc1-14 |
| 112 | exc1-15 |
| 113 | exc1-16 |
| 114 | exc1-17 |
| 115 | exc1-18 |
| 116 | exc1-19 |
| 117 | exc1-20 |
| 118 | exc1-21 |
| 119 | exc1-22 |
| 120 | exc1-23 |
| 121 | exc1-24 |
| 122 | exc1-25 |
| 123 | exc1-26 |
| 124 | exc1-27 |
| 125 | exc1-28 |
| 128 | exc2-0 |
| 129 | exc2-1 |
| 130 | exc2-2 |
| 131 | exc2-3 |
| 132 | exc2-4 |
| 133 | exc2-5 |
| 134 | exc2-6 |
| 135 | exc2-7 |
| 136 | exc2-8 |
| 137 | exc2-9 |
| 138 | exc2-10 |

APPENDIX C-continued

Bit ordering (channel coding)

| Bits, see table XXX | Description |
|---|---|
| 139 | exc2-11 |
| 140 | exc2-12 |
| 141 | exc2-13 |
| 142 | exc2-14 |
| 143 | exc2-15 |
| 144 | exc2-16 |
| 145 | exc2-17 |
| 146 | exc2-18 |
| 147 | exc2-19 |
| 148 | exc2-20 |
| 149 | exc2-21 |
| 150 | exc2-22 |
| 151 | exc2-23 |
| 152 | exc2-24 |
| 153 | exc2-25 |
| 154 | exc2-26 |
| 155 | exc2-27 |
| 156 | exc2-28 |
| 159 | exc3-0 |
| 160 | exc3-1 |
| 161 | exc3-2 |
| 162 | exc3-3 |
| 163 | exc3-4 |
| 164 | exc3-5 |
| 165 | exc3-6 |
| 166 | exc3-7 |
| 167 | exc3-8 |
| 168 | exc3-9 |
| 169 | exc3-10 |
| 170 | exc3-11 |
| 171 | exc3-12 |
| 172 | exc3-13 |
| 173 | exc3-14 |
| 174 | exc3-15 |
| 175 | exc3-16 |
| 176 | exc3-17 |
| 177 | exc3-18 |
| 178 | exc3-19 |
| 179 | exc3-20 |
| 180 | exc3-21 |
| 181 | exc3-22 |
| 182 | exc3-23 |
| 183 | exc3-24 |
| 184 | exc3-25 |
| 185 | exc3-26 |
| 186 | exc3-27 |
| 187 | exc3-28 |
| 190 | exc4-0 |
| 191 | exc4-1 |
| 192 | exc4-2 |
| 193 | exc4-3 |
| 194 | exc4-4 |
| 195 | exc4-5 |
| 196 | exc4-6 |
| 197 | exc4-7 |
| 198 | exc4-8 |
| 199 | exc4-9 |
| 200 | exc4-10 |
| 201 | exc4-11 |
| 202 | exc4-12 |
| 203 | exc4-13 |
| 204 | exc4-14 |
| 205 | exc4-15 |
| 206 | exc4-16 |
| 207 | exc4-17 |
| 208 | exc4-18 |
| 209 | exc4-19 |
| 210 | exc4-20 |
| 211 | exc4-21 |
| 212 | exc4-22 |
| 213 | exc4-23 |
| 214 | exc4-24 |
| 215 | exc4-25 |
| 216 | exc4-26 |
| 217 | exc4-27 |
| 218 | exc4-28 |

APPENDIX C-continued

Bit ordering (channel coding)

| Bits, see table XXX | Description |
|---|---|
| 37 | gc1-4 |
| 46 | gc2-4 |
| 55 | gc3-4 |
| 64 | gc4-4 |
| 126 | exc1-29 |
| 127 | exc1-30 |
| 157 | exc2-29 |
| 158 | exc2-30 |
| 188 | exc3-29 |
| 189 | exc3-30 |
| 219 | exc4-29 |
| 220 | exc4-30 |
| 95 | interp-0 |
| 96 | interp-1 |

Ordering of bits according to subjective importance (8.0 kbit/s FRTCH).

| | |
|---|---|
| 1 | lsf1-0 |
| 2 | lsf1-1 |
| 3 | lsf1-2 |
| 4 | lsf1-3 |
| 5 | lsf1-4 |
| 6 | lsf1-5 |
| 7 | lsf2-0 |
| 8 | lsf2-1 |
| 9 | lsf2-2 |
| 10 | lsf2-3 |
| 11 | lsf2-4 |
| 12 | lsf2-5 |
| 25 | gain1-0 |
| 26 | gain1-1 |
| 27 | gain1-2 |
| 28 | gain1-3 |
| 29 | gain1-4 |
| 32 | gain2-0 |
| 33 | gain2-1 |
| 34 | gain2-2 |
| 35 | gain2-3 |
| 36 | gain2-4 |
| 39 | gain3-0 |
| 40 | gain3-1 |
| 41 | gain3-2 |
| 42 | gain3-3 |
| 43 | gain3-4 |
| 46 | gain4-0 |
| 47 | gain4-1 |
| 48 | gain4-2 |
| 49 | gain4-3 |
| 50 | gain4-4 |
| 53 | pitch1-0 |
| 54 | pitch1-1 |
| 55 | pitch1-2 |
| 56 | pitch1-3 |
| 57 | pitch1-4 |
| 58 | pitch1-5 |
| 61 | pitch3-0 |
| 62 | pitch3-1 |
| 63 | pitch3-2 |
| 64 | pitch3-3 |
| 65 | pitch3-4 |
| 66 | pitch3-5 |
| 69 | pitch2-0 |
| 70 | pitch2-1 |
| 71 | pitch2-2 |
| 74 | pitch4-0 |
| 75 | pitch4-1 |
| 76 | pitch4-2 |
| 13 | lsf3-0 |
| 14 | lsf3-1 |
| 15 | lsf3-2 |
| 16 | lsf3-3 |
| 17 | lsf3-4 |
| 18 | lsf3-5 |
| 30 | gain1-5 |
| 37 | gain2-5 |
| 44 | gain3-5 |
| 51 | gain4-5 |

APPENDIX C-continued

Bit ordering (channel coding)

| Bits, see table XXX | Description |
|---|---|
| 59 | pitch1-6 |
| 67 | pitch3-6 |
| 72 | pitch2-3 |
| 77 | pitch4-3 |
| 79 | interp-0 |
| 80 | interp-1 |
| 31 | gain1-6 |
| 38 | gain2-6 |
| 45 | gain3-6 |
| 52 | gain4-6 |
| 19 | lsf4-0 |
| 20 | lsf4-1 |
| 21 | lsf4-2 |
| 22 | lsf4-3 |
| 23 | lsf4-4 |
| 24 | lsf4-5 |
| 60 | pitch1-7 |
| 68 | pitch3-7 |
| 73 | pitch2-4 |
| 78 | pitch4-4 |
| 81 | exc1-0 |
| 82 | exc1-1 |
| 83 | exc1-2 |
| 84 | exc1-3 |
| 85 | exc1-4 |
| 86 | exc1-5 |
| 87 | exc1-6 |
| 88 | exc1-7 |
| 89 | exc1-8 |
| 90 | exc1-9 |
| 91 | exc1-10 |
| 92 | exc1-11 |
| 93 | exc1-12 |
| 94 | exc1-13 |
| 95 | exc1-14 |
| 96 | exc1-15 |
| 97 | exc1-16 |
| 98 | exc1-17 |
| 99 | exc1-18 |
| 100 | exc1-19 |
| 101 | exc2-0 |
| 102 | exc2-1 |
| 103 | exc2-2 |
| 104 | exc2-3 |
| 105 | exc2-4 |
| 106 | exc2-5 |
| 107 | exc2-6 |
| 108 | exc2-7 |
| 109 | exc2-8 |
| 110 | exc2-9 |
| 111 | exc2-10 |
| 112 | exc2-11 |
| 113 | exc2-12 |
| 114 | exc2-13 |
| 115 | exc2-14 |
| 116 | exc2-15 |
| 117 | exc2-16 |
| 118 | exc2-17 |
| 119 | exc2-18 |
| 120 | exc2-19 |
| 121 | exc3-0 |
| 122 | exc3-1 |
| 123 | exc3-2 |
| 124 | exc3-3 |
| 125 | exc3-4 |
| 126 | exc3-5 |
| 127 | exc3-6 |
| 128 | exc3-7 |
| 129 | exc3-8 |
| 130 | exc3-9 |
| 131 | exc3-10 |
| 132 | exc3-11 |
| 133 | exc3-12 |
| 134 | exc3-13 |
| 135 | exc3-14 |
| 136 | exc3-15 |

APPENDIX C-continued

Bit ordering (channel coding)

| Bits, see table XXX | Description |
|---|---|
| 137 | exc3-16 |
| 138 | exc3-17 |
| 139 | exc3-18 |
| 140 | exc3-19 |
| 141 | exc4-0 |
| 142 | exc4-1 |
| 143 | exc4-2 |
| 144 | exc4-3 |
| 145 | exc4-4 |
| 146 | exc4-5 |
| 147 | exc4-6 |
| 148 | exc4-7 |
| 149 | exc4-8 |
| 150 | exc4-9 |
| 151 | exc4-10 |
| 152 | exc4-11 |
| 153 | exc4-12 |
| 154 | exc4-13 |
| 155 | exc4-14 |
| 156 | exc4-15 |
| 157 | exc4-16 |
| 158 | exc4-17 |
| 159 | exc4-18 |
| 160 | exc4-19 |
| Ordering of bits according to subjective importance (6.65 kbit/s FRTCH). | |
| 54 | pitch-0 |
| 55 | pitch-1 |
| 56 | pitch-2 |
| 57 | pitch-3 |
| 58 | pitch-4 |
| 59 | pitch-5 |
| 1 | lsf1-0 |
| 2 | lsf1-1 |
| 3 | lsf1-2 |
| 4 | lsf1-3 |
| 5 | lsf1-4 |
| 6 | lsf1-5 |
| 25 | gain1-0 |
| 26 | gain1-1 |
| 27 | gain1-2 |
| 28 | gain1-3 |
| 32 | gain2-0 |
| 33 | gain2-1 |
| 34 | gain2-2 |
| 35 | gain2-3 |
| 39 | gain3-0 |
| 40 | gain3-1 |
| 41 | gain3-2 |
| 42 | gain3-3 |
| 46 | gain4-0 |
| 47 | gain4-1 |
| 48 | gain4-2 |
| 49 | gain4-3 |
| 29 | gain1-4 |
| 36 | gain2-4 |
| 43 | gain3-4 |
| 50 | gain4-4 |
| 53 | mode-0 |
| 98 | exc3-0 pitch-0(Second subframe) |
| 99 | exc3-1 pitch-1(Second subframe) |
| 7 | lsf2-0 |
| 8 | lsf2-1 |
| 9 | lsf2-2 |
| 10 | lsf2-3 |
| 11 | lsf2-4 |
| 12 | lsf2-5 |
| 30 | gain1-5 |
| 37 | gain2-5 |
| 44 | gain3-5 |
| 51 | gain4-5 |
| 62 | exc1-0 pitch-0(Third subframe) |
| 63 | exc1-1 pitch-1(Third subframe) |
| 64 | exc1-2 pitch-2(Third subframe) |
| 65 | exc1-3 pitch-3(Third subframe) |
| 66 | exc1-4 pitch-4(Third subframe) |

APPENDIX C-continued

Bit ordering (channel coding)

| Bits, see table XXX | Description |
|---|---|
| 80 | exc2-0 pitch-5(Third subframe) |
| 100 | exc3-2 pitch-2(Second subframe) |
| 116 | exc4-0 pitch-0(Fourth subframe) |
| 117 | exc4-1 pitch-1(Fourth subframe) |
| 118 | exc4-2 pitch-2(Fourth subframe) |
| 13 | lsf3-0 |
| 14 | lsf3-1 |
| 15 | lsf3-2 |
| 16 | lsf3-3 |
| 17 | lsf3-4 |
| 18 | lsf3-5 |
| 19 | lsf4-0 |
| 20 | lsf4-1 |
| 21 | lsf4-2 |
| 22 | lsf4-3 |
| 67 | exc1-5 exc1(1tp) |
| 68 | exc1-6 exc1(1tp) |
| 69 | exc1-7 exc1(1tp) |
| 70 | exc1-8 exc1(1tp) |
| 71 | exc1-9 exc1(1tp) |
| 72 | exc1-10 |
| 81 | exc2-1 exc2(1tp) |
| 82 | exc2-2 exc2(1tp) |
| 83 | exc2-3 exc2(1tp) |
| 84 | exc2-4 exc2(1tp) |
| 85 | exc2-5 exc2(1tp) |
| 86 | exc2-6 exc2(1tp) |
| 87 | exc2-7 |
| 88 | exc2-8 |
| 89 | exc2-9 |
| 90 | exc2-10 |
| 101 | exc3-3 exc3(1tp) |
| 102 | exc3-4 exc3(1tp) |
| 103 | exc3-5 exc3(1tp) |
| 104 | exc3-6 exc3(1tp) |
| 105 | exc3-7 exc3(1tp) |
| 106 | exc3-8 |
| 107 | exc3-9 |
| 108 | exc3-10 |
| 119 | exc4-3 exc4(1tp) |
| 120 | exc4-4 exc4(1tp) |
| 121 | exc4-5 exc4(1tp) |
| 122 | exc4-6 exc4(1tp) |
| 123 | exc4-7 exc4(1tp) |
| 124 | exc4-8 |
| 125 | exc4-9 |
| 126 | exc4-10 |
| 73 | exc1-11 |
| 91 | exc2-11 |
| 109 | exc3-11 |
| 127 | exc4-11 |
| 74 | exc1-12 |
| 92 | exc2-12 |
| 110 | exc3-12 |
| 128 | exc4-12 |
| 60 | pitch-6 |
| 61 | pitch-7 |
| 23 | lsf4-4 |
| 24 | lsf4-5 |
| 75 | exc1-13 |
| 93 | exc2-13 |
| 111 | exc3-13 |
| 129 | exc4-13 |
| 31 | gain1-6 |
| 38 | gain2-6 |
| 45 | gain3-6 |
| 52 | gain4-6 |
| 76 | exc1-14 |
| 77 | exc1-15 |
| 94 | exc2-14 |
| 95 | exc2-15 |
| 112 | exc3-14 |
| 113 | exc3-15 |
| 130 | exc4-14 |
| 131 | exc4-15 |
| 78 | exc1-16 |

APPENDIX C-continued

Bit ordering (channel coding)

| Bits, see table XXX | Description |
|---|---|
| 96 | exc2-16 |
| 114 | exc3-16 |
| 132 | exc4-16 |
| 79 | exc1-17 |
| 97 | exc2-17 |
| 115 | exc3-17 |
| 133 | exc4-17 |
| Ordering of bits according to subjective importance (5.8 kbit/s FRTCH). | |
| 53 | pitch-0 |
| 54 | pitch-1 |
| 55 | pitch-2 |
| 56 | pitch-3 |
| 57 | pitch-4 |
| 58 | pitch-5 |
| 1 | lsf1-0 |
| 2 | lsf1-1 |
| 3 | lsf1-2 |
| 4 | lsf1-3 |
| 5 | lsf1-4 |
| 6 | lsf1-5 |
| 7 | lsf2-0 |
| 8 | lsf2-1 |
| 9 | lsf2-2 |
| 10 | lsf2-3 |
| 11 | lsf2-4 |
| 12 | lsf2-5 |
| 25 | gain1-0 |
| 26 | gain1-1 |
| 27 | gain1-2 |
| 28 | gain1-3 |
| 29 | gain1-4 |
| 32 | gain2-0 |
| 33 | gain2-1 |
| 34 | gain2-2 |
| 35 | gain2-3 |
| 36 | gain2-4 |
| 39 | gain3-0 |
| 40 | gain3-1 |
| 41 | gain3-2 |
| 42 | gain3-3 |
| 43 | gain3-4 |
| 46 | gain4-0 |
| 47 | gain4-1 |
| 48 | gain4-2 |
| 49 | gain4-3 |
| 50 | gain4-4 |
| 30 | gain1-5 |
| 37 | gain2-5 |
| 44 | gain3-5 |
| 51 | gain4-5 |
| 13 | lsf3-0 |
| 14 | lsf3-1 |
| 15 | lsf3-2 |
| 16 | lsf3-3 |
| 17 | lsf3-4 |
| 18 | lsf3-5 |
| 59 | pitch-6 |
| 60 | pitch-7 |
| 19 | lsf4-0 |
| 20 | lsf4-1 |
| 21 | lsf4-2 |
| 22 | lsf4-3 |
| 23 | lsf4-4 |
| 24 | lsf4-5 |
| 31 | gain1-6 |
| 38 | gain2-6 |
| 45 | gain3-6 |
| 52 | gain4-6 |
| 61 | exc1-0 |
| 75 | exc2-0 |
| 89 | exc3-0 |
| 103 | exc4-0 |
| 62 | exc1-1 |
| 63 | exc1-2 |
| 64 | exc1-3 |

APPENDIX C-continued

Bit ordering (channel coding)

| Bits, see table XXX | Description |
|---|---|
| 65 | exc1-4 |
| 66 | exc1-5 |
| 67 | exc1-6 |
| 68 | exc1-7 |
| 69 | exc1-8 |
| 70 | exc1-9 |
| 71 | exc1-10 |
| 72 | exc1-11 |
| 73 | exc1-12 |
| 74 | exc1-13 |
| 76 | exc2-1 |
| 77 | exc2-2 |
| 78 | exc2-3 |
| 79 | exc2-4 |
| 80 | exc2-5 |
| 81 | exc2-6 |
| 82 | exc2-7 |
| 83 | exc2-8 |
| 84 | exc2-9 |
| 85 | exc2-10 |
| 86 | exc2-11 |
| 87 | exc2-12 |
| 88 | exc2-13 |
| 90 | exc3-1 |
| 91 | exc3-2 |
| 92 | exc3-3 |
| 93 | exc3-4 |
| 94 | exc3-5 |
| 95 | exc3-6 |
| 96 | exc3-7 |
| 97 | exc3-8 |
| 98 | exc3-9 |
| 99 | exc3-10 |
| 100 | exc3-11 |
| 101 | exc3-12 |
| 102 | exc3-13 |
| 104 | exc4-1 |
| 105 | exc4-2 |
| 106 | exc4-3 |
| 107 | exc4-4 |
| 108 | exc4-5 |
| 109 | exc4-6 |
| 110 | exc4-7 |
| 111 | exc4-8 |
| 112 | exc4-9 |
| 113 | exc4-10 |
| 114 | exc4-11 |
| 115 | exc4-12 |
| 116 | exc4-13 |
| Ordering of bits according to subjective importance (8.0 kbit/s HRTCH). | |
| 1 | lsf1-0 |
| 2 | lsf1-1 |
| 3 | lsf1-2 |
| 4 | lsf1-3 |
| 5 | lsf1-4 |
| 6 | lsf1-5 |
| 25 | gain1-0 |
| 26 | gain1-1 |
| 27 | gain1-2 |
| 28 | gain1-3 |
| 32 | gain2-0 |
| 33 | gain2-1 |
| 34 | gain2-2 |
| 35 | gain2-3 |
| 39 | gain3-0 |
| 40 | gain3-1 |
| 41 | gain3-2 |
| 42 | gain3-3 |
| 46 | gain4-0 |
| 47 | gain4-1 |
| 48 | gain4-2 |
| 49 | gain4-3 |
| 53 | pitch1-0 |
| 54 | pitch1-1 |
| 55 | pitch1-2 |

APPENDIX C-continued

Bit ordering (channel coding)

| Bits, see table XXX | Description |
|---|---|
| 56 | pitch1-3 |
| 57 | pitch1-4 |
| 58 | pitch1-5 |
| 61 | pitch3-0 |
| 62 | pitch3-1 |
| 63 | pitch3-2 |
| 64 | pitch3-3 |
| 65 | pitch3-4 |
| 66 | pitch3-5 |
| 69 | pitch2-0 |
| 70 | pitch2-1 |
| 71 | pitch2-2 |
| 74 | pitch4-0 |
| 75 | pitch4-1 |
| 76 | pitch4-2 |
| 7 | lsf2-0 |
| 8 | lsf2-1 |
| 9 | lsf2-2 |
| 10 | lsf2-3 |
| 11 | lsf2-4 |
| 12 | lsf2-5 |
| 29 | gain1-4 |
| 36 | gain2-4 |
| 43 | gain3-4 |
| 50 | gain4-4 |
| 79 | interp-0 |
| 80 | interp-1 |
| 13 | lsf3-0 |
| 14 | lsf3-1 |
| 15 | lsf3-2 |
| 16 | lsf3-3 |
| 17 | lsf3-4 |
| 18 | lsf3-5 |
| 19 | lsf4-0 |
| 20 | lsf4-1 |
| 21 | lsf4-2 |
| 22 | lsf4-3 |
| 23 | lsf4-4 |
| 24 | lsf4-5 |
| 30 | gain1-5 |
| 31 | gain1-6 |
| 37 | gain2-5 |
| 38 | gain2-6 |
| 44 | gain3-5 |
| 45 | gain3-6 |
| 51 | gain4-5 |
| 52 | gain4-6 |
| 59 | pitch1-6 |
| 67 | pitch3-6 |
| 72 | pitch2-3 |
| 77 | pitch4-3 |
| 60 | pitch1-7 |
| 68 | pitch3-7 |
| 73 | pitch2-4 |
| 78 | pitch4-4 |
| 81 | exc1-0 |
| 82 | exc1-1 |
| 83 | exc1-2 |
| 84 | exc1-3 |
| 85 | exc1-4 |
| 86 | exc1-5 |
| 87 | exc1-6 |
| 88 | exc1-7 |
| 89 | exc1-8 |
| 90 | exc1-9 |
| 91 | exc1-10 |
| 92 | exc1-11 |
| 93 | exc1-12 |
| 94 | exc1-13 |
| 95 | exc1-14 |
| 96 | exc1-15 |
| 97 | exc1-16 |
| 98 | exc1-17 |
| 99 | exc1-18 |
| 100 | exc1-19 |
| 101 | exc2-0 |

APPENDIX C-continued

Bit ordering (channel coding)

| Bits, see table XXX | Description |
|---|---|
| 102 | exc2-1 |
| 103 | exc2-2 |
| 104 | exc2-3 |
| 105 | exc2-4 |
| 106 | exc2-5 |
| 107 | exc2-6 |
| 108 | exc2-7 |
| 109 | exc2-8 |
| 110 | exc2-9 |
| 111 | exc2-10 |
| 112 | exc2-11 |
| 113 | exc2-12 |
| 114 | exc2-13 |
| 115 | exc2-14 |
| 116 | exc2-15 |
| 117 | exc2-16 |
| 118 | exc2-17 |
| 119 | exc2-18 |
| 120 | exc2-19 |
| 121 | exc3-0 |
| 122 | exc3-1 |
| 123 | exc3-2 |
| 124 | exc3-3 |
| 125 | exc3-4 |
| 126 | exc3-5 |
| 127 | exc3-6 |
| 128 | exc3-7 |
| 129 | exc3-8 |
| 130 | exc3-9 |
| 131 | exc3-10 |
| 132 | exc3-11 |
| 133 | exc3-12 |
| 134 | exc3-13 |
| 135 | exc3-14 |
| 136 | exc3-15 |
| 137 | exc3-16 |
| 138 | exc3-17 |
| 139 | exc3-18 |
| 140 | exc3-19 |
| 141 | exc4-0 |
| 142 | exc4-1 |
| 143 | exc4-2 |
| 144 | exc4-3 |
| 145 | exc4-4 |
| 146 | exc4-5 |
| 147 | exc4-6 |
| 148 | exc4-7 |
| 149 | exc4-8 |
| 150 | exc4-9 |
| 151 | exc4-10 |
| 152 | exc4-11 |
| 153 | exc4-12 |
| 154 | exc4-13 |
| 155 | exc4-14 |
| 156 | exc4-15 |
| 157 | exc4-16 |
| 158 | exc4-17 |
| 159 | exc4-18 |
| 160 | exc4-19 |

Ordering of bits according to subjective importance (6.65 kbit/s HRTCH).

| | |
|---|---|
| 53 | mode-0 |
| 54 | pitch-0 |
| 55 | pitch-1 |
| 56 | pitch-2 |
| 57 | pitch-3 |
| 58 | pitch-4 |
| 59 | pitch-5 |
| 1 | lsf1-0 |
| 2 | lsf1-1 |
| 3 | lsf1-2 |
| 4 | lsf1-3 |
| 5 | lsf1-4 |
| 6 | lsf1-5 |
| 7 | lsf2-0 |
| 8 | lsf2-1 |

APPENDIX C-continued

Bit ordering (channel coding)

| Bits, see table XXX | Description |
|---|---|
| 9 | lsf2-2 |
| 10 | lsf2-3 |
| 11 | lsf2-4 |
| 12 | lsf2-5 |
| 25 | gain1-0 |
| 26 | gain1-1 |
| 27 | gain1-2 |
| 28 | gain1-3 |
| 32 | gain2-0 |
| 33 | gain2-1 |
| 34 | gain2-2 |
| 35 | gain2-3 |
| 39 | gain3-0 |
| 40 | gain3-1 |
| 41 | gain3-2 |
| 42 | gain3-3 |
| 46 | gain4-0 |
| 47 | gain4-1 |
| 48 | gain4-2 |
| 49 | gain4-3 |
| 29 | gain1-4 |
| 36 | gain2-4 |
| 43 | gain3-4 |
| 50 | gain4-4 |
| 62 | exc1-0 pitch-0(Third subframe) |
| 63 | exc1-1 pitch-1(Third subframe) |
| 64 | exc1-2 pitch-2(Third subframe) |
| 65 | exc1-3 pitch-3(Third subframe) |
| 80 | exc2-0 pitch-5(Third subframe) |
| 98 | exc3-0 pitch-0(Second subframe) |
| 99 | exc3-1 pitch-1(Second subframe) |
| 100 | exc3-2 pitch-2(Second subframe) |
| 116 | exc4-0 pitch-0(Fourth subframe) |
| 117 | exc4-1 pitch-1(Fourth subframe) |
| 118 | exc4-2 pitch-2(Fourth subframe) |
| 13 | lsf3-0 |
| 14 | lsf3-1 |
| 15 | lsf3-2 |
| 16 | lsf3-3 |
| 17 | lsf3-4 |
| 18 | lsf3-5 |
| 19 | lsf4-0 |
| 20 | lsf4-1 |
| 21 | lsf4-2 |
| 22 | lsf4-3 |
| 23 | lsf4-4 |
| 24 | lsf4-5 |
| 81 | exc2-1 exc2(1tp) |
| 82 | exc2-2 exc2(1tp) |
| 83 | exc2-3 exc2(1tp) |
| 101 | exc3-3 exc3(1tp) |
| 119 | exc4-3 exc4(1tp) |
| 66 | exc1-4 pitch-4(Third subframe) |
| 84 | exc2-4 exc2(1tp) |
| 102 | exc3-4 exc3(1tp) |
| 120 | exc4-4 exc4(1tp) |
| 67 | exc1-5 exc1(1tp) |
| 68 | exc1-6 exc1(1tp) |
| 69 | exc1-7 exc1(1tp) |
| 70 | exc1-8 exc1(1tp) |
| 71 | exc1-9 exc1(1tp) |
| 72 | exc1-10 |
| 73 | exc1-11 |
| 85 | exc2-5 exc2(1tp) |
| 86 | exc2-6 exc2(1tp) |
| 87 | exc2-7 |
| 88 | exc2-8 |
| 89 | exc2-9 |
| 90 | exc2-10 |
| 91 | exc2-11 |
| 103 | exc3-5 exc3(1tp) |
| 104 | exc3-6 exc3(1tp) |
| 105 | exc3-7 exc3(1tp) |
| 106 | exc3-8 |
| 107 | exc3-9 |
| 108 | exc3-10 |

APPENDIX C-continued

Bit ordering (channel coding)

| Bits, see table XXX | Description |
|---|---|
| 109 | exc3-11 |
| 121 | exc4-5 exc4(1tp) |
| 122 | exc4-6 exc4(1tp) |
| 123 | exc4-7 exc4(1tp) |
| 124 | exc4-8 |
| 125 | exc4-9 |
| 126 | exc4-10 |
| 127 | exc4-11 |
| 30 | gain1-5 |
| 31 | gain1-6 |
| 37 | gain2-5 |
| 38 | gain2-6 |
| 44 | gain3-5 |
| 45 | gain3-6 |
| 51 | gain4-5 |
| 52 | gain4-6 |
| 60 | pitch-6 |
| 61 | pitch-7 |
| 74 | exc1-12 |
| 75 | exc1-13 |
| 76 | exc1-14 |
| 77 | exc1-15 |
| 92 | exc2-12 |
| 93 | exc2-13 |
| 94 | exc2-14 |
| 95 | exc2-15 |
| 110 | exc3-12 |
| 111 | exc3-13 |
| 112 | exc3-14 |
| 113 | exc3-15 |
| 128 | exc4-12 |
| 129 | exc4-13 |
| 130 | exc4-14 |
| 131 | exc4-15 |
| 78 | exc1-16 |
| 96 | exc2-16 |
| 114 | exc3-16 |
| 132 | exc4-16 |
| 79 | exc1-17 |
| 97 | exc2-17 |
| 115 | exc3-17 |
| 133 | exc4-17 |

Ordering of bits according to subjective importance (5.8 kbit/s HRTCH)

| | |
|---|---|
| 25 | gain1-0 |
| 26 | gain1-1 |
| 32 | gain2-0 |
| 33 | gain2-1 |
| 39 | gain3-0 |
| 40 | gain3-1 |
| 46 | gain4-0 |
| 47 | gain4-1 |
| 1 | lsf1-0 |
| 2 | lsf1-1 |
| 3 | lsf1-2 |
| 4 | lsf1-3 |
| 5 | lsf1-4 |
| 6 | lsf1-5 |
| 27 | gain1-2 |
| 34 | gain2-2 |
| 41 | gain3-2 |
| 48 | gain4-2 |
| 53 | pitch-0 |
| 54 | pitch-1 |
| 55 | pitch-2 |
| 56 | pitch-3 |
| 57 | pitch-4 |
| 58 | pitch-5 |
| 28 | gain1-3 |
| 29 | gain1-4 |
| 35 | gain2-3 |
| 36 | gain2-4 |
| 42 | gain3-3 |
| 43 | gain3-4 |
| 49 | gain4-3 |
| 50 | gain4-4 |

APPENDIX C-continued

Bit ordering (channel coding)

| Bits, see table XXX | Description |
|---|---|
| 7 | lsf2-0 |
| 8 | lsf2-1 |
| 9 | lsf2-2 |
| 10 | lsf2-3 |
| 11 | lsf2-4 |
| 12 | lsf2-5 |
| 13 | lsf1-0 |
| 14 | lsf1-1 |
| 15 | lsf1-2 |
| 16 | lsf1-3 |
| 17 | lsf1-4 |
| 18 | lsf1-5 |
| 19 | lsf4-0 |
| 20 | lsf4-1 |
| 21 | lsf4-2 |
| 22 | lsf4-3 |
| 30 | gain1-5 |
| 37 | gain2-5 |
| 44 | gain3-5 |
| 51 | gain4-5 |
| 31 | gain1-6 |
| 38 | gain2-6 |
| 45 | gain3-6 |
| 52 | gain4-6 |
| 61 | exc1-0 |
| 62 | exc1-1 |
| 63 | exc1-2 |
| 64 | exc1-3 |
| 75 | exc2-0 |
| 76 | exc2-1 |
| 77 | exc2-2 |
| 78 | exc2-3 |
| 89 | exc3-0 |
| 90 | exc3-1 |
| 91 | exc3-2 |
| 92 | exc3-3 |
| 103 | exc4-0 |
| 104 | exc4-1 |
| 105 | exc4-2 |
| 106 | exc4-3 |
| 23 | lsf4-4 |
| 24 | lsf4-5 |
| 59 | pitch-6 |
| 60 | pitch-7 |
| 65 | exc1-4 |
| 66 | exc1-5 |
| 67 | exc1-6 |
| 68 | exc1-7 |
| 69 | exc1-8 |
| 70 | exc1-9 |
| 71 | exc1-10 |
| 72 | exc1-11 |
| 73 | exc1-12 |
| 74 | exc1-13 |
| 79 | exc2-4 |
| 80 | exc2-5 |
| 81 | exc2-6 |
| 82 | exc2-7 |
| 83 | exc2-8 |
| 84 | exc2-9 |
| 85 | exc2-10 |
| 86 | exc2-11 |
| 87 | exc2-12 |
| 88 | exc2-13 |
| 93 | exc3-4 |
| 94 | exc3-5 |
| 95 | exc3-6 |
| 96 | exc3-7 |
| 97 | exc3-8 |
| 98 | exc3-9 |
| 99 | exc3-10 |
| 100 | exc3-11 |
| 101 | exc3-12 |
| 102 | exc3-13 |
| 107 | exc4-4 |
| 108 | exc4-5 |

APPENDIX C-continued

| Bit ordering (channel coding) | |
|---|---|
| Bits, see table XXX | Description |
| 109 | exc4-6 |
| 110 | exc4-7 |
| 111 | exc4-8 |
| 112 | exc4-9 |
| 113 | exc4-10 |
| 114 | exc4-11 |
| 115 | exc4-12 |
| 116 | exc4-13 |
| Ordering of bits according to subjective importance (4.55 kbit/s HRTCH). | |
| 20 | gain1-0 |
| 26 | gain2-0 |
| 44 | pitch-0 |
| 45 | pitch-1 |
| 46 | pitch-2 |
| 32 | gain3-0 |
| 38 | gain4-0 |
| 21 | gain1-1 |
| 27 | gain2-1 |
| 33 | gain3-1 |
| 39 | gain4-1 |
| 19 | prd . . . lsf |
| 1 | lsf1-0 |
| 2 | lsf1-1 |
| 3 | lsf1-2 |
| 4 | lsf1-3 |
| 5 | lsf1-4 |
| 6 | lsf1-5 |
| 7 | lsf2-0 |
| 8 | lsf2-1 |
| 9 | lsf2-2 |
| 22 | gain1-2 |
| 28 | gain2-2 |
| 34 | gain3-2 |
| 40 | gain4-2 |
| 23 | gain1-3 |
| 29 | gain2-3 |
| 35 | gain3-3 |
| 41 | gain4-3 |
| 47 | pitch-3 |
| 10 | lsf2-3 |
| 11 | lsf2-4 |
| 12 | lsf2-5 |
| 24 | gain1-4 |
| 30 | gain2-4 |
| 36 | gain3-4 |
| 42 | gain4-4 |
| 48 | pitch-4 |
| 49 | pitch-5 |
| 13 | lsf3-0 |
| 14 | lsf3-1 |
| 15 | lsf3-2 |
| 16 | lsf3-3 |
| 17 | lsf3-4 |
| 18 | lsf3-5 |
| 25 | gain1-5 |
| 31 | gain2-5 |
| 37 | gain3-5 |
| 43 | gain4-5 |
| 50 | pitch-6 |
| 51 | pitch-7 |
| 52 | exc1-0 |
| 53 | exc1-1 |
| 54 | exc1-2 |
| 55 | exc1-3 |
| 56 | exc1-4 |
| 57 | exc1-5 |
| 58 | exc1-6 |
| 62 | exc2-0 |
| 63 | exc2-1 |
| 64 | exc2-2 |
| 65 | exc2-3 |
| 66 | exc2-4 |
| 67 | exc2-5 |
| 72 | exc3-0 |
| 73 | exc3-1 |

APPENDIX C-continued

| Bit ordering (channel coding) | |
|---|---|
| Bits, see table XXX | Description |
| 74 | exc3-2 |
| 75 | exc3-3 |
| 76 | exc3-4 |
| 77 | exc3-5 |
| 82 | exc4-0 |
| 83 | exc4-1 |
| 84 | exc4-2 |
| 85 | exc4-3 |
| 86 | exc4-4 |
| 87 | exc4-5 |
| 59 | exc1-7 |
| 60 | exc1-8 |
| 61 | exc1-9 |
| 68 | exc2-6 |
| 69 | exc2-7 |
| 70 | exc2-8 |
| 71 | exc2-9 |
| 78 | exc3-6 |
| 79 | exc3-7 |
| 80 | exc3-8 |
| 81 | exc3-9 |
| 88 | exc4-6 |
| 89 | exc4-7 |
| 90 | exc4-8 |
| 91 | exc4-9 |

While various embodiments of the invention have been described, it will be apparent to those of ordinary skill in the art that many more embodiments and implementations are possible that are within the scope of the invention. Accordingly, the invention is not to be restricted except in light of the attached claims and their equivalents.

The following is claimed:

1. A method of encoding a speech signal, the method comprising:

analyzing each frame of a plurality of frames of the speech signal to determine one or more speech parameters for the speech signal, wherein one parameter of the one or more speech parameters includes one or more pitch lags;

deciding, for each frame of the plurality of frames of the speech signal, based on the one or more speech parameters of the speech signal, to select one of a plurality of encoding modes including a first encoding mode, a second encoding mode and a third encoding mode for encoding each frame of the plurality of frames of the speech signal;

converting the speech signal into an encoded speech by encoding each frame of the plurality of frames of the speech signal according to the selected one of the plurality of encoding modes for each frame of the plurality of frames in the deciding;

wherein the first encoding mode supports a first encoding rate, the second encoding mode supports a second encoding rate and the third encoding mode supports a third encoding rate, wherein the first encoding rate is the same encoding rate as the second encoding rate, wherein the third encoding rate is different than the first encoding rate and the second encoding rate, and wherein the converting of the speech signal to the encoded speech signal for each frame of the plurality of frames of the speech signal further comprises encoding a single pitch lag of the one or more pitch lags if the encoding mode is one of the second encoding mode and the third encoding mode;

wherein the converting of the speech signal to an encoded speech signal for each frame of the plurality of frames of the speech signal comprises encoding of a single pitch lag of the one or more pitch lags if the encoding mode is the second encoding mode or the third encoding mode.

2. The method of claim 1, wherein the first encoding rate and the second encoding rate are both at 6.65 kbps, and the third encoding rate is 5.80 kbps.

3. The method of claim 1, wherein the first encoding mode is long-term prediction mode (LTP_mode) and the second encoding mode and the third encoding mode are pitch preprocessing mode (PP_mode).

4. The method of claim 1, wherein the deciding is based on the one or more speech parameters of the speech signal including a pitch lag parameter.

5. The method of claim 1, wherein the deciding is based on the one or more speech parameters of the speech signal including a pitch gain parameter.

6. The method of claim 1, wherein the deciding is based on the one or more speech parameters of the speech signal including a line spectrum frequency LSF parameter.

7. The method of claim 1, wherein the deciding is based on the one or more speech parameters of the speech signal including a pitch correlation parameter.

8. The method of claim 1, wherein the deciding is based on the one or more speech parameters of the speech signal including linear prediction analysis parameters.

9. The method of claim 8, wherein the deciding is based on the one or more speech parameters of the speech signal including a distance measure between linear prediction analysis parameters.

10. The method of claim 1, wherein the first encoding mode supports a plurality of encoding rates including the first encoding rate and the second encoding mode supports a plurality of encoding rates including the second encoding rate.

11. A speech encoding system for encoding a speech signal, the speech encoding system comprising:

an encoder processing circuit configured to:

analyze each frame of a plurality of frames of the speech signal to determine one or more speech parameters for the speech signal, wherein one parameter of the one or more speech parameters includes one or more pitch lags;

decide, for each frame of the plurality of frames of the speech signal, based on the one or more speech parameters of the speech signal, to select one of a plurality of encoding modes including a first encoding, a second encoding mode and a third encoding mode for encoding each frame of the plurality of frames of the speech signal;

convert the speech signal into an encoded speech by encoding each frame of the plurality of frames of the speech signal according to the selected one of the plurality of encoding modes for each frame of the plurality of frames, thereby converting the speech signal into an encoded speech;

wherein the first encoding mode supports a first encoding rate, the second encoding mode supports a second encoding rate and the third encoding mode supports a third encoding rate, wherein the first encoding rate is the same encoding rate as the second encoding rate, wherein the third encoding rate is different than the first encoding rate and the second encoding rate, wherein converting the speech signal to the encoded speech signal for each frame of the plurality of frames of the speech signal further comprises encoding a single pitch lag of the one or more pitch lags if the encoding mode is one of the second encoding mode and the third encoding mode.

12. The speech encoding system of claim 11, wherein the first encoding rate and the second encoding rate are both at 6.65 kbps, and the third encoding rate is 5.80 kbps.

13. The speech encoding system of claim 11, wherein the first encoding mode is long-term prediction mode (LTP_mode) and the second encoding mode and the third encoding mode are pitch preprocessing mode (PP_mode).

14. The speech encoding system of claim 11, wherein the encoder processing circuit is configured to decide based on the one or more speech parameters of the speech signal including a pitch lag parameter.

15. The speech encoding system of claim 11, wherein the encoder processing circuit is configured to decide based on the one or more speech parameters of the speech signal including a pitch gain parameter.

16. The speech encoding system of claim 11, wherein the encoder processing circuit is configured to decide based on the one or more speech parameters of the speech signal including a line spectrum frequency LSF parameter.

17. The speech encoding system of claim 11, wherein the encoder processing circuit is configured to decide based on the one or more speech parameters of the speech signal including a pitch correlation parameter.

18. The speech encoding system of claim 11, wherein the encoder processing circuit is configured to decide based on the one or more speech parameters of the speech signal including linear prediction analysis parameters.

19. The speech encoding system of claim 18, wherein the encoder processing circuit is configured to decide based on the one or more speech parameters of the speech signal including a distance measure between linear prediction analysis parameters.

20. The speech encoding system of claim 11, wherein the first encoding mode supports a plurality of encoding rates including the first encoding rate and the second encoding mode supports a plurality of encoding rates including the second encoding rate.

21. The method of claim 1, wherein the converting of the speech signal to the encoded speech signal for each frame of the plurality of frames of the speech signal uses Code Excited Linear Prediction (CELP) if the encoding mode is the first encoding mode.

22. The speech encoding system of claim 11, wherein converting the speech signal to the encoded speech signal for each frame of the plurality of frames of the speech signal uses Code Excited Linear Prediction (CELP) if the encoding mode is the first encoding mode.

* * * * *

UNITED STATES PATENT AND TRADEMARK OFFICE

CERTIFICATE OF CORRECTION

PATENT NO. : 8,650,028 B2
APPLICATION NO. : 12/229324
DATED : February 11, 2014
INVENTOR(S) : Gao et al.

It is certified that error appears in the above-identified patent and that said Letters Patent is hereby corrected as shown below:

In the claims,

Column 80, line 60, “encoded speech signal” should be changed to --encoded speech--.

Column 81, line 53, “an” should be changed to --the--.

Column 82, line 3, “encoding rate,” should be changed to --encoding rate, and--.

Column 82, line 5, “speech signal,” should be changed to --speech--.

Column 82, line 48, “encoded speech signal,” should be changed to --encoded speech--.

Column 82, line 53, “encoded speech signal,” should be changed to --encoded speech--.

Signed and Sealed this
Eleventh Day of November, 2014

Michelle K. Lee

Michelle K. Lee
*Deputy Director of the United States Patent and Trademark Office*